US011439280B2

(12) United States Patent
Mann et al.

(10) Patent No.: US 11,439,280 B2
(45) Date of Patent: Sep. 13, 2022

(54) WIPES DISPENSING CANISTERS AND WIPES DISPENSING CANISTER MOUNTING BRACKETS

(71) Applicant: GOJO Industries, Inc., Akron, OH (US)

(72) Inventors: Christopher J. Mann, Hudson, OH (US); Mark E. Rosenkranz, Akron, OH (US); John P. Cichello, Wooster, OH (US); Aaron D. Marshall, Silver Lake, OH (US); Mark Wesley Moore, Seven Hills, OH (US); Richard E. Corney, Akron, OH (US); Ann Marie Hicho, North Royalton, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 17/095,809

(22) Filed: Nov. 12, 2020

(65) Prior Publication Data

US 2021/0137322 A1 May 13, 2021

Related U.S. Application Data

(60) Provisional application No. 62/934,235, filed on Nov. 12, 2019, provisional application No. 62/934,862, filed on Nov. 13, 2019.

(51) Int. Cl.
*A47K 10/32* (2006.01)
*B65D 83/08* (2006.01)

(52) U.S. Cl.
CPC ..... *A47K 10/32* (2013.01); *B65D 83/0805* (2013.01); *A47K 2010/3233* (2013.01); *A47K 2010/3266* (2013.01)

(58) Field of Classification Search
CPC ..... A47K 10/32
(Continued)

(56) References Cited

U.S. PATENT DOCUMENTS

D256,859 S 9/1980 Hauser et al.
D300,891 S 5/1989 Roland
(Continued)

OTHER PUBLICATIONS

International Search Report and Written Opinion from PCT/US2020/060117 dated Apr. 12, 2021.
(Continued)

*Primary Examiner* — Gene O Crawford
*Assistant Examiner* — Ayodeji T Ojofeitimi
(74) *Attorney, Agent, or Firm* — Calfee, Halter & Griswold LLP

(57) ABSTRACT

Exemplary embodiments of wipes dispensing systems, wipes dispensing canisters and wipes dispensing mounting brackets are disclosed herein. An exemplary wipes dispensing system includes a wipes dispensing canister. The wipes dispensing canister includes one of a catch and a latch and a cap. A wall mounting bracket is included. The wall mounting bracket includes an opening for receiving the wipes dispensing canister, a first wall located on the inside of the opening and a second wall located on the inside of the opening. A cap ridge is formed between the first wall and the second wall. The wall mounting bracket further includes one of a catch and a latch. When the wipes dispensing canister is located within the wall mounting bracket, a bottom edge of the cap is located proximate the cap edge.

20 Claims, 38 Drawing Sheets

(58) Field of Classification Search
USPC ..... 221/33–63
See application file for complete search history.

(56) References Cited

U.S. PATENT DOCUMENTS

| | | | |
|---|---|---|---|
| 4,846,429 | A | 7/1989 | Scheurer et al. |
| D303,566 | S | 9/1989 | Kohler, Jr. et al. |
| D318,607 | S | 7/1991 | Reid et al. |
| D319,575 | S | 9/1991 | Young |
| 5,087,005 | A | 2/1992 | Holoff et al. |
| 5,180,132 | A | 1/1993 | Pearson et al. |
| D415,951 | S | 11/1999 | Kraine |
| D422,204 | S | 4/2000 | Holloway et al. |
| D444,978 | S | 7/2001 | Kauzlarich et al. |
| 6,386,494 | B1 | 5/2002 | Huang |
| 6,422,402 | B1 | 7/2002 | Hollinger |
| 6,596,374 | B1 | 7/2003 | Adjeleian |
| 7,124,987 | B2 | 10/2006 | Zschiedrich |
| 7,264,197 | B2 | 9/2007 | Yu |
| D552,453 | S | 10/2007 | Cronk et al. |
| 7,338,020 | B2 | 3/2008 | Magid |
| 7,607,622 | B2 | 10/2009 | Carnevali |
| 7,708,245 | B2 | 5/2010 | Woo |
| 7,850,133 | B2 | 12/2010 | Carnevali |
| 7,861,647 | B2 | 1/2011 | So et al. |
| 7,975,971 | B2 | 7/2011 | Carnevali |
| 8,028,850 | B2 | 10/2011 | Zimmerman |
| 8,033,517 | B2 | 10/2011 | Wilcoxon |
| 8,235,336 | B2 | 8/2012 | Lin et al. |
| 8,302,920 | B2 | 11/2012 | Tsai |
| 8,505,861 | B2 | 8/2013 | Carnevali |
| 8,757,418 | B2 | 6/2014 | Zimmerman et al. |
| 8,757,426 | B1 | 6/2014 | Serrano |
| 8,757,572 | B1 | 6/2014 | Starr et al. |
| D712,099 | S | 8/2014 | Pelletier |
| D718,953 | S | 12/2014 | Masino |
| 8,998,158 | B2 | 4/2015 | St. Jacques |
| D760,549 | S | 7/2016 | Haytayan et al. |
| D760,550 | S | 7/2016 | Haytayan et al. |
| D782,882 | S | 4/2017 | Haytayan et al. |
| D823,647 | S | 7/2018 | Curl, Jr. |
| 10,098,815 | B2 | 10/2018 | Zerebny |
| 10,165,906 | B1 | 1/2019 | Beychok et al. |
| 10,342,396 | B2 | 7/2019 | Sellars et al. |
| D910,259 | S | 2/2021 | Stack |
| D921,373 | S | 6/2021 | Fearing |
| 2003/0116582 | A1 | 6/2003 | Tosdale |
| 2011/0192862 | A1* | 8/2011 | Knudsen ..... A47K 10/3818 221/46 |
| 2016/0000275 | A1 | 1/2016 | Sellars et al. |
| 2017/0245699 | A1* | 8/2017 | Keily ..... A47K 10/38 |
| 2017/0354299 | A1 | 12/2017 | Scholer |
| 2020/0375414 | A1 | 12/2020 | Albrecht |
| 2021/0137322 | A1 | 5/2021 | Mann et al. |

OTHER PUBLICATIONS

Amazon.com, CraftsOfEgypt White—Marble Wine Bottle Coaster-Coaster. (Jan. 26, 2016). Accessed: Oct. 4, 2021. URL: <https ://www.amazon.com/Coaster-Elegant-Absorbent-Occasion-CraftOfEgypt/dp/BOOV2 RO RG2> (Year: 2016).

* cited by examiner

WIPES DISPENSING CANISTERS AND WIPES DISPENSING CANISTER MOUNTING BRACKETS

RELATED APPLICATIONS

The present invention claims priority to and the benefits of U.S. Provisional Application Ser. No. 62/934,235 titled "WIPES DISPENSING CANISTERS AND WIPES DISPENSING CANISTER MOUNTING BRACKETS", filed on Nov. 12, 2019 and U.S. Provisional Application Ser. No. 62/934,862 titled "REMOVABLE SURFACE MOUNTING MECHANISM USING A PARTIAL VACUUM" filed on Nov. 13, 2019, both of which are incorporated herein by reference in their entirety.

TECHNICAL FIELD

The present invention generally relates to methods and systems for dispensing wipes or moist towelettes. More particularly, the present invention relates to mounting brackets for cylindrical wipes dispensing containers.

BACKGROUND OF THE INVENTION

Wipes are typically made from a variety of materials, such as non-woven materials. Wipes are often moistened with solutions, such as cleaning solutions and/or antimicrobial solutions. The wipes may be stacked and folded in a container or may be in the form of a roll. Wipes in the form of a roll typically have perforations between the individual wipes. The strength of the material between the individual wipes is important as it needs to be strong enough so the wipes remain attached to one another until the top of the trailing wipe is pulled up through a dispensing outlet nozzle and weak enough to break when the leading tail of the trailing wipe is high enough above the outlet nozzle that it may be grabbed by a user and pulled out of the container when another wipe is required.

The wipes are often packaged and shipped in cylindrical dispensing containers. The cylindrical dispensing containers often have a cap. The cap typically includes an opening for the wipe to be pulled through and a rip fence for separating the lead wipe from the trailing wipe. The cap often includes lid attached thereto to close off and seal the container. Using the cylindrical dispensing container generally requires two hands. One hand to hold the container and the other hand to pull the wipe from the container.

SUMMARY

Exemplary embodiments of wipes dispensing systems, wipes dispensing canisters and wipes dispensing mounting brackets are disclosed herein. An exemplary wipes dispensing system includes a wipes dispensing canister. The wipes dispensing canister includes one of a catch and a latch and a cap. A wall mounting bracket is included. The wall mounting bracket includes an opening for receiving the wipes dispensing canister, a first wall located on the inside of the opening and a second wall located on the inside of the opening. A cap ridge is formed between the first wall and the second wall. The wall mounting bracket further includes one of a catch and a latch. When the wipes dispensing canister is located within the wall mounting bracket, a bottom edge of the cap is located proximate the cap edge.

Another exemplary wipes dispensing system includes a wipes dispensing canister and a wall mounting bracket. The wipes dispensing canister includes a cap and one of a catch and a latch. The wall mounting bracket includes a circular opening for receiving the wipes dispensing canister. The circular opening surrounds at least a portion of the wipes dispensing canister when the wipes dispensing canister is installed in the wall mounting bracket. At least a portion of the cap is located within the circular opening when the wipes dispensing canister is installed in the wall mounting bracket. The wall mounting bracket also includes one of a catch and a latch. When the wipes dispensing canister is located within the wall mounting bracket, the latch and the catch engage to secure the wipes dispensing canister in the wall mounting bracket.

An exemplary wipes dispensing canister includes a cylindrical body, a cap, a first catch configured to engaging a latch of a wall mounting bracket, and a second catch configured to engage a latch of a base mounting bracket.

Another exemplary wipes dispensing system includes a wipes dispensing canister and a base mounting bracket. The wipes dispensing canister includes one of a catch and a latch; and a cap. The base mounting bracket includes an opening for receiving the wipes dispensing canister, a bottom, a surface engagement member located on the bottom of the base and one of a catch and a latch. When the wipes dispensing canister is located within the base mounting bracket, the wipes dispensing canister is secured to the base.

An exemplary wipes dispensing system includes a wipes dispensing canister and a wall mounting bracket. The wipes dispensing canister includes one of a catch and a latch and a cap. The wall mounting bracket includes an opening therethrough for receiving the wipes dispensing canister, a cap ridge for engaging a portion of the cap to support the wipes dispensing canister in the wall mounting bracket and one of a catch and a latch. When the wipes dispensing canister is located within the wall mounting bracket, a bottom edge of the cap is located proximate the cap ridge, and a bottom of the wipes dispensing canister is located below a bottom of the wall mounting bracket.

Another exemplary embodiment of a wipes dispensing system includes a base. The base includes a receiver, a sealing device, a base plate, one or more canister retention members and an actuator. The actuator has a plurality of functional positions. In a first functional position, the base is sealed to a surface with a suction force and a wipes dispensing canister is engaged by the one or more wipes canister retention members thereby retaining the wipes dispensing canister in the base. In a second functional position, at least one of a) the suction force is released allowing the base to be freely removable from the surface and b) the canister retention members are disengaged from the wipes dispensing canister allowing the wipes dispensing canister to be removed from the base.

Exemplary wipes dispensing canisters are disclosed herein. An exemplary wipes dispensing canister includes an elongated body, a base, and an annular groove located at least partially around the elongated body. The annular groove is configured to mate with a wipes canister retention member located in a base mounting bracket for a wipes dispensing canister.

Another exemplary embodiment of a base for mounting a canister containing wipes to a surface includes the canister is disclosed herein. The canister includes a canister wall extending between a first end and a second end. The canister wall having an interior surface and an exterior surface. The interior surface defines a space for containing the wipes, wherein the wipes are removable from the canister through an opening in the canister. The exterior surface defines an annular feature. The mechanism also includes a base mountable to the surface. The base includes an attachment structure movable between a first position and a second position. When the attachment structure is in the second position, the attachment structure engages the annular feature to attach the canister to the base and mount the canister to the surface through the base when the base is mounted to the surface. When the attachment structure is in the first position, the attachment structure does not engage the annular feature such that the canister is detachable from the base.

Another exemplary embodiment of a base for a mechanism for mounting a canister containing wipes to a surface is disclosed herein. The base is mountable to the surface and the base includes a receiver. The receiver includes a receiver wall extending between a first end and a second end. The receiver wall has an interior surface and an exterior surface. The interior surface defines a receptacle for receiving a plate. The plate includes a first attachment structure and a second attachment structure. The first attachment structure is movable between a first position and a second position. The first attachment structure is biased to the first position such that the first attachment structure is in the first position when the first attachment structure is not received within the receptacle. The first attachment structure is moved to the second position when the first attachment structure is received within the receptacle. The second attachment structure is movable between a first position and a second position. The second attachment structure is biased to the first position such that the second attachment structure is in the first position when the second attachment structure is not received within the receptacle. The second attachment structure is moved to the second position when the second attachment structure is received within the receptacle. A greatest dimension of the receptacle as measured between a first point on the interior surface and a second point on the interior surface is less than a distance between the first attachment structure and the second attachment structure when the first attachment structure is in the first position and the second attachment structure is in the first position. The greatest dimension of the receptacle is not less than the distance between the first attachment structure and the second attachment structure when the first attachment structure is in the second position and the second attachment structure is in the second position. The receptacle is configured to receive the canister. When the first attachment structure is in the second position and the second attachment structure is in the second position, the first attachment structure and the second attachment structure engage an annular feature defined on an exterior surface of the canister to attach the canister to the base and mount the canister to the surface through the base when the base is mounted to the surface. When the first attachment structure is in the first position and the second attachment structure is in the first position the first attachment structure and the second attachment structure do not engage the annular feature such that the canister is detachable from the base.

Another exemplary embodiment of a base for a mechanism for mounting a canister containing wipes to a surface is disclosed herein. The base includes an actuator movable between a first position, a second position, and a third position. When the actuator is in the first position, a vent aperture defined in the actuator is not over an airtight volume defined by the mechanism that mounts the mechanism to the surface. As such, ambient air is not in fluid communication with the airtight volume to disrupt the airtight volume and enable the mechanism to be dismounted from the surface. Also when the actuator is in the first position, the actuator does not decouple a coupling arrangement between a first coupling member and a second coupling member of the mechanism such that an attachment structure of the mechanism attaches the canister to the mechanism such that the canister is mounted to the surface through the mechanism. When the actuator is in the second position, the actuator does decouple the coupling arrangement between the first coupling member and the second coupling member such that the attachment structure does not attach the canister to the mechanism and the canister is not mounted to the surface through the mechanism. Also when the actuator is in the second position, the vent aperture is not over the airtight volume such that ambient air is not in fluid communication with the airtight volume to disrupt the airtight volume and enable the mechanism to be dismounted from the surface. When the actuator is in the third position, the vent aperture is over the airtight volume such that ambient air is in fluid communication with the airtight volume to disrupt the airtight volume and enable the mechanism to be dismounted from the surface.

BRIEF DESCRIPTION OF THE DRAWINGS

These and other features and advantages of the present invention will become better understood with regard to the following description, and accompanying drawings where:

FIG. 52 is a prospective view of the base plate in the receiver with canister retention members in an open or released position;

FIG. 54 is a cross-sectional view of a base and a portion of a wipes dispensing canister with the canister retention members in an open or disengaged position;

DETAILED DESCRIPTION

Figure 1:
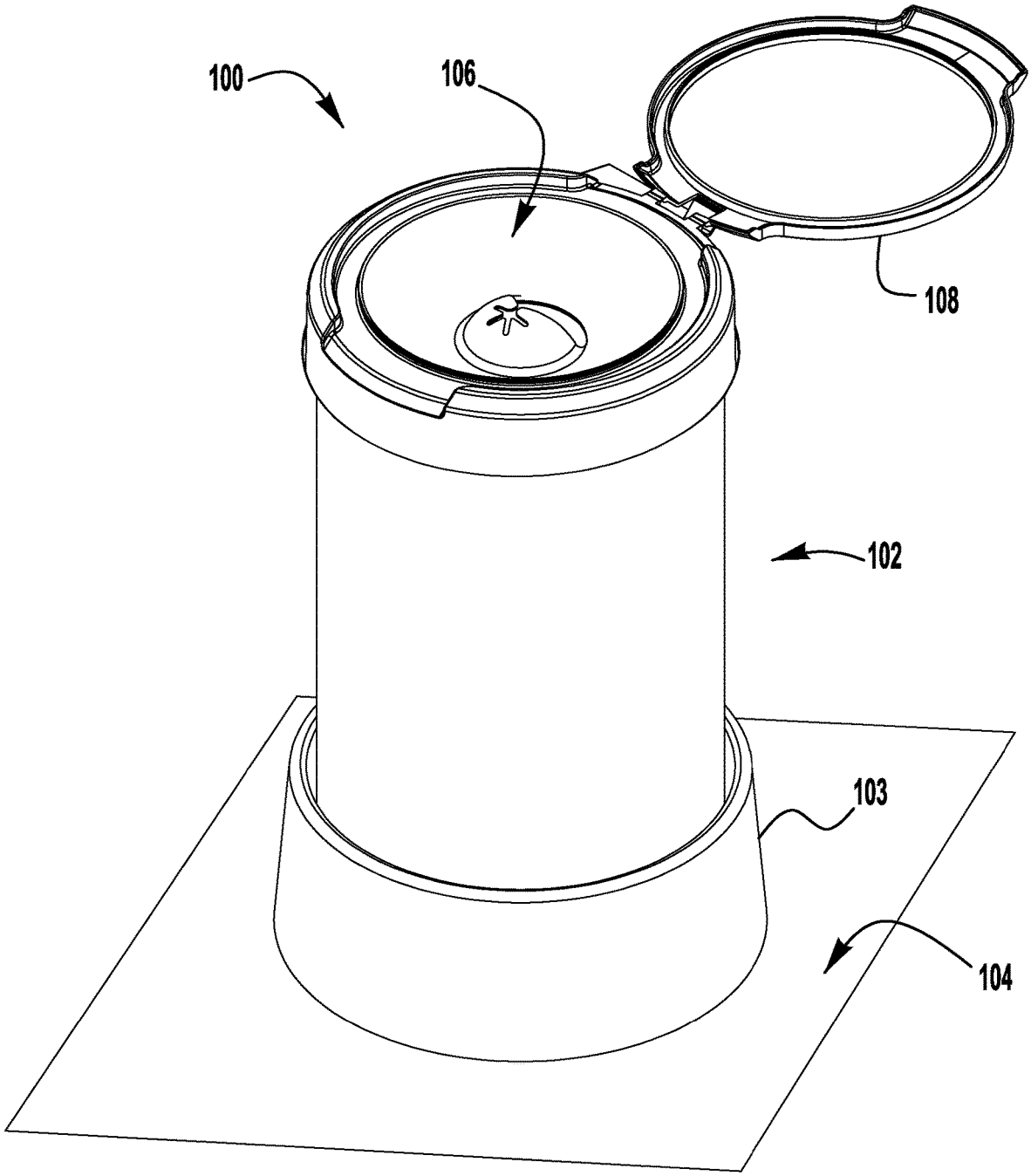
FIG. 1 is a prospective view of an exemplary base mounted wipes dispensing system.

Referring to FIG. 1, an example wipes dispensing system 100. Wipes dispensing system 100 includes a base 103 for securing a wipes canister 102 containing wipes to a surface 104. In some embodiments, the wipes canister 102 can include an opening 106 such that a plurality of wipes are removable from the wipes canister 102 through the opening 106. Additionally, a lid 108 can be provided for the wipes canister 102 to inhibit contamination, drying, etc. of the plurality of wipes that may be inside the wipes canister 102 or partially inside the wipes canister 102. The wipes canister 102 can be used for storing and dispensing a product. The product can be a material that can comprise any type of a wipe, sanitary wipes, bathing wipes, disinfectant wipes, anti-bacterial wipes, etc. In some embodiments, the wipes may be made of materials such as polyester, polypropylene, cotton, wood pulp, or rayon fibers formed into sheets. These wipes may comprise, for example, cleaning materials such as disinfectants, sanitizers, antiseptics, soaps, moisturizers, alcohol-infused liquids, or the like. Indeed, the product is not specifically limited to these examples, and could include other types of materials.

The wipes dispensing system 100 is selectively mountable on a surface 104, such as, for example, a horizontal or nearly horizontal surface at locations where wipes are commonly used. In some embodiments, the dispenser may be mounted to a surface (not shown), such as, for example, a desk, a counter, a table, or the like. The wipes dispensing system 100 can be used in any number of environments, including, but not limited to, hospitals, medical clinics, kitchens, bathrooms, prisons/jails, rehabilitation facilities, nursing homes, restaurants, schools, factories, warehouses, etc.

Figure 2:
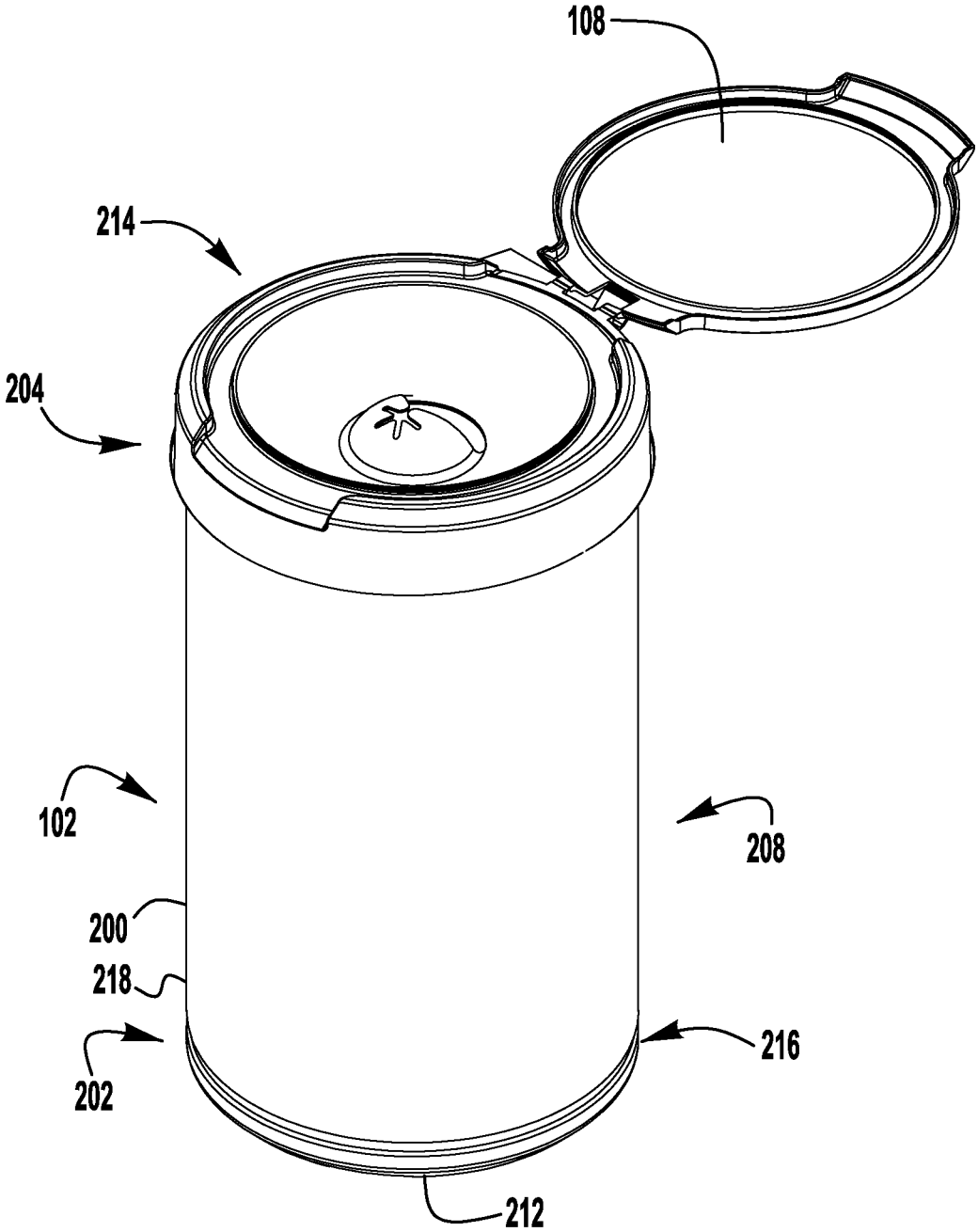
FIGS. 2 and 3 are prospective views of exemplary wipes dispensing canisters for the exemplary base mounted wipes dispensing systems.

Referring to FIG. 2, the wipes canister 102 is detached or separated from the base 103 is illustrated. The wipes canister 102 includes a canister wall 200 extending between a first end 202 and a second end 204. The canister wall 200 has an interior surface 506 (shown in FIG. 5) and an exterior surface 208. The interior surface 506 defines a space for containing the wipes. In some embodiments, the canister wall 200 can define the space within which wipes can be stored and/or dispensed. In some examples, the canister wall 200 can have a circular cross-section such that the space defined by the canister wall 200 is cylindrical. Other example cross-sections are also contemplated, such as square, rectangular, etc. Additional walls can be added to achieve particular desired functional and aesthetic needs of the wipes canister 102, such as a bottom wall 212, a cap 214 including the lid 108, etc.

The exterior surface 208 defines an annular feature 216 configured to be engaged by a portion of the wipes dispensing system 100 to secure the wipes canister 102 to the base 103. Examples of this cooperation between the base 103 and the annular feature 216 will be further described below. In some embodiments, the annular feature 216 is concave relative to a portion 218 of the exterior surface 208 not defining the annular feature 216. As shown in FIG. 2, the annular feature 216 may be continuous about the exterior surface 208. Additionally, the annular feature 216 can be located at a fixed distance from the bottom wall 212.

Figure 3:
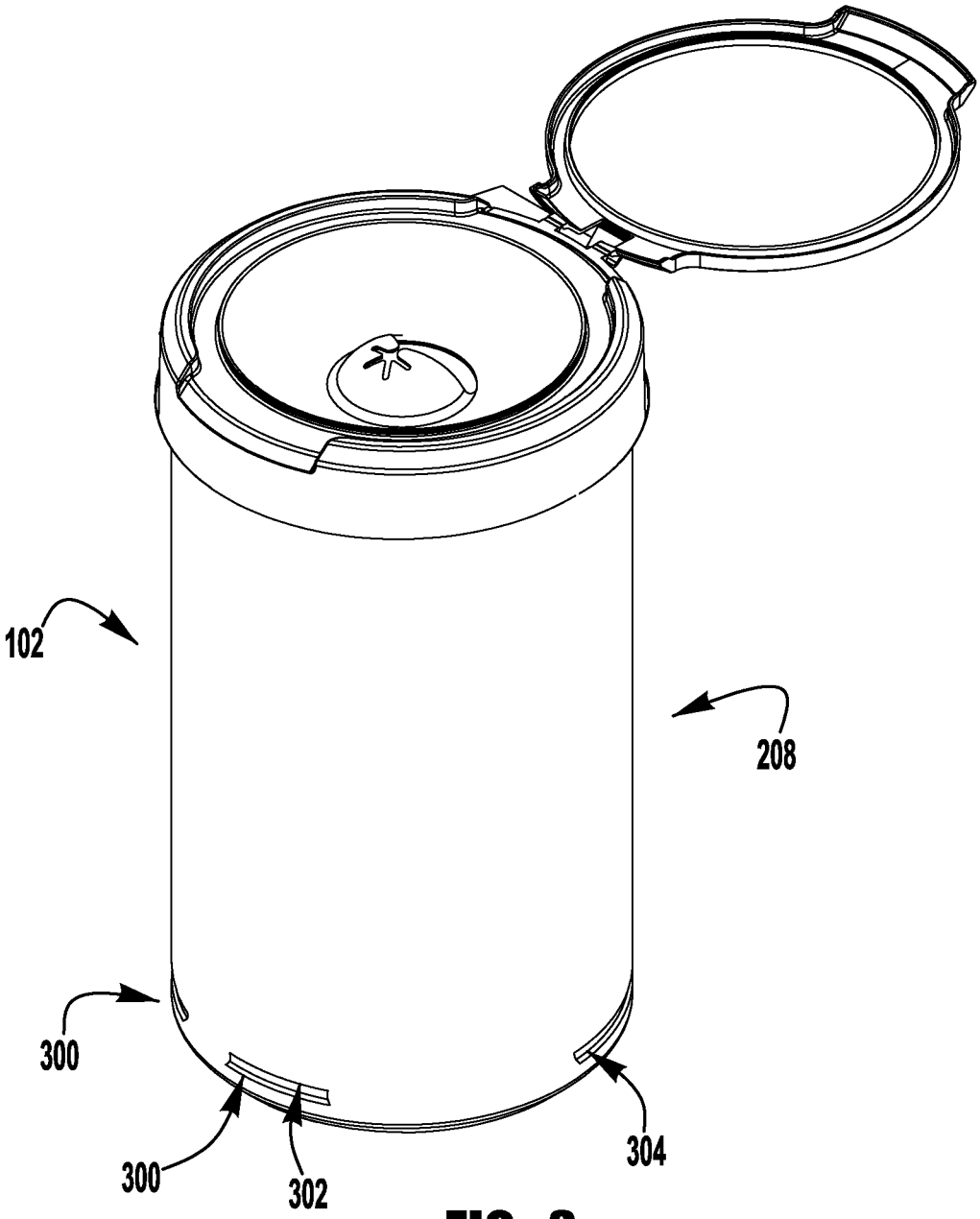

Referring to FIG. 3, there are some examples of the wipes canister 102 having a discontinuous annular feature 300. In other words, the annular feature 300 comprises a plurality of portions 302, 304 about the exterior surface 208. Any suitable arrangement of portions 302, 304 may be used depending on the desired configuration. In some embodiments, the portions 302, 304 are uniformly spaced around the circumference of the exterior surface 208. In other examples, the portions 302, 304 are not uniformly spaced around the circumference of the exterior surface 208. In some embodiments, the portions 302, 304 include differing dimensions such that the sizes/lengths of the portions 302, 304 are not uniform. The general spacing and sizing of the portions 302, 304 of the annular feature 300 will be discussed in greater detail below. In some embodiments, portions 302 may be non-uniform or non-uniformly spaced such that the when the mating latches (not shown) that couple to the annular feature(s) 300 couple in a manner that allows for the wipes canister 102 to be orientated in a desired direction.

Figure 4:
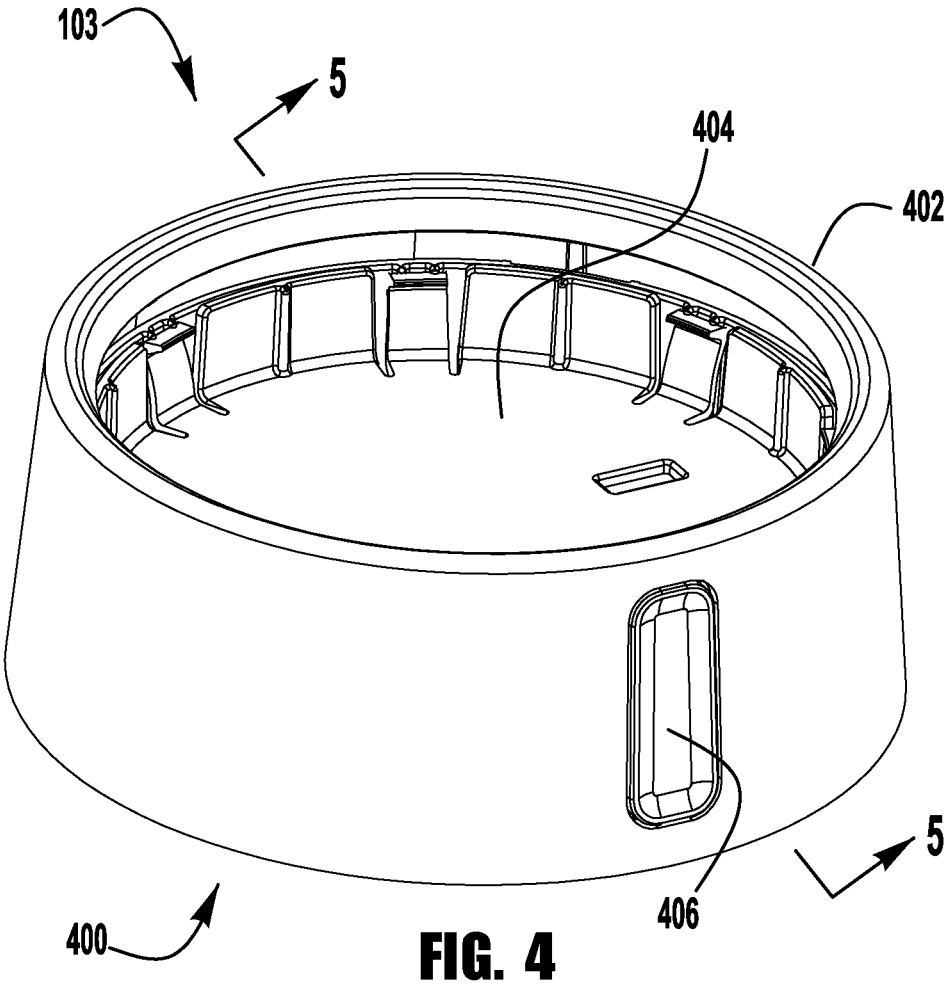
FIG. 4 is an exemplary base for a base mounted wipes dispensing system.

Referring to FIG. 4, a perspective view of an exemplary base 400 without the wipes canister 102 (i.e., the wipes canister 102 is detached and removed from the base 400). The base 400 includes a base cover 402, a base plate 404, and an actuator 406.

Figure 5:
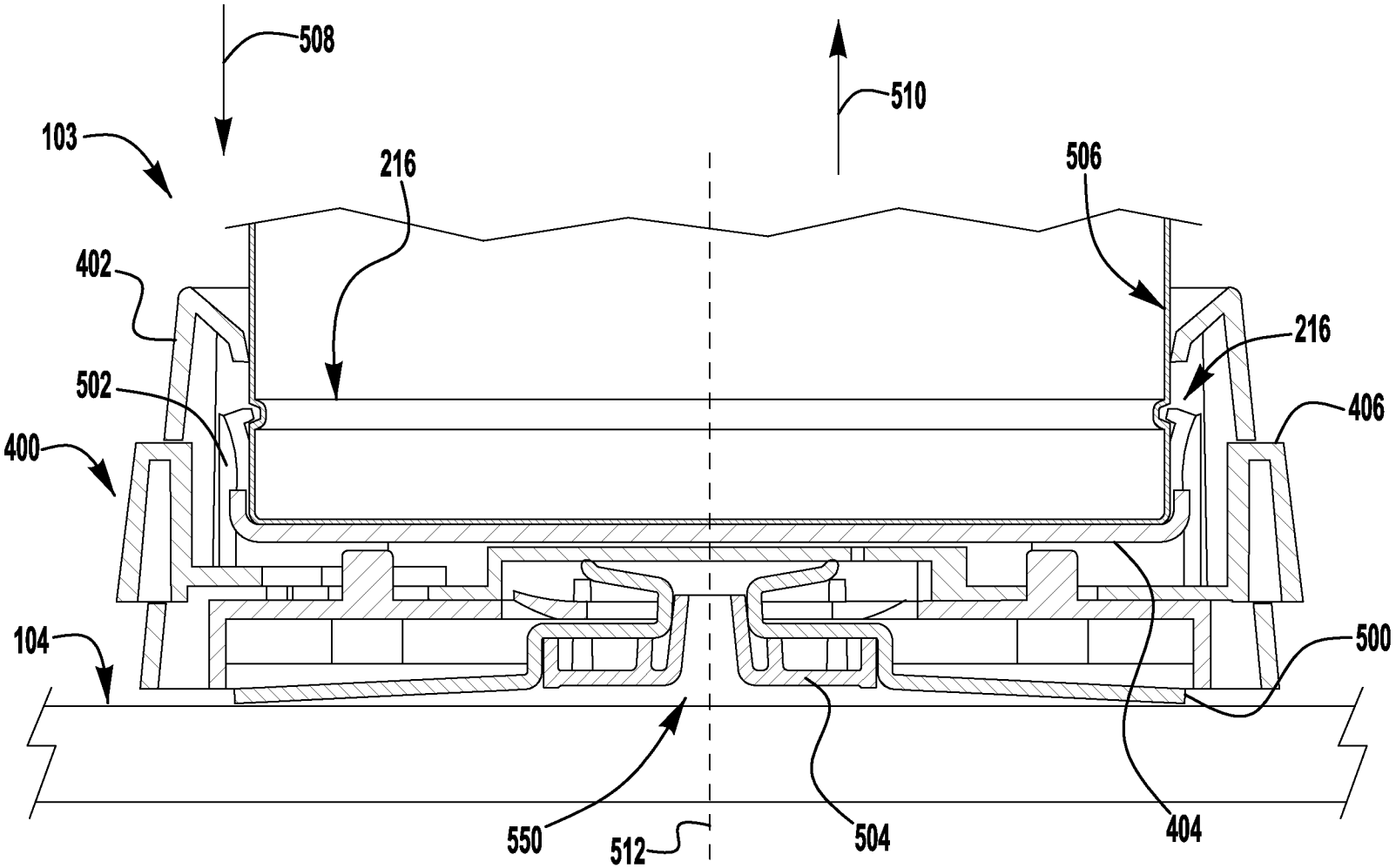
FIG. 5 is a cross-sectional view of the base of FIG. 4 and a portion of a wipes dispensing canister mounted secured to the base.

Referring to FIG. 5, a cross-section view of the base 400 taken along line 5-5 of FIG. 4 is illustrated. The base 400 includes a number of structures that will be described individually with reference to several figures following FIG. 5. This paragraph provides a brief overview of several of these structures, and more detailed descriptions will follow below. The base 400 includes a sealing device 500 configured to contact the surface 104. The sealing device 500 is attached to a receiver 502 that is located within the base cover 402. A stabilizer 504 may be used to attach the sealing device 500 to the receiver 502. The receiver 502 also provides a receptacle to receive the base plate 404 and mounting locations for the actuator 406. The cross-section shown in FIG. 5 enables a view of the interior surface 506 of the wipes canister 102 and the interior space defined by the interior surface 506 for containing the wipes. The annular feature 216 is also shown in this figure. For reference, the words "down" and "downward" will be used to refer to the general direction of arrow 508 (e.g., toward the surface 104 with respect to the base 400). Similarly, the words "up" and upward will be used to refer to the general direction of arrow 510 (e.g., toward the wipes canister 102 with respect to the surface 104). Additionally, portions of the wipes dispensing system 100 can be centered about a central axis 512.

Figure 6:
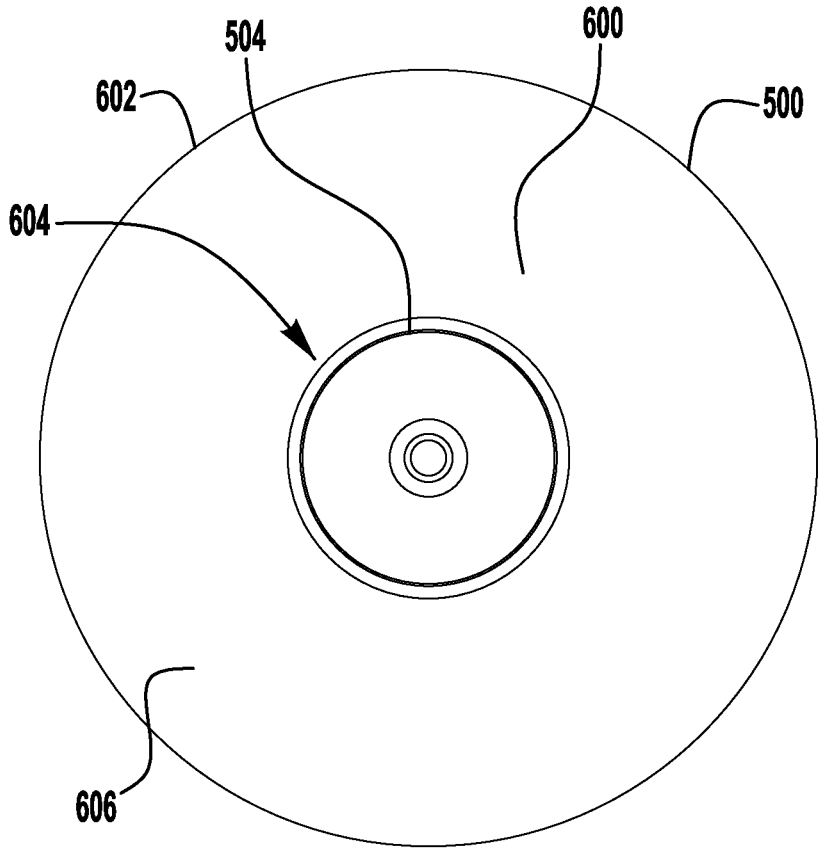
FIGS. 6 through 13 illustrate exemplary embodiments of a sealing device and a stabilizer for an exemplary base.

Referring to FIG. 6, a bottom view of the sealing device 500 and the stabilizer 504 is illustrated. The sealing device 500 includes a first portion 600 having first outside perimeter 602. The first portion 600 includes a first inner aperture 604. In some exemplary embodiments, the stabilizer 504 is located at least partially within a first inner aperture 604. As shown, the first outside perimeter 602 can be circular in shape, however, any suitable shape is contemplated for use with the sealing device 500. The first portion 600 can have a surface engagement side 606 that is configured to contact the surface 104 upon which the base 400 can be mounted. In some embodiments, surface engagement side 606 is slightly concave and the center of surface engagement side 606 is elevated off of the surface 104. Because sealing device 500 is made of a resilient material, pushing down on base 400 flexes the sealing device 500 and pushes air out from beneath base 400 and sealing device 500. Sealing device 500 forms a seal with surface 104 creating a vacuum "suction cup" force that secures the base 400 to surface 104. The base 400 may be removed from surface 104 by allowing air to flow into the area between surface engagement side 606 and surface 104 (creating a vacuum relief) as described in more detail below.

Figure 7:
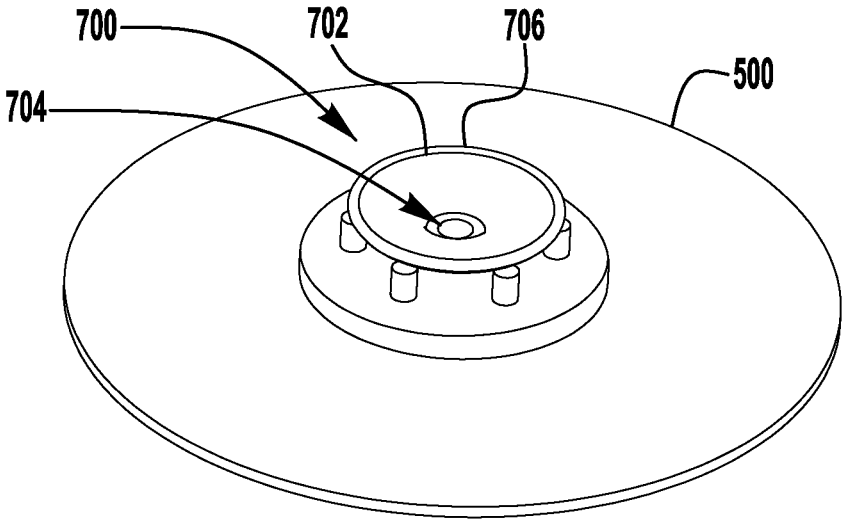

Referring to FIG. 7, a top perspective view of the sealing device 500 is illustrated. The sealing device 500 includes a second portion 700 having a second outside perimeter 702. The second portion 700 defines a second inner aperture 704. As shown, the second outside perimeter 702 can be circular in shape, however, any suitable shape is contemplated for use with the sealing device 500. The second portion 700 can have an upward extending ridge 706 that is configured to contact a surface within the base 400 that will be described below. In some exemplary embodiments, the upward extending ridge 706 is not required.

Figure 8:
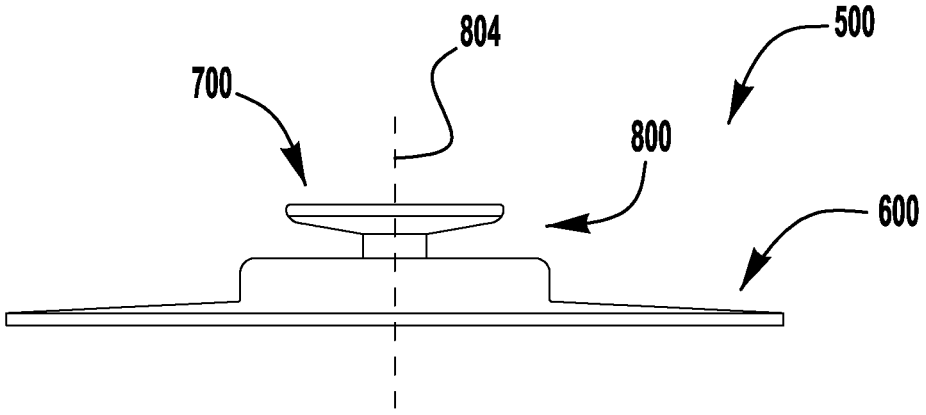
Figure 9:
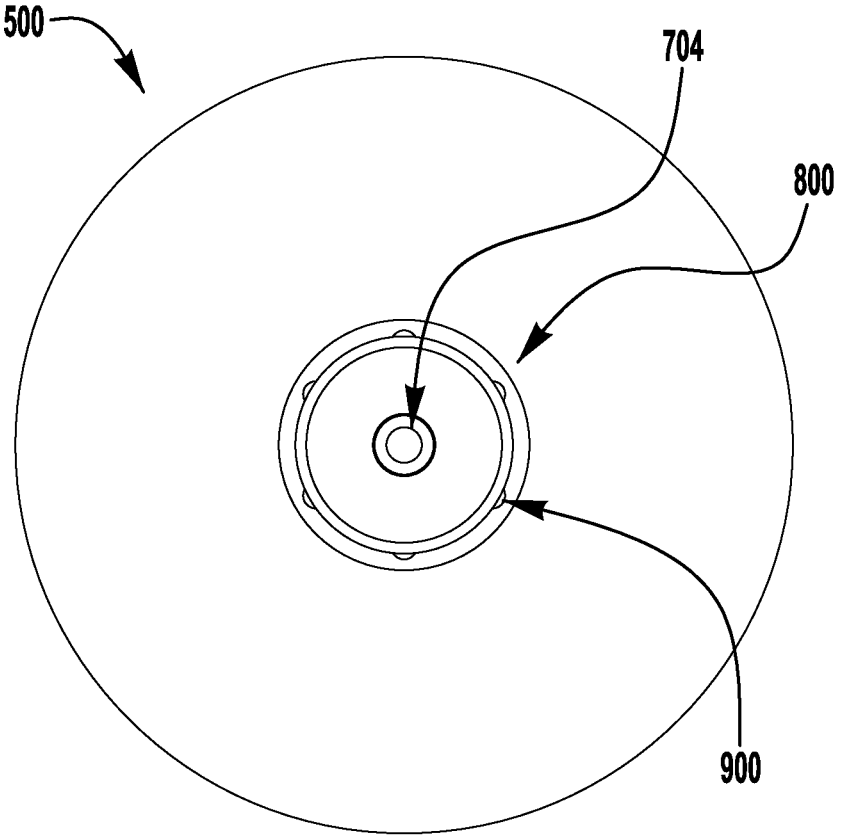

Referring to FIG. 8, an elevation view of the sealing device 500 is illustrated. The sealing device 500 includes a recessed portion 800. The recessed portion 800 can be formed by any suitable profile or cross-section. Referring to FIG. 9, a top view of the sealing device 500 is illustrated. A plurality of apertures 900 are located in the sealing device 500. The plurality of apertures 900 receive on or more of a plurality of projections or pins 1012 of the stabilizer 504. In some embodiments, the plurality of apertures 900 are arranged radially about the axis 804 (shown in FIG. 8). The apertures 900 may be evenly spaced about the axis 804. In other embodiments, the apertures 900 can be spaced unequally to create a clocking feature such that the stabilizer 504 can cooperate with the sealing device 500 in only one rotational orientation.

The sealing device 500 is an elastomeric member. In some embodiments, the sealing device comprises silicone. In some embodiments, the sealing device 500 is a thermoplastic elastomer. In some embodiments, the sealing device comprises rubber. In some embodiments, the sealing device 500 comprises one or more mixtures of elastomers.

Figure 10:
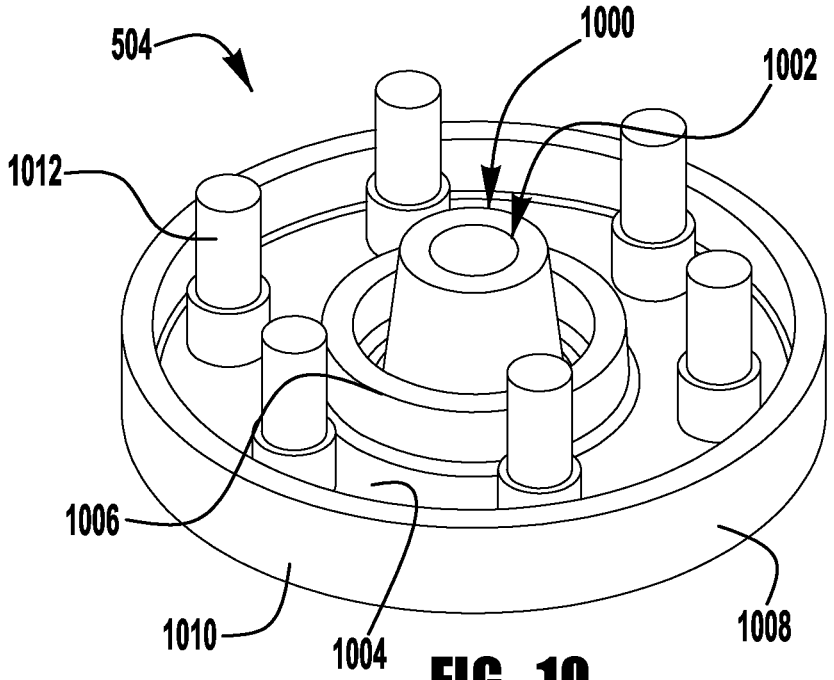

Referring to FIG. 10, a perspective view of the stabilizer 504 is illustrated. The stabilizer 504 includes a central annular portion 1000 that extends upward within the second inner aperture 704 of the sealing device 500. The central annular portion 1000 includes an aperture 1002 therethrough creating a fluid pathway from below the surface engagement side 606 up through sealing device 500. The central annular portion 1000 is attached to (or an integral part of) a stabilizer base 1004. The stabilizer base 1004 provides a base for an inner annular wall 1006 that extends up from the stabilizer base 1004. An outer annular wall 1008 also extends up from the stabilizer base 1004. In some exemplary embodiments, one or more of the exterior perimeter 1010 of the outer annular wall 1008, the outer annular wall 1008, and the inner annular wall 1006 help maintain a desired shape of the sealing device 500 during operation of the wipes dispensing system 100. As shown, the stabilizer 504 can also include one or more pins 1012 configured to engage one or more aperture 900*s* of the sealing device 500.

Figure 11:
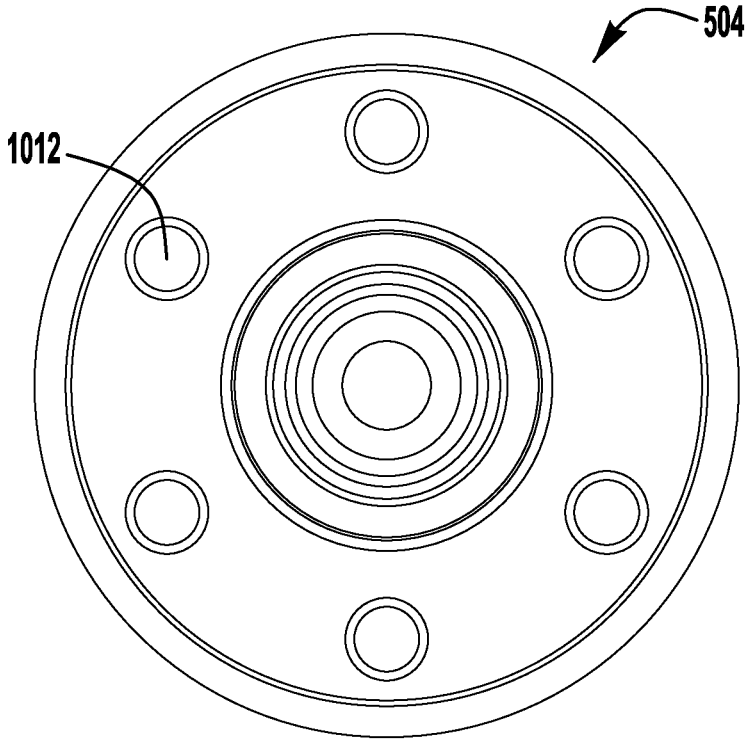

Referring to FIG. 11, a top view of the stabilizer 504 is illustrated. As shown, the stabilizer 504 can have a circular profile or cylindrical shape, but no particular shape is necessary for the proper operation of the wipes dispensing system 100. In some embodiments, the pins 1012 are cylindrical, however, any suitable shape can be used.

Figure 12:
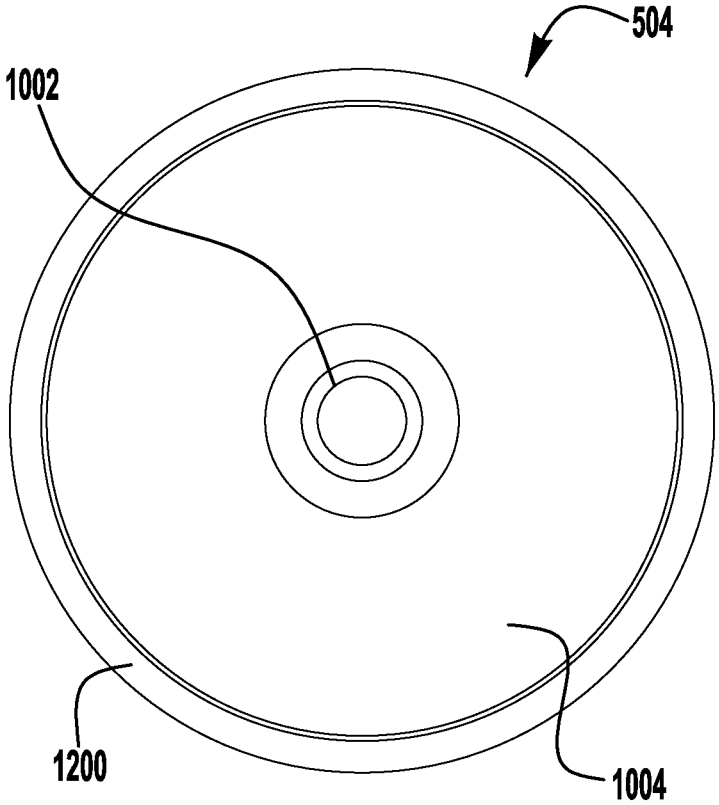

Referring to FIG. 12, a bottom view of the stabilizer 504 is illustrated. In some embodiments, the stabilizer 504 can include a downward facing ridge 1200 extending away from the stabilizer base 1004. The aperture 1002 passes through the stabilizer base 1004 and the central annular portion 1000 (shown in FIG. 10).

Figure 13:
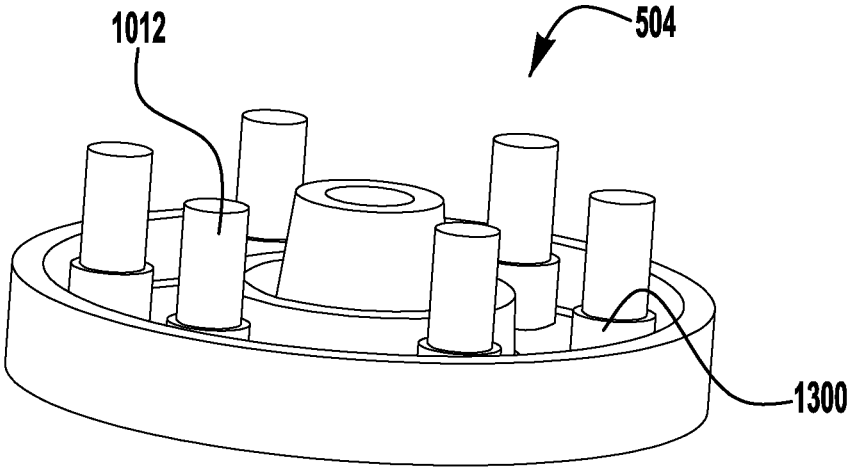

Referring to FIG. 13, an elevation view of the stabilizer 504 is illustrated. The one or more pins 1012 can include a base portion 1300 having a greater diameter than the upper portion of the pins 1012. The base portion 1300 can act as a boss to strengthen the pins 1012. The base portion 1300 can also have a diameter to provide a relatively snug fit with the apertures 900 of the sealing device 500. In some embodiments, the sealing device 500 comprises a relatively soft or flexible material compared to the stabilizer 504, and the apertures 900 can expand to fit around the pins 1012, its base portion 1300. In some embodiments, expanded fit applies a force around the pins 1012 such that the stabilizer 504 is held within the sealing device 500. The stabilizer 504 can be formed in a plastic molding process to be a monolithic unit, however, it is also contemplated that the stabilizer 504 can include several constituent parts.

Figure 14:
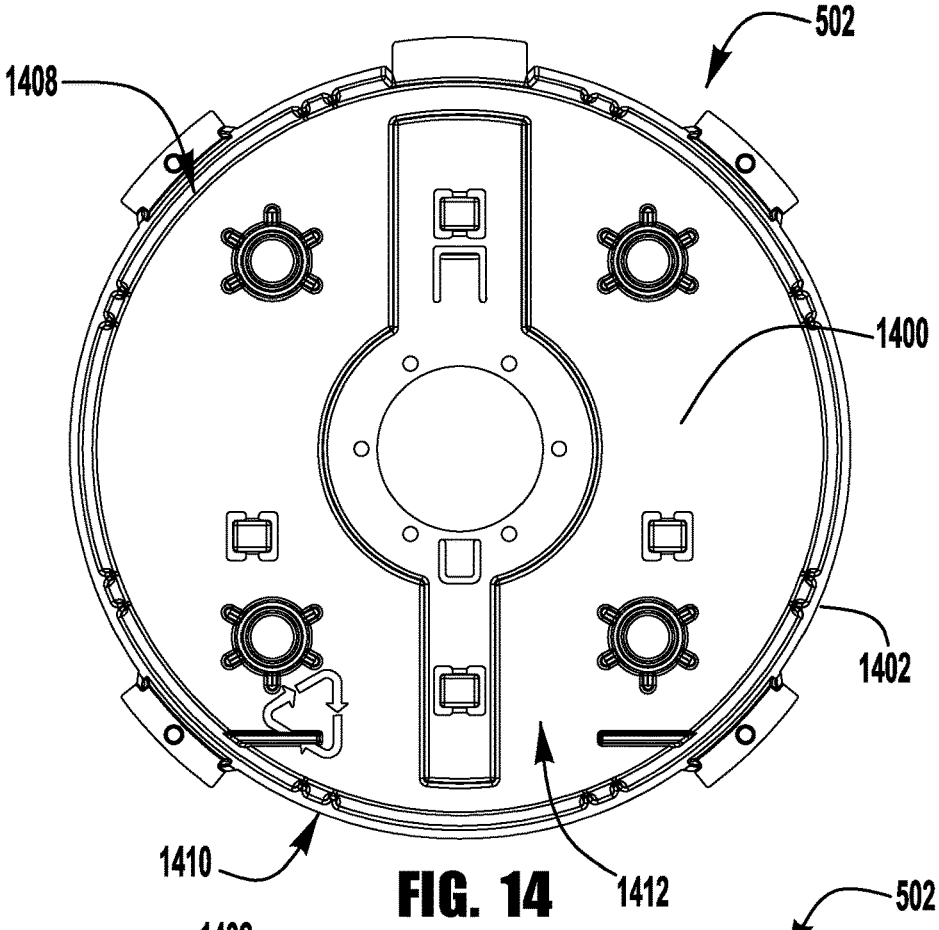
FIGS. 14-21 illustrate an exemplary embodiment of a receiver for an exemplary base.

Referring to FIG. 14, a top view of the receiver 502 is illustrated. The receiver 502 includes a receiver floor 1400 and a receiver wall 1402 extending upward from a first end 1404 and a second end 1406 (both shown in FIG. 15). The receiver wall 1402 includes an interior surface 1408 and an exterior surface 1410. The interior surface 1408 defines a receptacle 1412 for receiving the base plate 404. Receiver 502 may be formed of any material. Preferably, receiver 502 is made of a plastic material. In some embodiments, the receiver 502 can be formed in a plastic molding process from a material, such as, for example, an acrylonitrile butadiene styrene (ABS) material.

Figure 15:
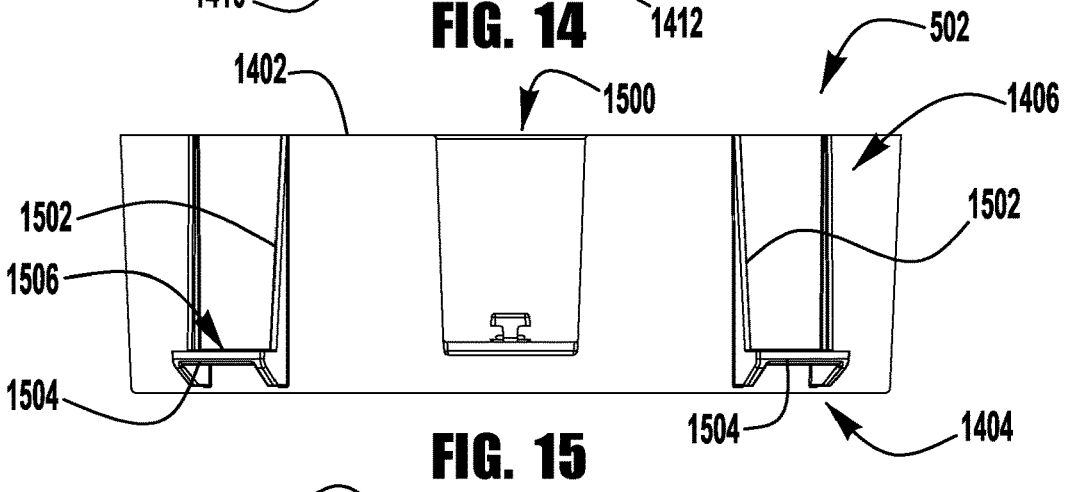

Referring to FIG. 15, an elevation view of the receiver 502 is illustrated. As discussed, the receiver wall 1402 can extend between a first end 1404 and a second end 1406. The first end 1404 can be attached to the receiver floor 1400 or integrally molded with receiver floor 1400. The receiver wall 1402 includes an opening 1500 for allowing passage of a portion (e.g., an end) of the actuator 406 to pass through the receiver wall 1402. In some embodiments, the opening 1500 is not bounded at the second end 1406 of the receiver wall 1402, and thus, the top perimeter of the receiver wall 1402 can be discontinuous. A ridge 1502 can extend outwardly from the receiver wall 1402 to strengthen the receiver wall 1402. In some embodiments, the ridge 1502 acts as a guide for a cooperating portion of the base cover 402 as it is installed onto the receiver 502. The receiver wall 1402 can also include outward projecting member 1504. In some embodiments, outward projecting member extends away from the receiver wall 1402 in a substantially horizontal direction and include a top surface 1506. The outward projecting member 1504 may include an aperture 1508 (shown in FIG. 17), that can cooperate with a pin or other structure located on the base cover 402. The top surface 1506 can also act as a contact surface with the base cover 402 in order to provide a positive location for the base cover 402 relative to the receiver 502.

Figure 16:
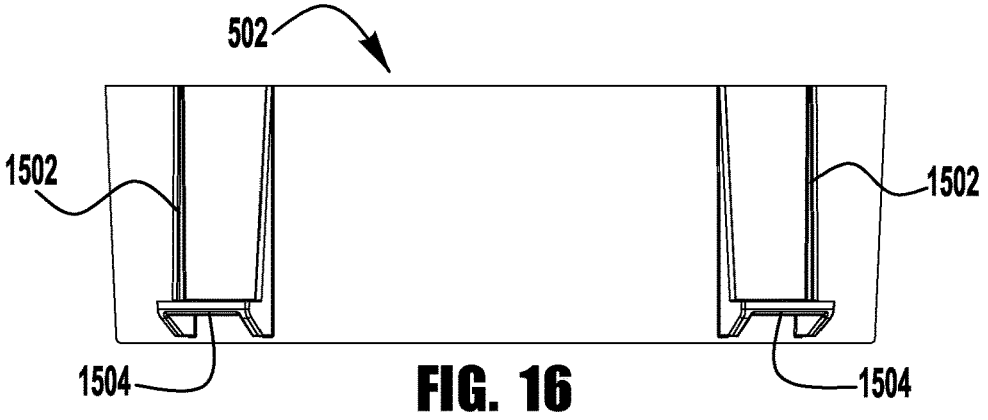

Referring to FIG. 16, another elevation view of the receiver 502 is illustrated. The view of FIG. 16 is diametrically opposed to the elevation view shown in FIG. 15.

Figure 17:
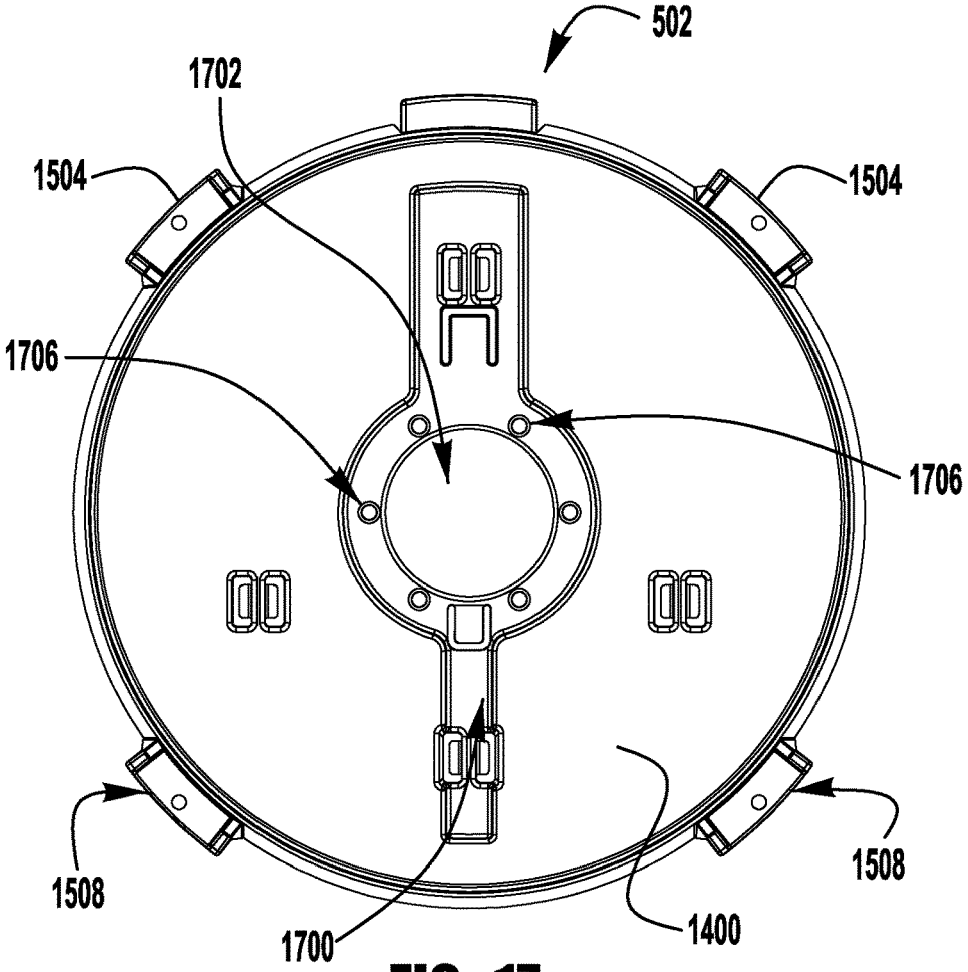

Referring to FIG. 17, a bottom view of the receiver 502 is illustrated. The outward projecting member(s) 1504 can be spaced equally about the center of the receiver 502. In some embodiments, similar to other features of the wipes dispensing system 100, the outward projecting member 1504 can be of varying size and or location so as to clock the base cover 402 to the receiver 502. The receiver floor 1400 can include a raised area 1700 that is raised upward from the surface of the receiver floor 1400 (e.g., away from the viewer in FIG. 17).

Raised area 1700 includes a central aperture 1702. Located within the raised area is a plurality of pin apertures 1706 configured to receive the pins 1012 of the stabilizer 504. It is to be understood that the configuration of the pin apertures 1706 matches the configuration of the pins 1012 of the stabilizer 504. In some embodiments, the pins 1012 of the stabilizer 504 can pass through the sealing device 500 and continue through the pin apertures 1706 in order to fasten the sealing device 500 to the receiver 502.

Figure 18:
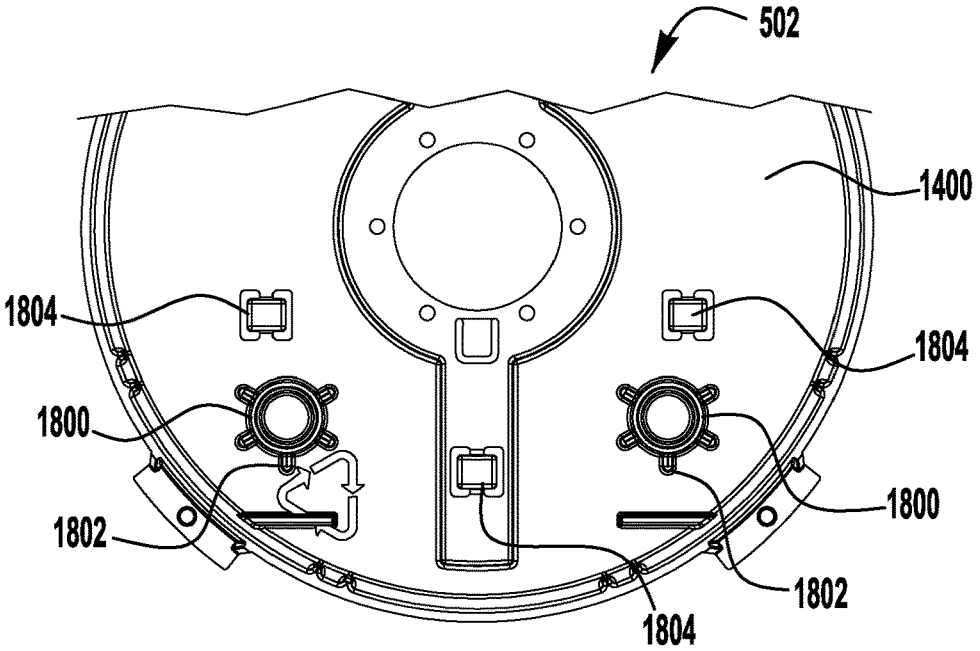

Referring to FIG. 18, a top detail view of a portion of the receiver 502 is illustrated. The receiver 502 includes a plurality of bosses 1800 that extend upward from the receiver floor 1400. In some embodiments, the bosses 1800 interact with components located on the base plate 404 as will be described below. In some embodiments, the bosses 1800 provide a mounting location for one or more biasing members in order to bias the base plate 404 upward and away from the receiver 502. As shown in FIG. 18, a plurality of ribs 1802 and other structural features can be included in the molding process of the receiver 502 in order to strengthen the receiver wall 1402 and the bosses 1800. It is also contemplated that a top surface of the ribs 1802 attached to the bosses 1800 may also act as a positive location stop for a biasing member (e.g., a coil spring) that will be described below. FIG. 18 also shows one or more locating tabs 1804. One or more locating tabs 1804 are configured to positively locate the actuator 406. Any suitable number of locating tabs 1804 can be included on the receiver 502 (three are shown in FIG. 18).

Figure 19:
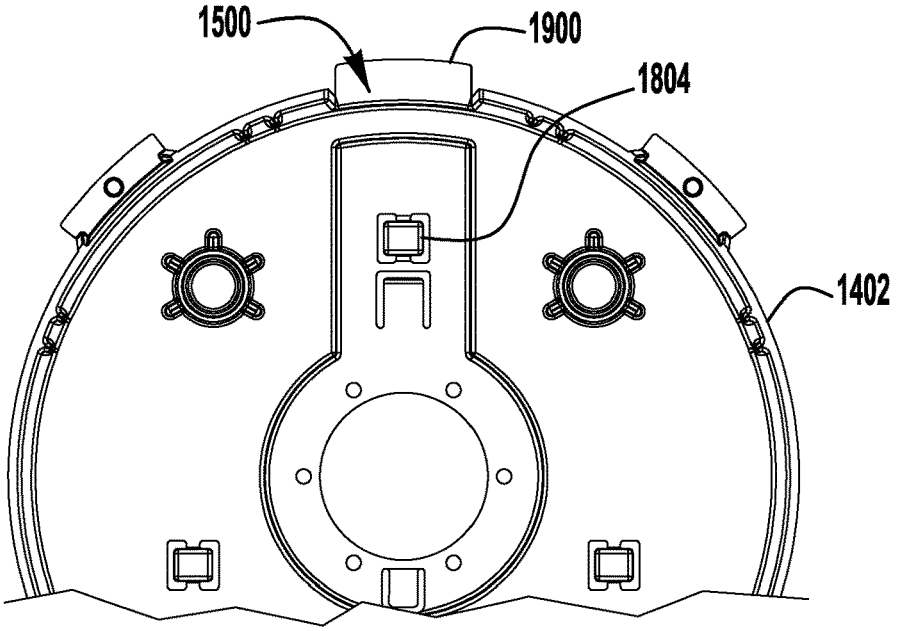

Referring to FIG. 19, another top detail view of the receiver 502 is illustrated. A fourth of the one or more locating tabs 1804 is shown in this detail view. A horizontal surface 1900 extending radially from the receiver wall 1402 is also shown. The horizontal surface 1900 can be located just below the opening 1500.

Figure 20:
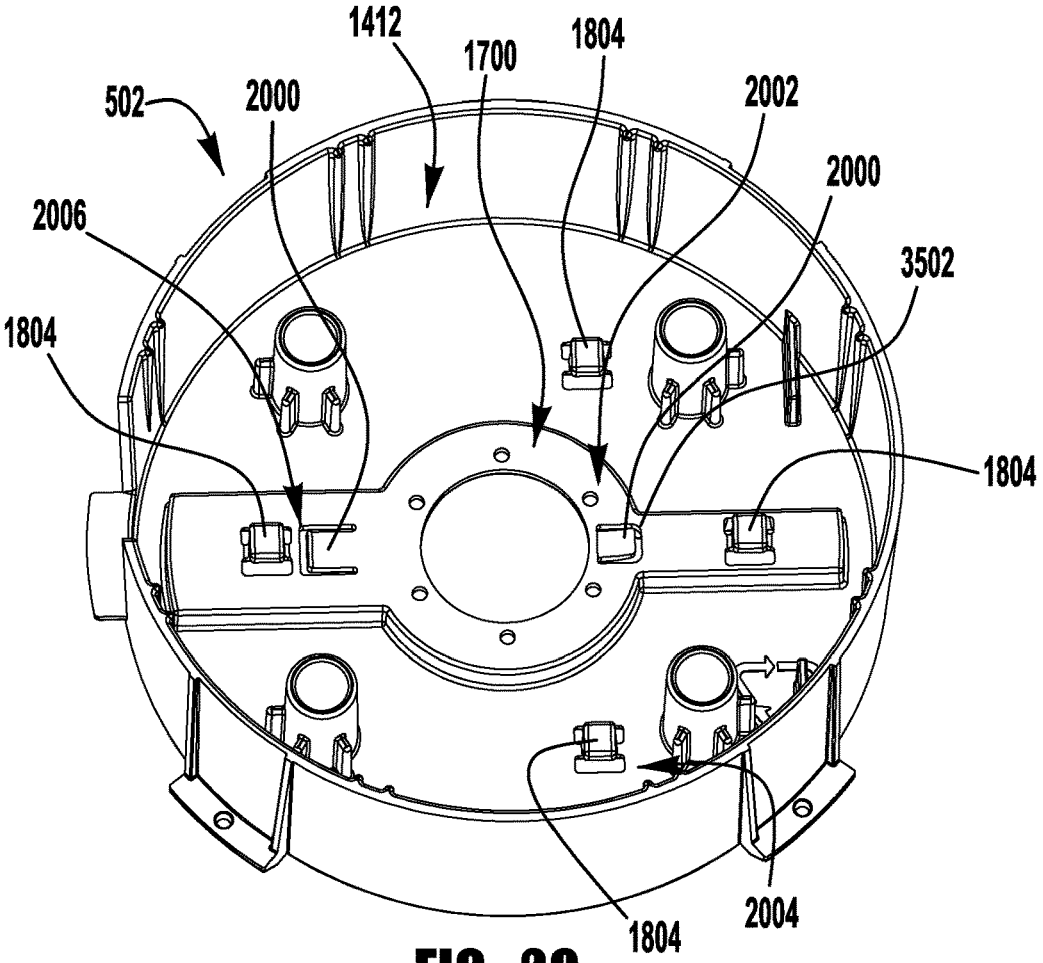

Referring to FIG. 20, a perspective view of the receptacle 1412 is illustrated. In the view shown in FIG. 20, the actuator 406 (not shown) is configured to move left to right and right to left. The receiver 502 (for example, the raised area 1700) includes a plurality of retaining tabs 2000 that extend upward from an upward facing surface 2002 of the raised area 1700. The two retaining tabs 2000 can be used to inhibit motion of the actuator 406. Interaction between the retaining tabs 2000 and the actuator 406 will be described in more detail below. In FIG. 20, it is also apparent that the locating tabs 1804 can be "T-shaped" in order to have a portion of the actuator 406, such as walls defining a slot, to be located on either side of the vertical section of the "T" while the horizontal portion of the "T" can retain the actuator 406 and prevent or limit vertical movement of the actuator 406. As shown in FIG. 20. Apertures 2004 adjacent the locating tabs 1804 can be used to aid the molding process used to manufacture the receiver 502.

Figure 21:
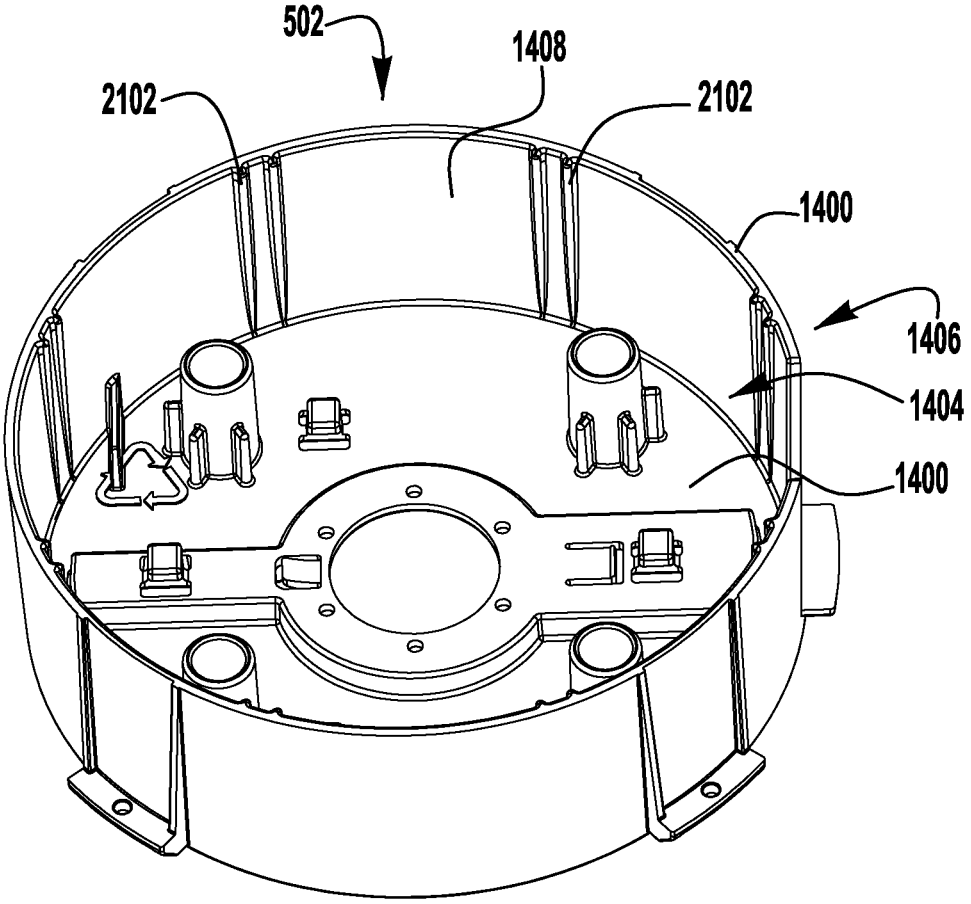

Referring to FIG. 21, a perspective detail partial view of the interior surface 1408 of the receiver 502 is illustrated. A plurality of ribs 2102 extend inward along a portion of the interior surface 1408 of the receiver 502 in order to actuate a portion of the base plate 404 as will be described below. Any number of ribs 2102 can be included on the interior surface 1408, and in some embodiments, the rib 2102 can correspond with a movable part of the base plate 404. It is to be understood that in some embodiments, the receiver wall 1402 can be perpendicular to the receiver floor 1400, however to aid the plastic molding process, a draft may be added to the design such that the receiver can have a greater diameter at the second end 1406 than at the first end 1404.

Figure 22:
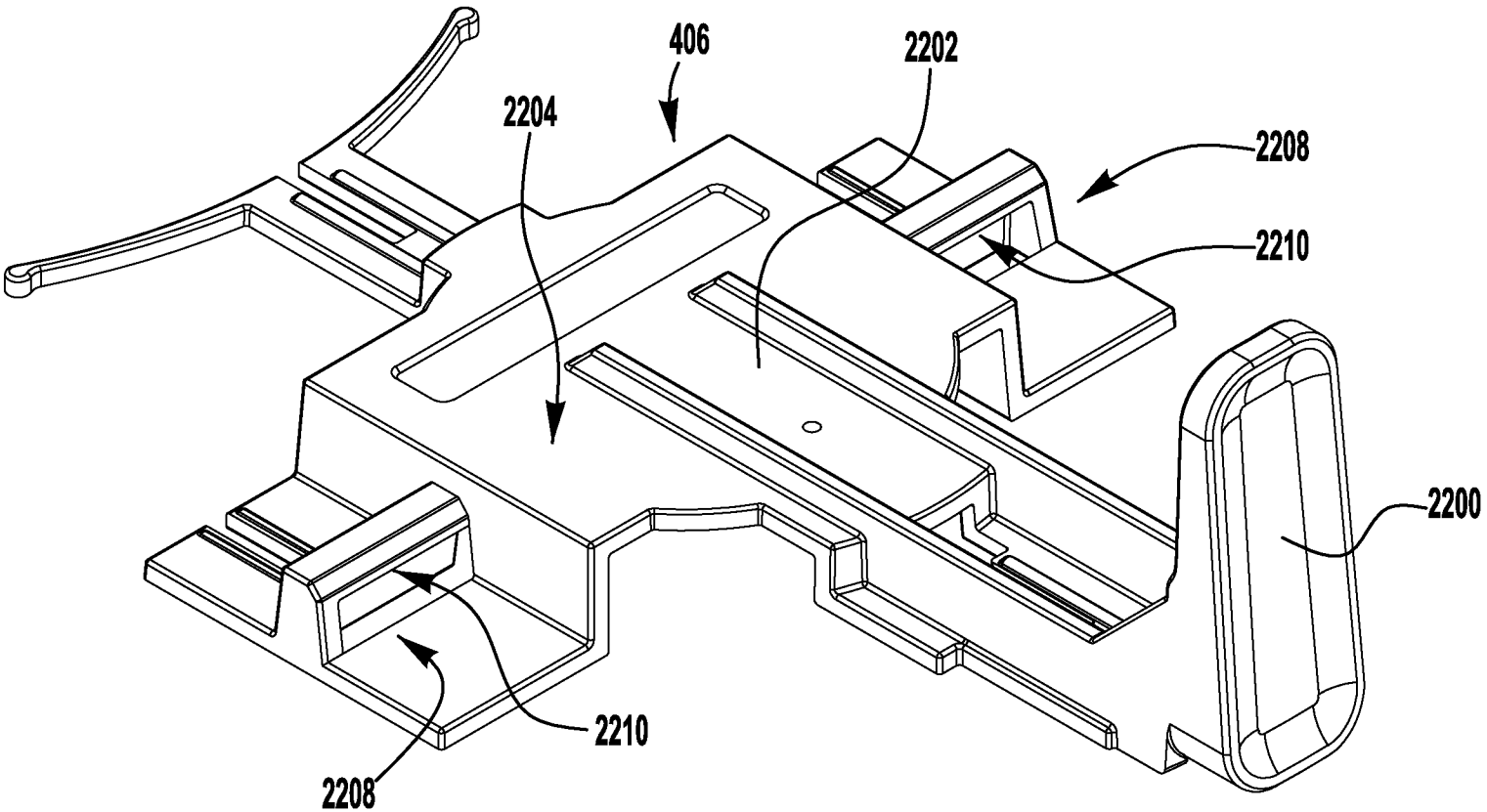
FIGS. 22-29 illustrate exemplary embodiment of actuators for an exemplary base.

Referring to FIG. 22, a perspective view of the actuator 406 is illustrated. The actuator 406 includes an engagement member 2200 that extends through the opening 1500 in the receiver wall 1402. The engagement member 2200 extends outward from a main body 2202 of the actuator 406. The main body 2202 has an upward facing surface 2204 and a downward facing surface 2206 (shown in FIG. 24) (shown in FIG. 24). The actuator 406 can also include a first coupling member 2208 (e.g., the undercut area shown) that can have a downward facing surface 2210. The downward facing surface 2210 can interact with a portion of the base plate 404 that will be further described below.

Figure 23:
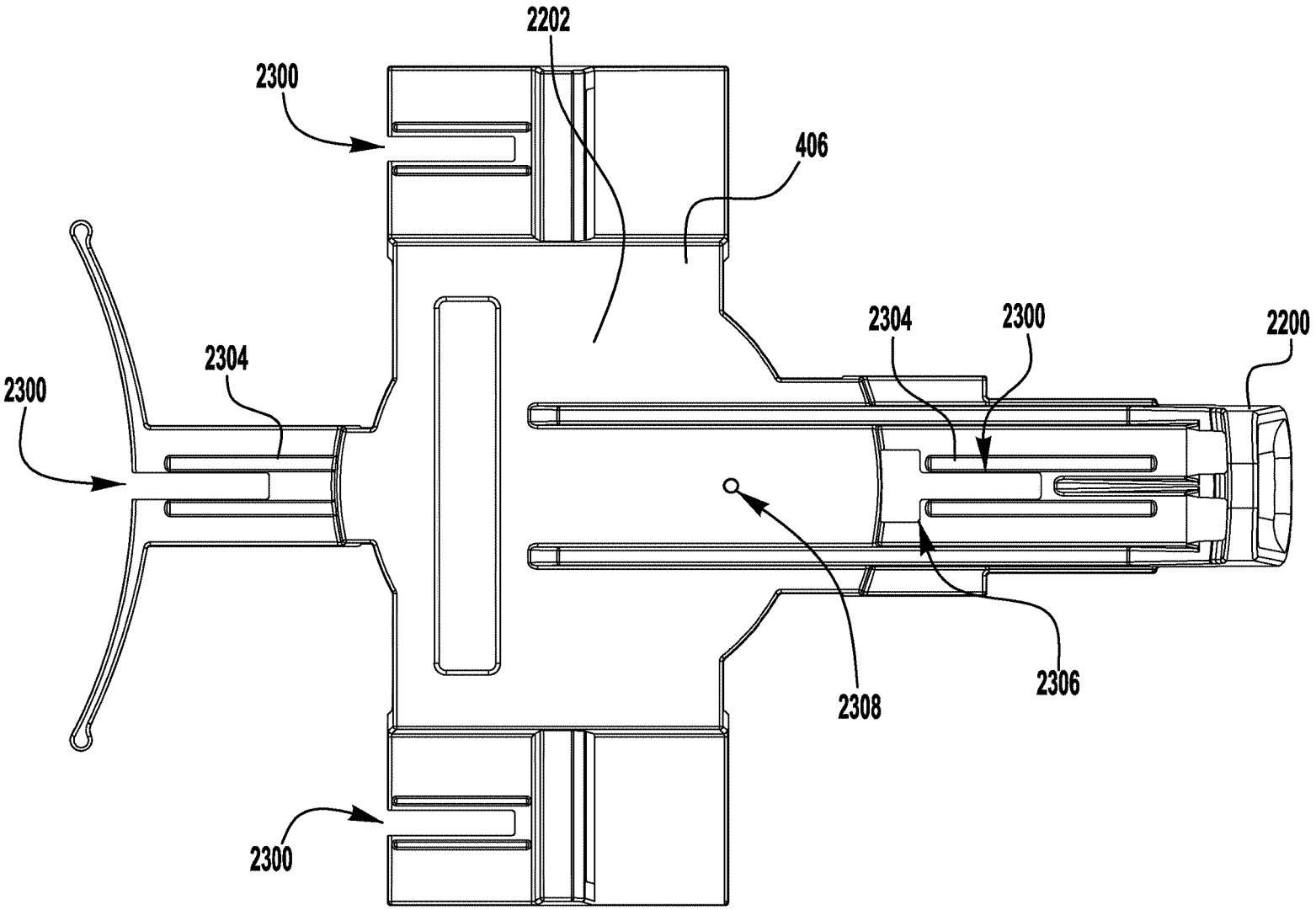

Referring to FIG. 23, a top view of the actuator 406 is illustrated. Portions of the actuator 406 define a plurality of slots 2300 which are configured to interact with the locating tabs 1804 of the receiver 502. As shown in FIG. 23, the actuator 406 can also include ridges 2304 that can act as contact surfaces as they interact with the undersides of the locating tabs 1804 (e.g., the underside of horizontal parts of the "T"). It is also noted that any number of the slots 2300 can include a larger open portion 2306 to enable the horizontal part of the "T" of one or more locating tabs 1804 to pass through a portion of the actuator 406. As shown in FIG. 23, the main body 2202 of the actuator 406 includes a vent aperture 2308.

Figure 24:
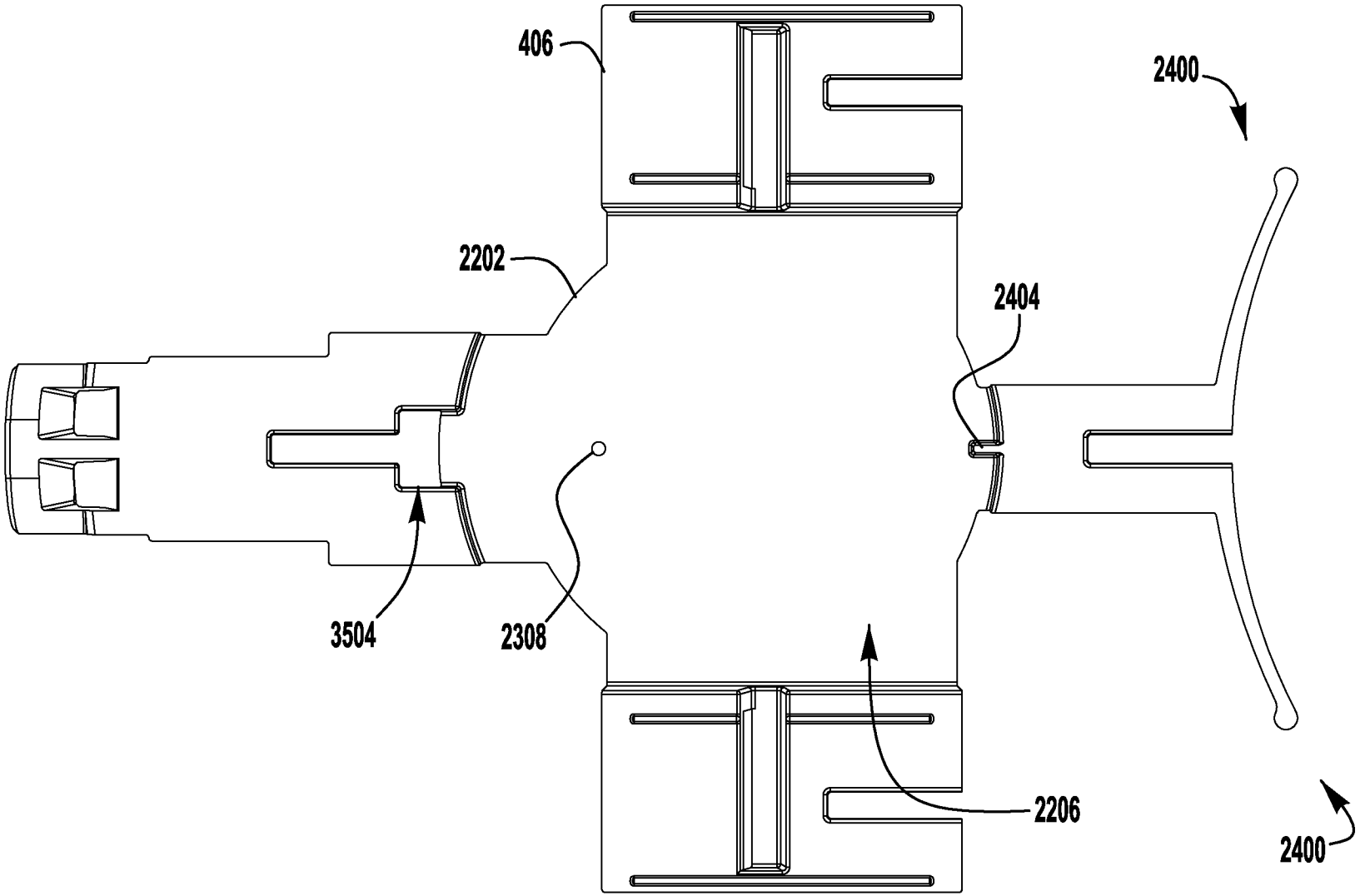

Referring to FIG. 24, a bottom view of the actuator 406 is illustrated. The main body 2202 includes the downward facing surface 2206 as noted previously. The downward facing surface 2206 is preferably relatively smooth, and is configured to cooperate with the second outside perimeter 702 of the sealing device 500 to form a sliding seal therebetween. The sliding seal is configured to prevent the passage of air therebetween.

The actuator 406 is biased within the receiver 502 such that the actuator 406, without outside force, is biased in a direction toward the engagement member 2200 with respect to the central axis 512 (shown in FIG. 5). For example, in FIG. 24, the actuator would be biased to the left. Any number of biasing means are contemplated including, but not limited to, springs, magnets, electromagnets, etc. In the shown example of FIG. 24, a biasing member 2400 is built into the actuator 406 in the form of a living spring. The biasing member 2400 is one or more arm structures 2402 that is resilient and can flex, thereby enabling motion of the actuator 406 to the right in FIG. 24 when the actuator 406 is actuated by a user (e.g., the engagement member 2200 is pushed or depressed to the right). Any number of materials can be used to make up the actuator 406. In some embodiments, the actuator 406 is composed of a plastic material, and in some embodiments may contain acetyl compounds.

Figure 25:
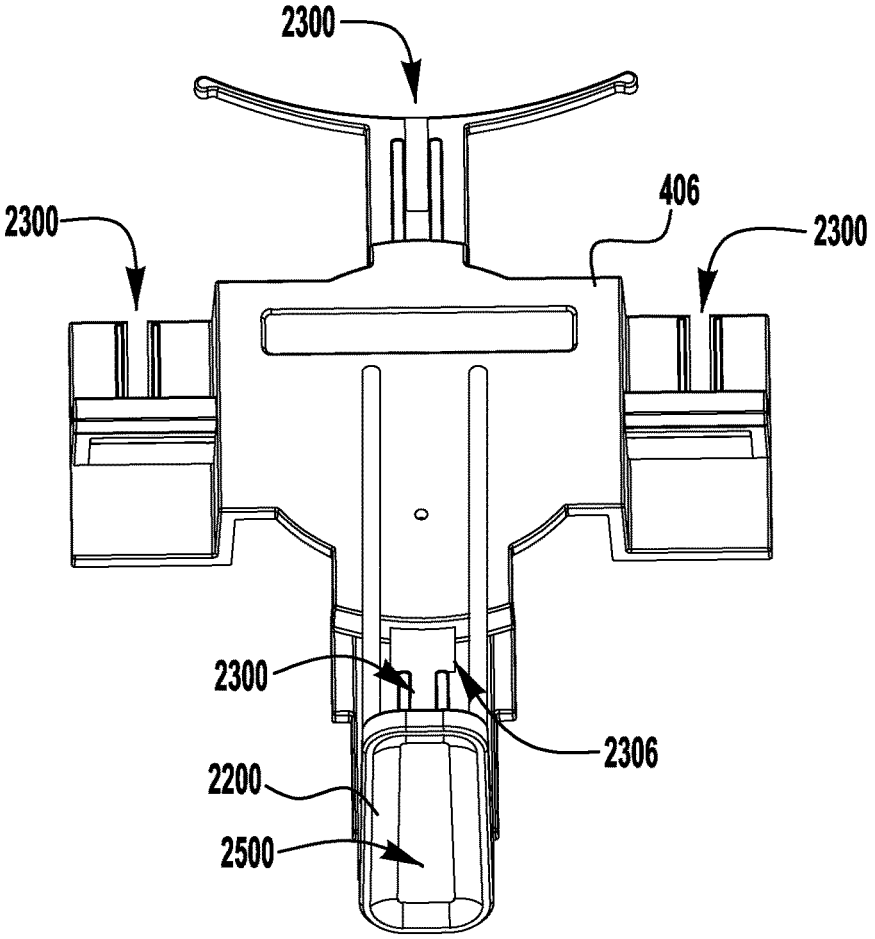

Referring to FIG. 25, a perspective view of the actuator 406 is illustrated. In this view, the opening of 2306 of one of the slots 2300 is prominent. As shown, the engagement member 2200 can include various ergonomic features such as a curved well 2500 enabling a user to feel the boundaries of the engagement member 2200. Additionally, ergonomic features can help add friction to the contact action between a user's finger and the engagement member 2200 to help limit slippage.

Figure 26:
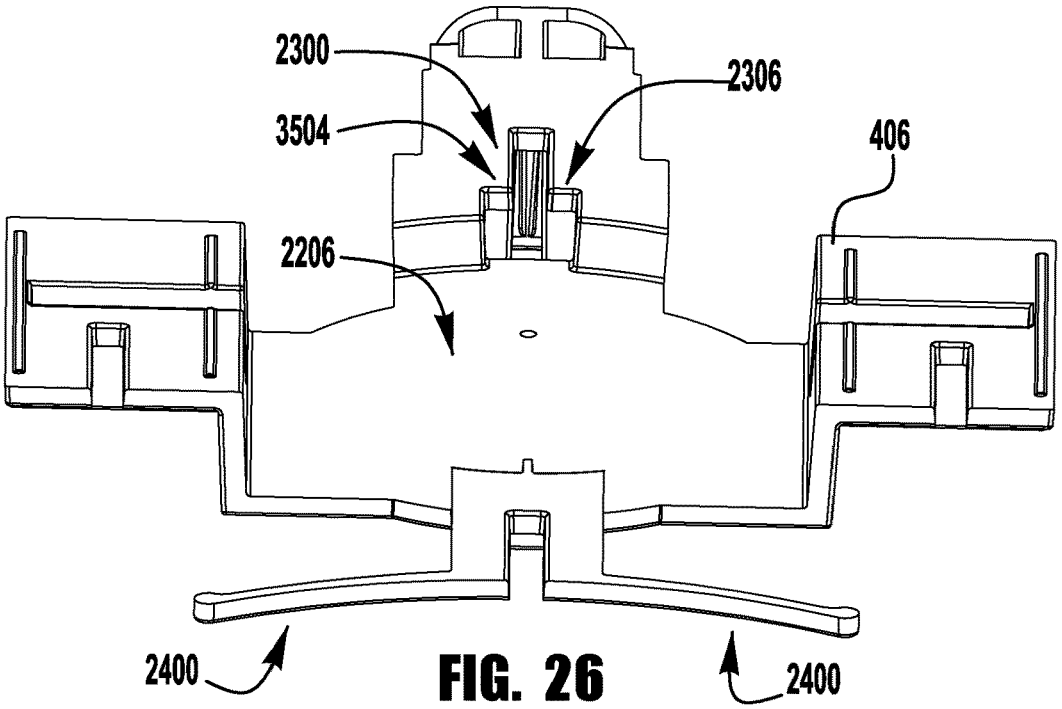

Referring to FIG. 26, a perspective view of the actuator 406 from the end of the biasing member 2400 is illustrated. This view enables a better illustration of the slots 2300 and the larger open portion 2306. Also shown in this view is the downward facing surface 2206 which can be relatively smooth as discussed previously. In some embodiments, the smooth surface of the downward facing surface 2206 can be created in a plastic mold with no further secondary work (e.g., trimming, smoothing, etc.) to be completed on the actuator 406.

Figure 27:
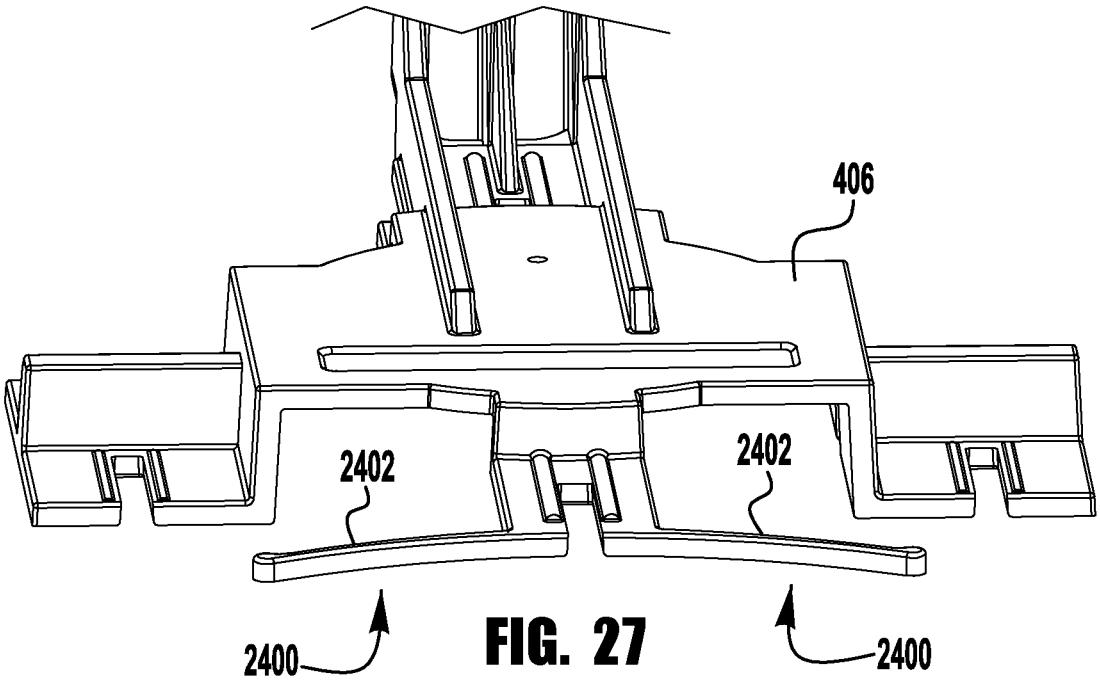

Referring to FIG. 27, a detailed view of the biasing member 2400 is illustrated. In some embodiments the one or more arm structures 2402 can be curved as shown. It is to be understood that the curve and various aspects of the one or more arm structures 2402 geometry can be engineered to maintain desired stress maximum values and resistance of the living spring.

Figure 28:
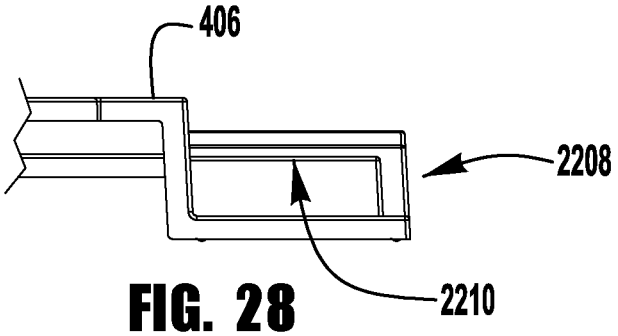

Referring to FIG. 28, a detailed view of the first coupling member 2208 having the downward facing surface 2210 is illustrated. The downward facing surface 2210 can interact with a portion of the base plate 404 that will be described below.

Figure 29:
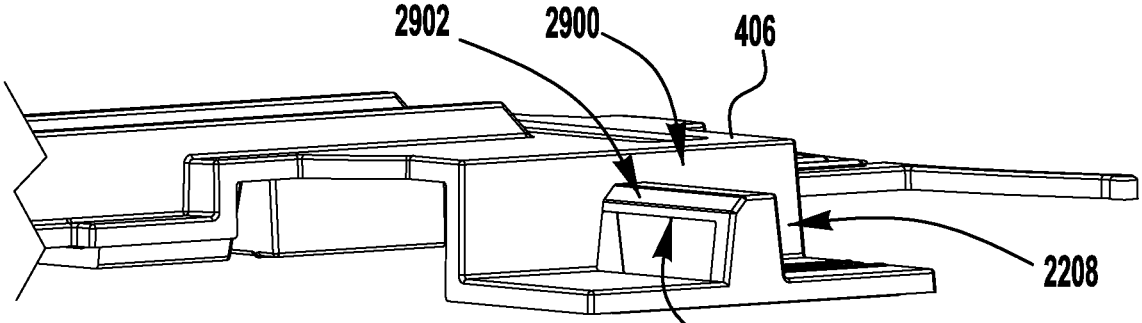

Referring to FIG. 29, a detail perspective view of the first coupling member 2208 is shown including the downward facing surface 2210. The first coupling member 2208 can be defined by a block of material 2900 having an undercut (e.g., forming the downward facing surface 2210), and the block of material 2900 can include an angled surface 2902 configured to cooperate with another angled surface of the base plate 404.

Figure 30:
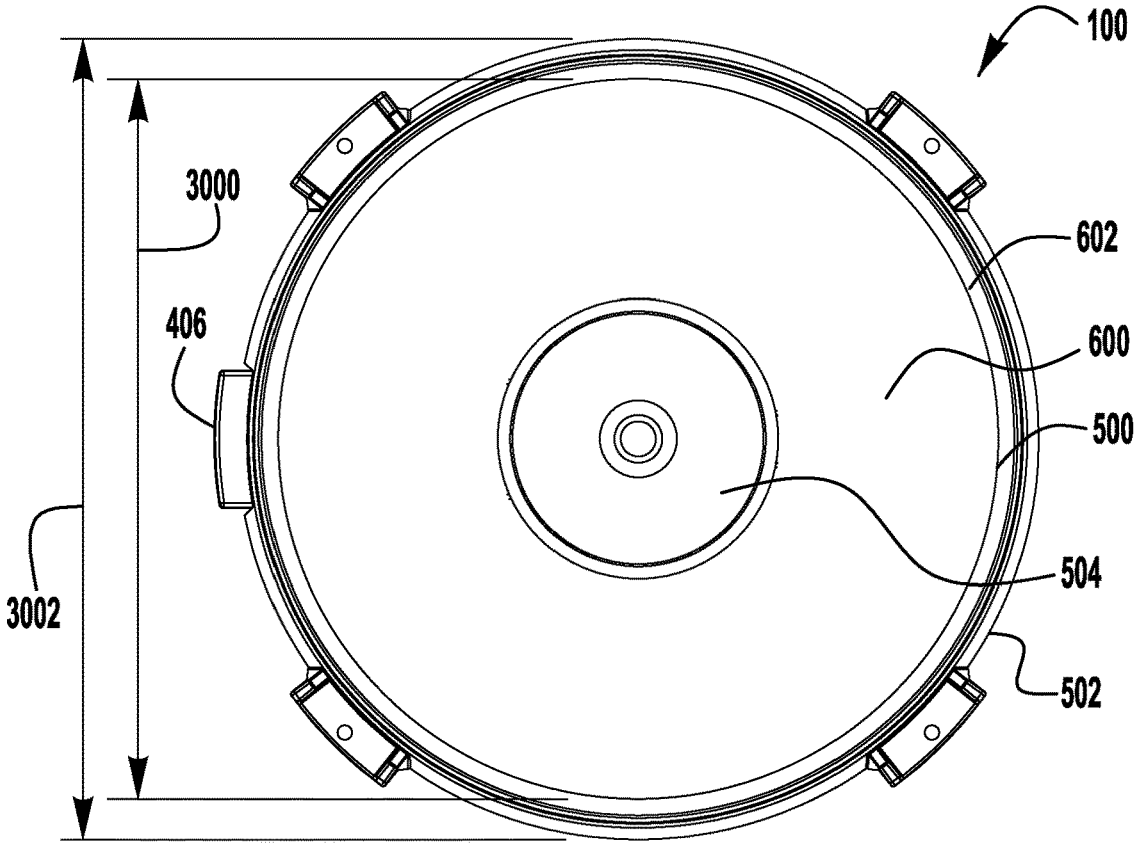
FIGS. 30-31 illustrate a prospective/bottom the sealing device, stabilizer and receiver for an exemplary base.
Figure 31:
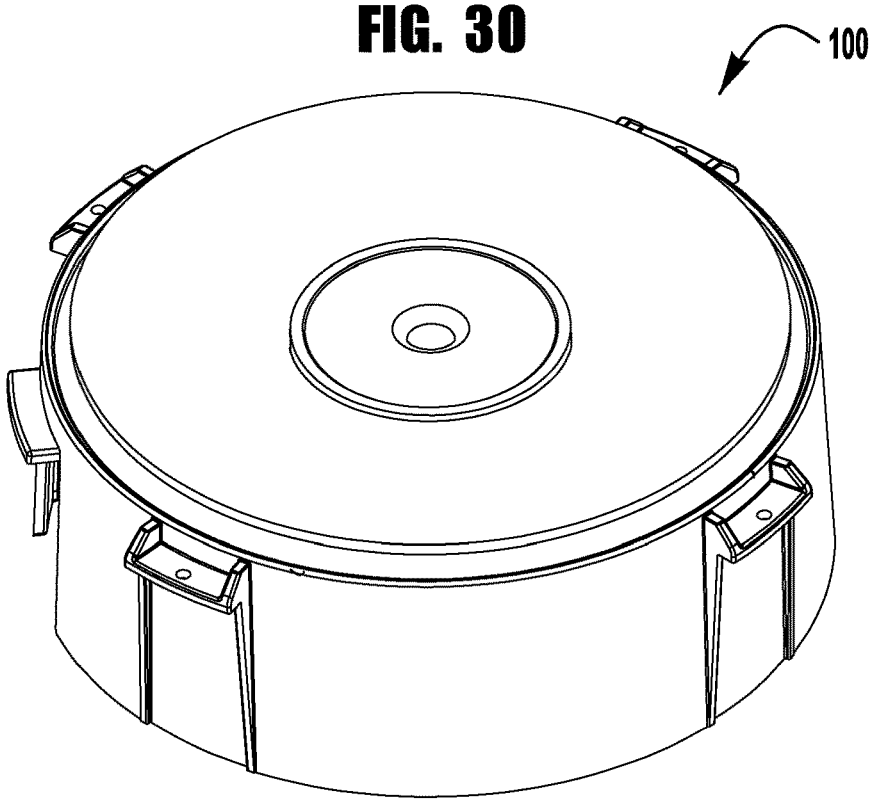

Referring to FIG. 30, a bottom view of the base 400 (without it's outer cover) is shown with the sealing device 500, the stabilizer 504, and the actuator 406 assembled together. As shown in FIG. 30, the first outside perimeter 602 of the first portion 600 of the sealing device 500 can have a diameter 3000 that is less than the outside diameter 3002 of the receiver 502. As such, the sealing device 500 can fit entirely within a perimeter of the base 400. Referring to FIG. 31, a perspective view of the base 400 is illustrated. In this view, the base cover 402 is removed for clarity.

Figure 32:
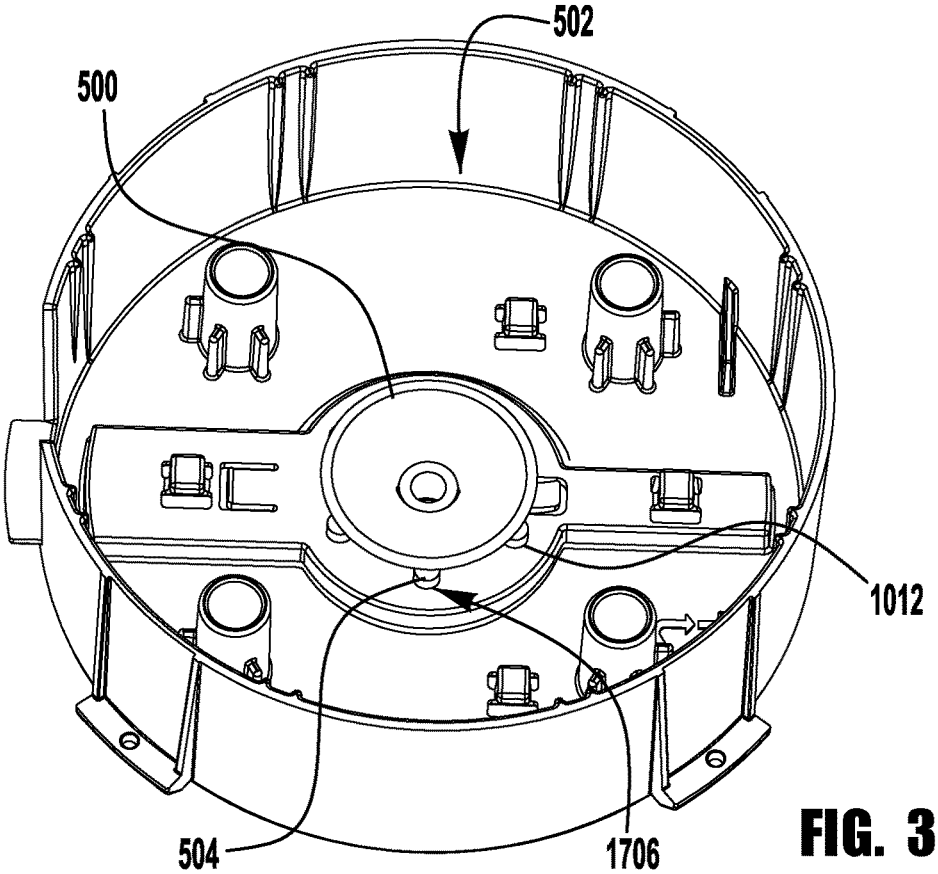
FIGS. 32-33 illustrate a prospective/top view the sealing device, stabilizer and receiver for an exemplary base.

Referring to FIG. 32, a detailed view of a portion of the receiver 502 assembled with the sealing device 500 and the stabilizer 504 is shown. As was discussed previously, the pins 1012 of the stabilizer 504 extend through the pin apertures 1706 of the receiver 502. While not shown in this view, the tops of the pins 1012 can be secured with in the sealing device 500. Any manner of securement is contemplated. In some embodiments, the tips of the pins can be peened over similar to a rivet construction. In some embodiments, the tips of the pins 1012 can be heated to urge the diameter of the pins to expand and exceed the diameter of the pin apertures 1706 (e.g., melt) thereby securing the stabilizer 504 and the sealing device 500 to the receiver 502.

Figure 33:
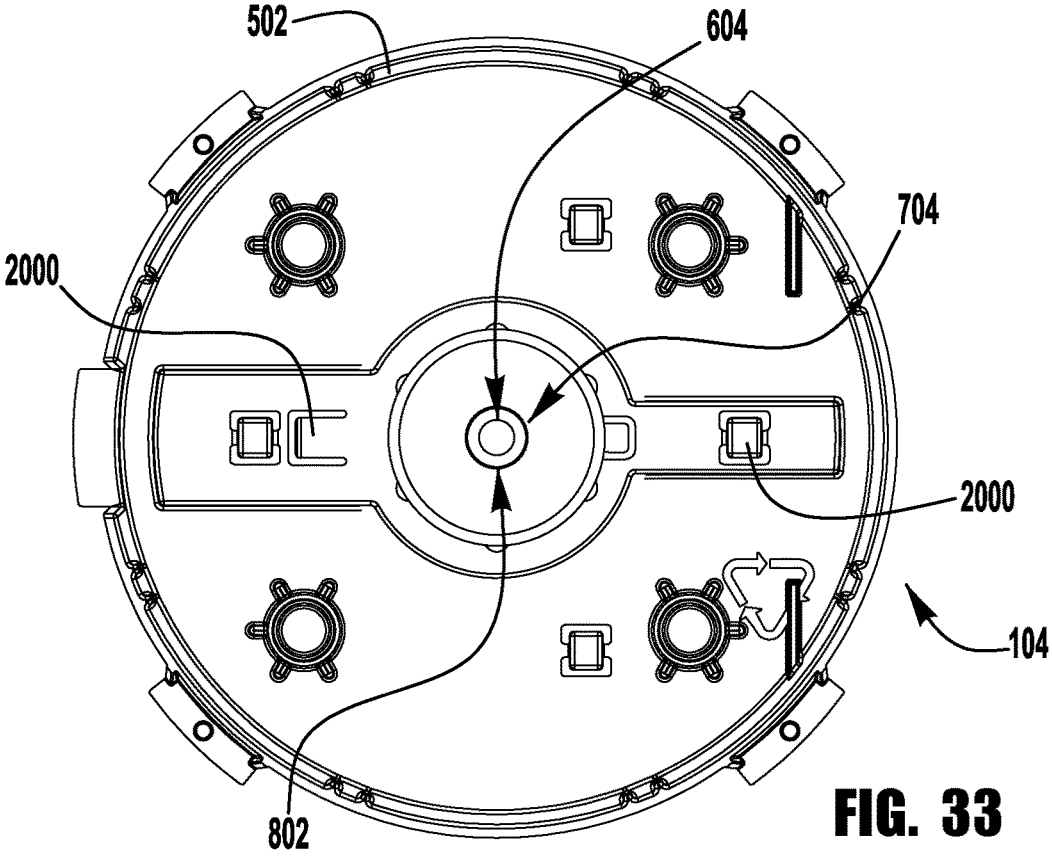

Referring to FIG. 33, a top view of the assembly of FIG. 32 is illustrated. It is to be appreciated by looking into the second inner aperture 704, the first inner aperture 604, the second inner aperture 704, and the third inner aperture 802 are in fluid communication with each other. As such, in this view the second inner aperture 704 is in fluid communication with the surface 104.

Figure 34:
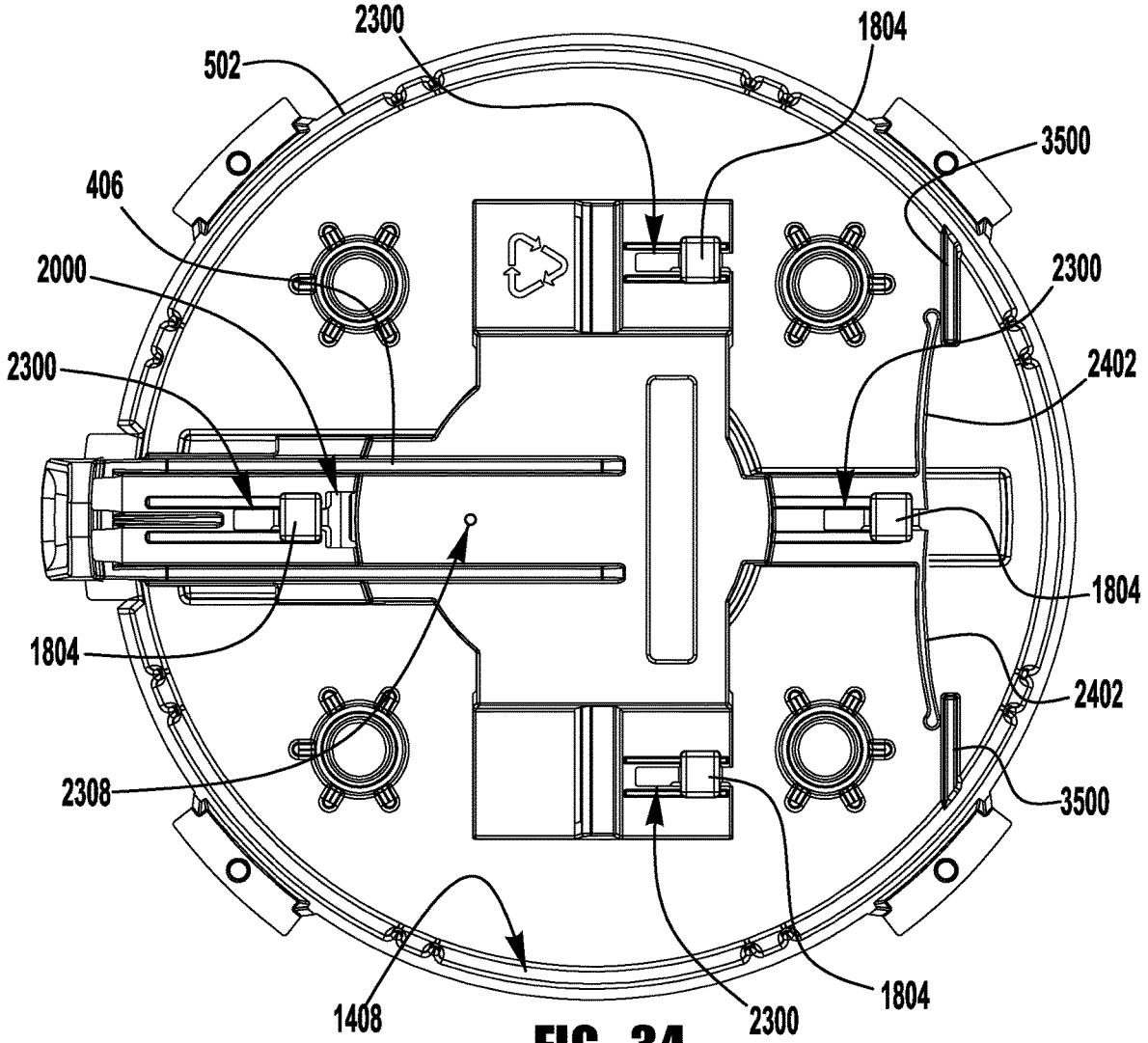
FIG. 34 illustrates an actuator in the receiver, with the actuator in a first functional position

Referring to FIG. 34, the actuator 406 is attached to the receiver 502, and a top view of this assembly is shown. As shown in FIG. 34, the actuator 406 can cooperate with the receiver 502 in any number of locations. For example, the slots 2300 are each cooperating with the locating tabs 1804. Additionally, each of the one or more arm structures 2402 are in contact with one or more walls 3500. As shown, the one or more walls 3500 can extend away from the interior surface 1408, however, any suitable location or structure (e.g., the wall) can serve as a location point for a contact with the one or more arm structures 2402. For example, the interior surface 1408 can provide this point of contact with the one or more arm structures 2402.

As previously noted, the receiver 502 can define retaining tabs 2000 that extend upward from an upward facing surface 2002 of the raised area 1700 (shown in FIG. 20). The two retaining tabs 2000 can be used to inhibit some motion of the actuator 406. FIG. 20 and other figures show greater detail of these retaining tabs 2000.

Figure 35:
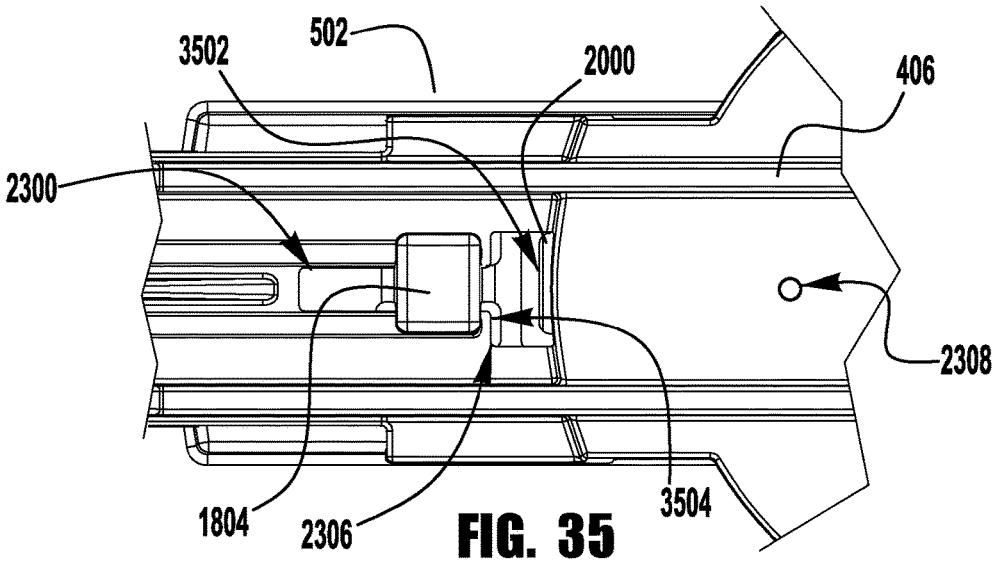
FIG. 35 is a detail of a portion of FIG. 34.

Remaining with FIG. 34, the actuator 406 is movable between a first position relative to the sealing device 500 and a second position relative to the sealing device 500. As shown, the actuator 406 is movable in a left-to-right and right-to-left orientation, however, other directions are also contemplated. FIGS. 34 and 35 can be referred to as the first position when the vent aperture 2308 defined by the actuator 406 is not within the second outside perimeter of the second portion of the sealing device 500.

Referring to FIG. 35, a detail view of the actuator 406 located within the receiver 502 is illustrated. As shown, a leading edge 3502 of the retaining tabs 2000 is not in contact with the edge 3504 of the slot 2300 defining an edge of the larger open portion 2306 of the slot 2300. For clarity, the leading edge 3502 is also shown in FIG. 20, while edge 3504 is also shown in FIGS. 24 and 26. In other words, the actuator is biased toward the left in FIG. 34. In this position the vent aperture 2308 is not in fluid communication with the center of the sealing device and thus, is not venting or relieving vacuum or suction pressure that is causing sealing device 500 to seal against surface 104 and retain the base 400 in position.

Figure 36:
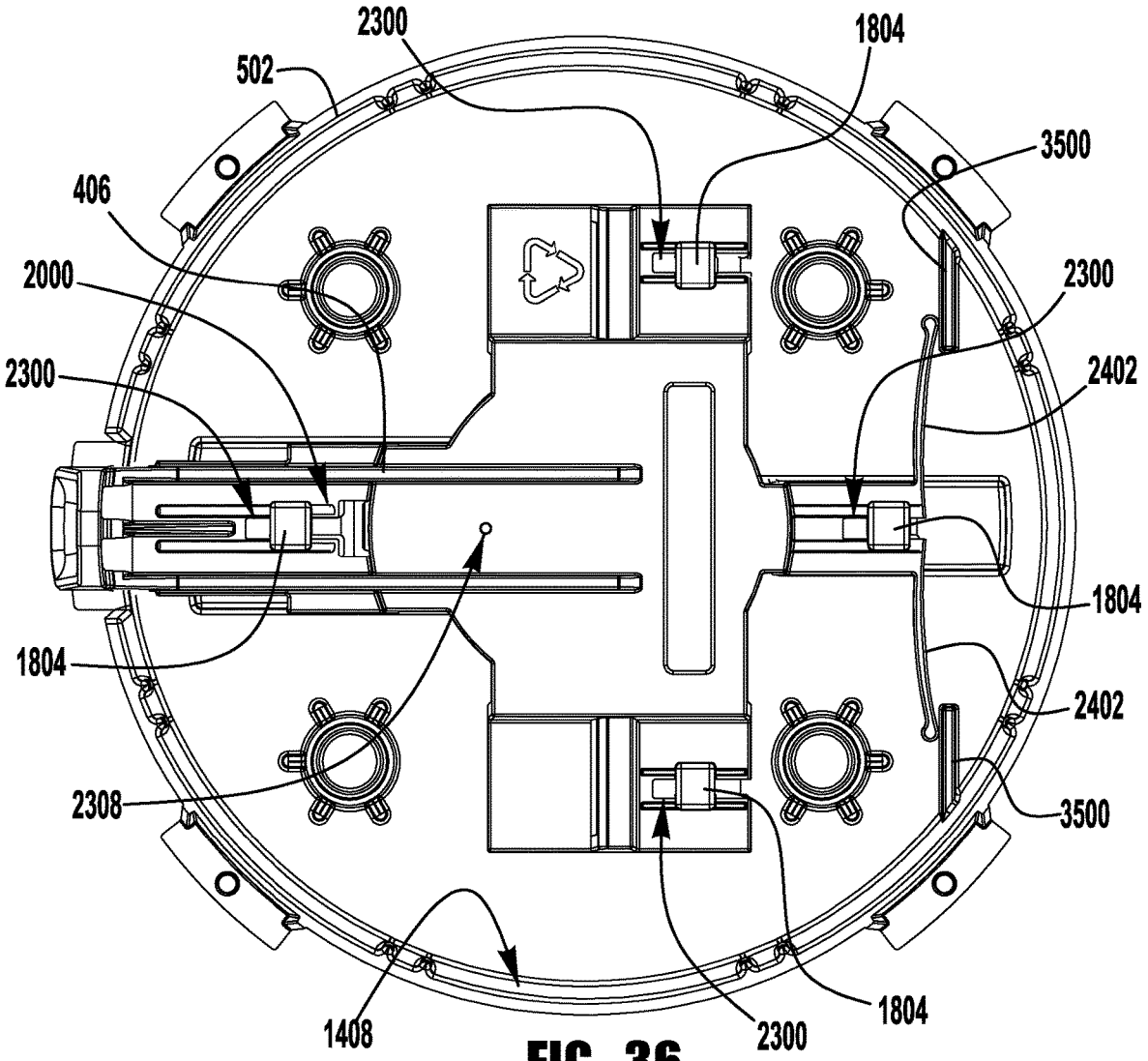
FIG. 36 illustrates an actuator in the receiver, with the actuator in a second functional position
Figure 36A:
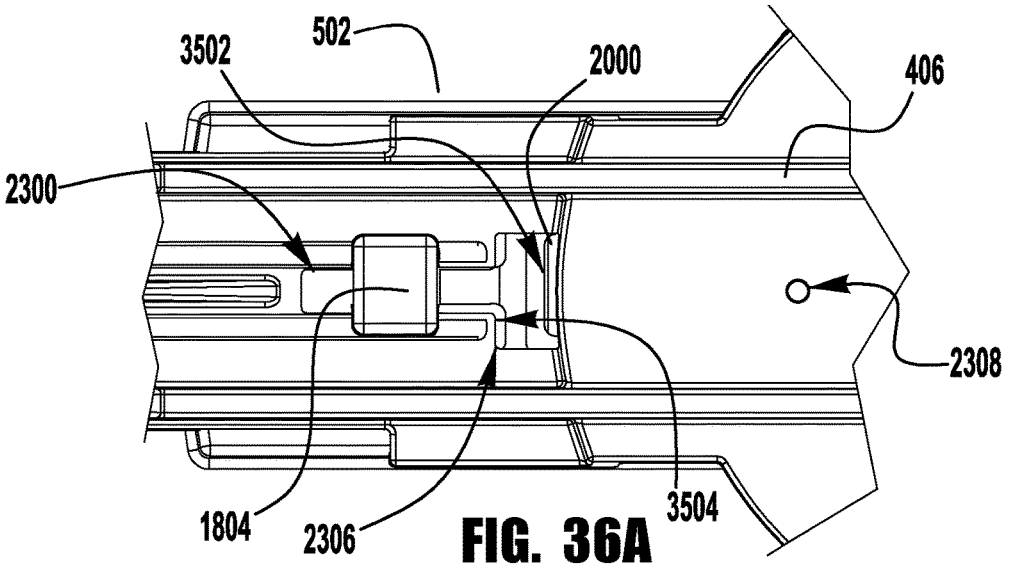
FIG. 36A is a detail of a portion of FIG. 36.

Referring to FIGS. 36 and 36A, the actuator 406 has been moved to an intermediate position between the first position relative to the sealing device 500 and a second position relative to the sealing device 500. As shown on the right-hand side of FIG. 36, the living spring and its arm structures 2402 are deflected, and the user applying a force to the right on the engagement member or actuator 406 (e.g., depressing the button-like device) is overcoming the force applied by biasing member 2400 in the form of the living spring.

Referring to FIG. 36A, a detail view of FIG. 36 is illustrated. In the described intermediate position, the leading edge 3502 of the retaining tabs 2000 is in contact with the edge 3504 of the slot 2300 as the actuator 406 has been moved to the right by a force applied by a user. The leading edges 3502 and 3504 can come into contact for a short period of time until an adequate force applied by the user can elastically deform the retaining tabs 2000 to remove the physical interference with the edge 3504. This interaction can give the user a tactile sense of the position of the actuator 406 relative to the receiver 502 and relative to the sealing device 500. In some embodiments, the physical interference between the two edges 3502 and 3504 is meant to be relatively easily overcome and exists mainly for tactile feedback to the user. In some embodiments, the tactile feedback is not present on the return stroke of the actuator 406 when the biasing member 2400 overcomes the user force on the actuator 406 or the user-applied force is removed.

Figure 37:
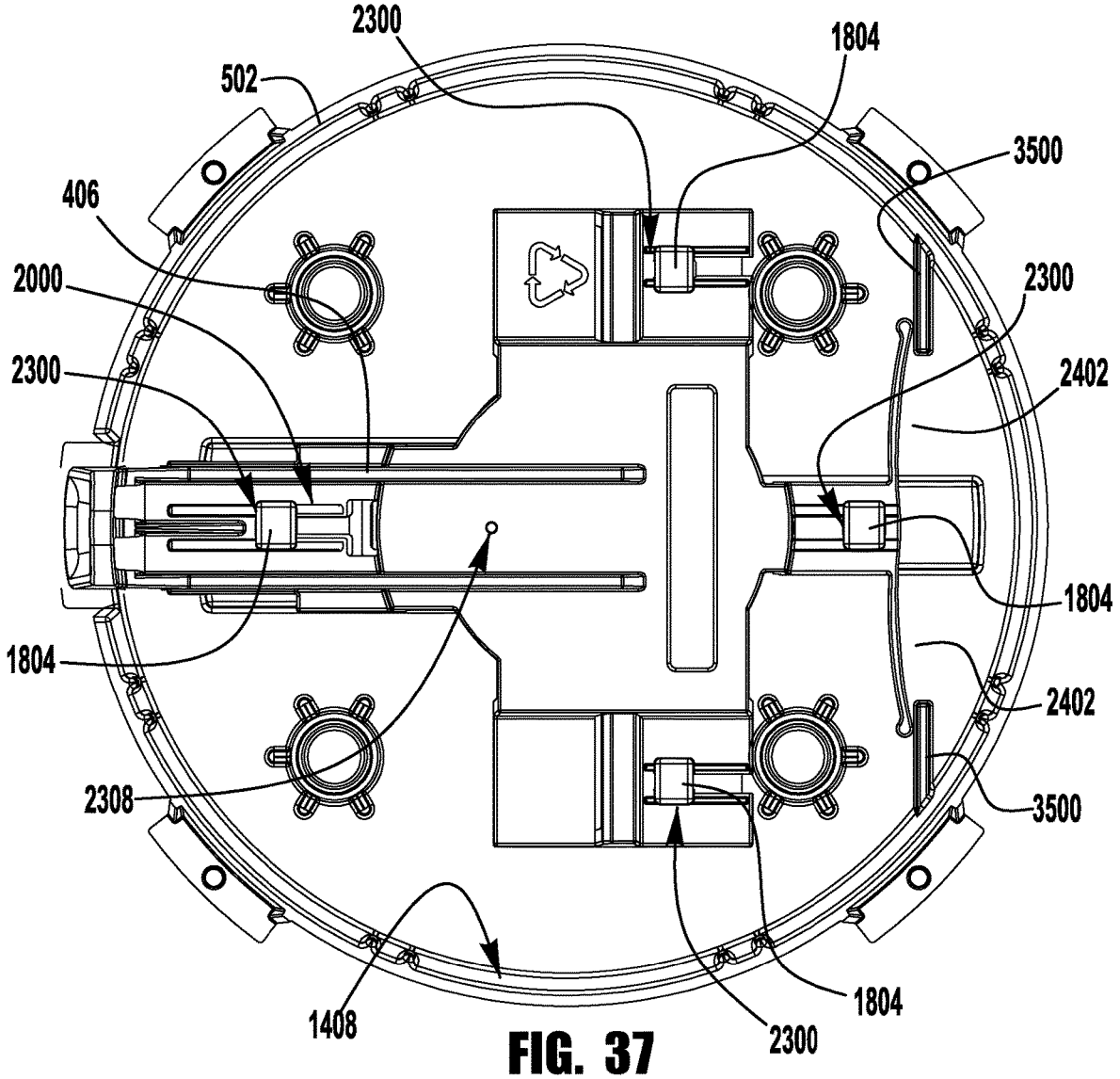
FIG. 37 illustrates an actuator in the receiver, with the actuator in a third functional position
Figure 38:
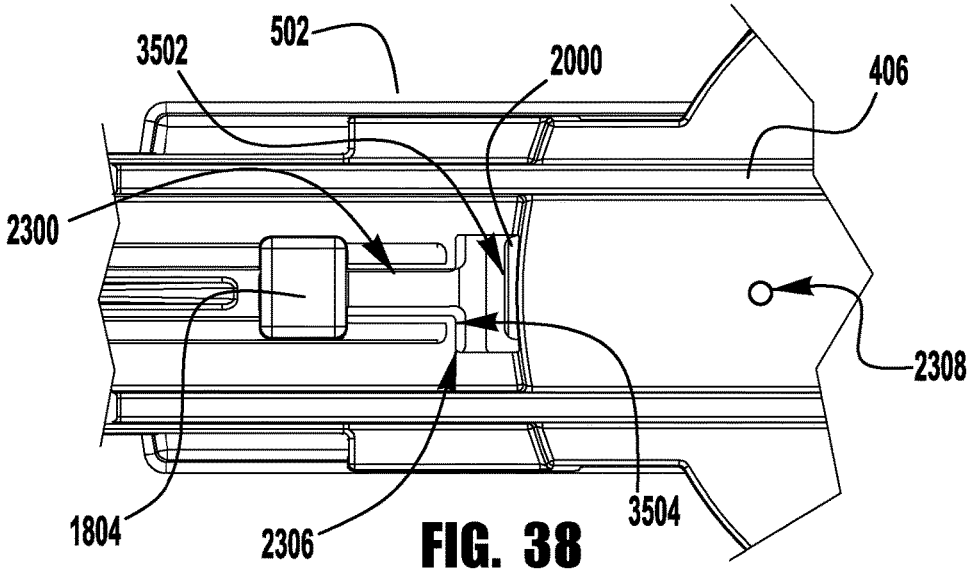
FIG. 38 is a detail of a portion of FIG. 37.

Referring to FIGS. 37 and 38, the actuator 406 has been moved to the second position relative to the sealing device 500. As will be further illustrated in subsequent figures, the vent aperture 2308 is moved within the second outside perimeter 702 placing the vent aperture in fluid communication with the center of the sealing device 500 and, thus, in fluid communication with the area between a mounting surface and the bottom surface of the sealing device 500. As shown in FIG. 37, the arm structures 2402 are deflected even farther than the first position shown in FIG. 36.

Referring to FIG. 38, a detail view of FIG. 37 is illustrated. When the actuator 406 is in the second position relative to the sealing device 500, the leading edge 3502 has passed by the edge 3504 of the slot 2300. As has been discussed, the biasing member 2400 exerts a force on the actuator 406 to maintain the actuator 406 in the first position. As such, when the user removes an applied force to the actuator 406, the actuator is urged to return to the first position relative to the sealing device 500.

Figure 39:
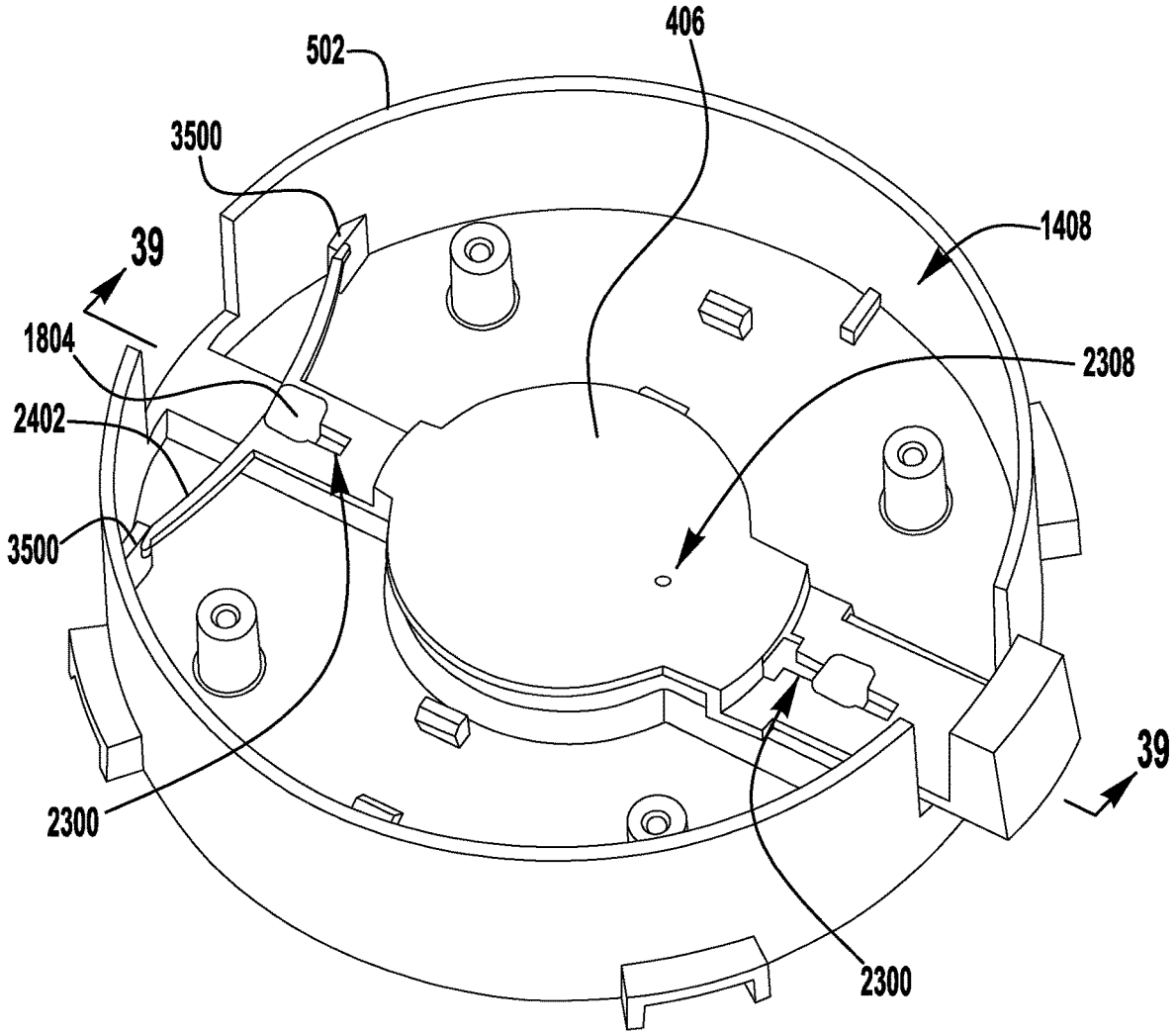
FIG. 39 is an exemplary embodiment of an actuator mounted in a receiver.

Referring to FIG. 39, another example receiver 502 and actuator 406 are shown. It is to be appreciated that several different styles, dimensions, shapes, and orientations can be used in the configurations of these two devices. The example of FIG. 38 will be used in FIGS. 40 and 41 show the relative position of the actuator 406 with respect to the sealing device 500.

Figure 40:
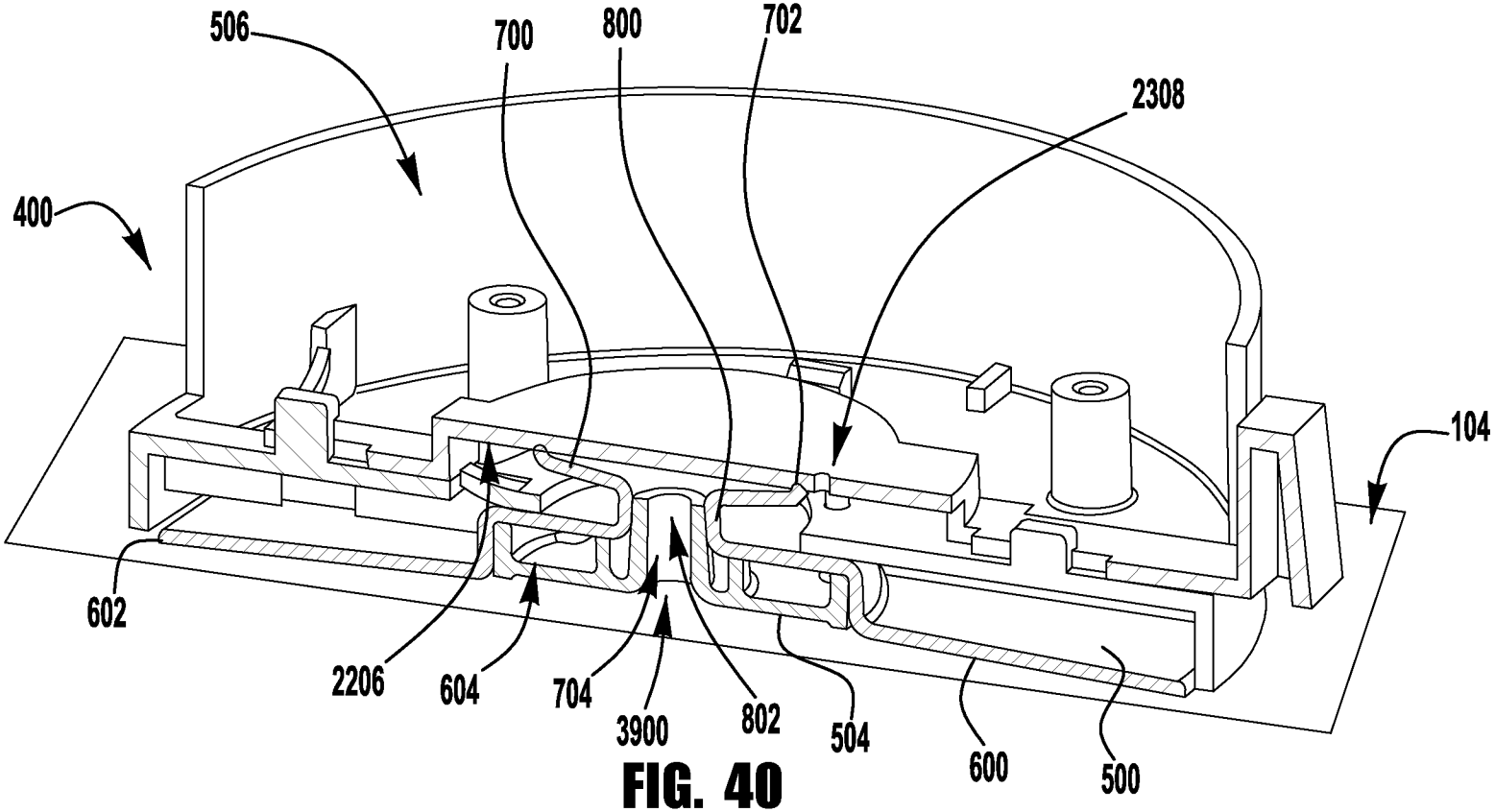
FIG. 40 is a cross-sectional view of the actuator mounted in the receiver and a stabilizer and an exemplary sealing device, with the actuator in a first functional position.
Figure 41:
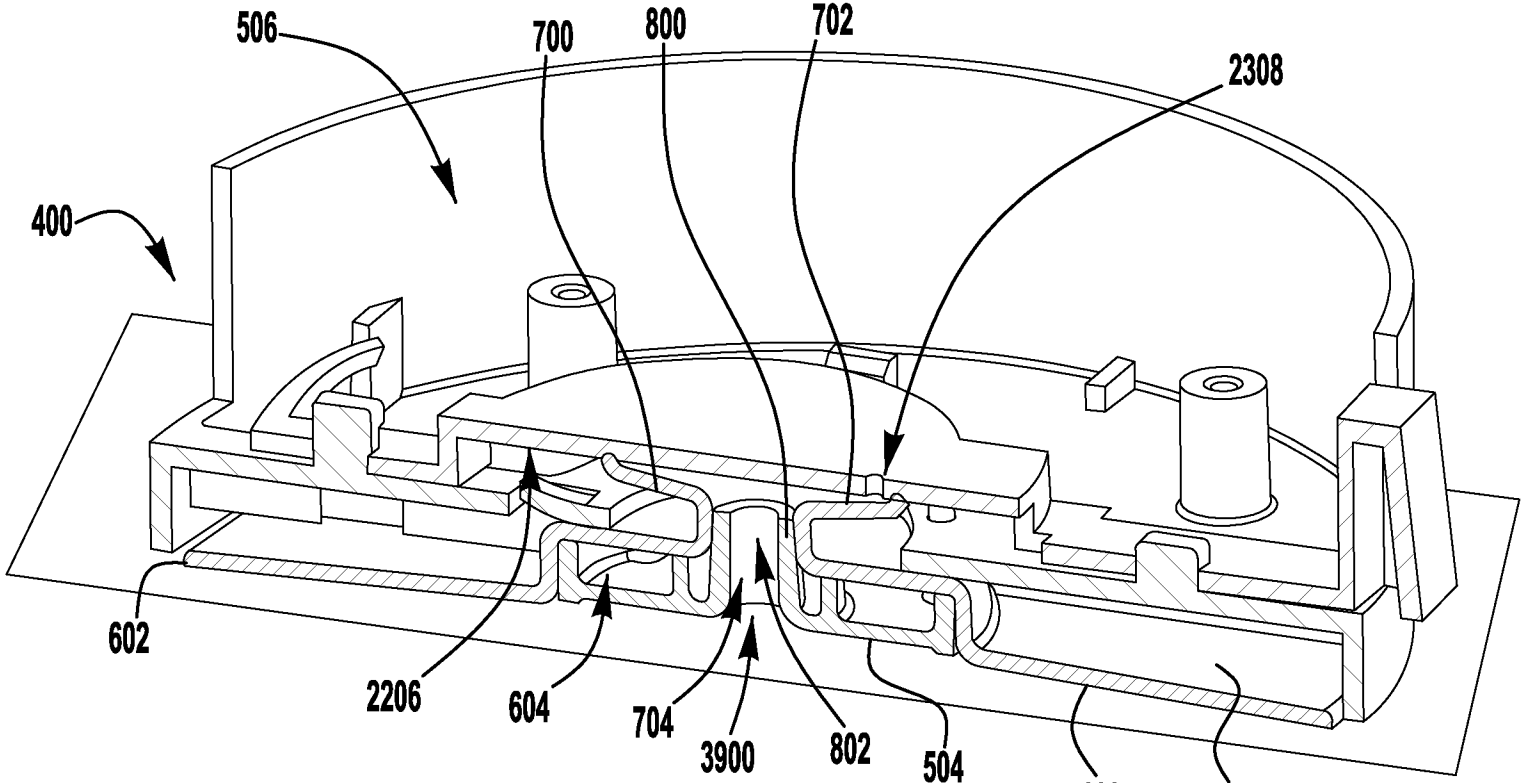
FIG. 41 is a cross-sectional view of the actuator mounted in the receiver and a stabilizer and an exemplary sealing device, with the actuator in a second functional position.

Referring to FIG. 40, a cross-sectional view of certain components of the base 400 are illustrated with the actuator in the first position relative to the sealing device 500. The first portion 600 of the sealing device 500 contacts the surface 104 such that the first outside perimeter 602 forms an airtight seal between the first portion 600 and the surface 104. Similarly, the second portion 700 contacts a face (e.g., the downward facing surface 2206) of the actuator 406 such that the second outside perimeter 702 forms an airtight seal between the second portion 700 and the downward facing surface 2206. Pushing downward on the base 400 pushes air out of beneath the sealing device 500 and forms a suction pressure between the sealing device 500 and surface 104. In some embodiments, the suction force inhibits movement of the base 400 relative to the surface 104 so as to mount the base 400 to the surface. In some embodiments, the base 400 is inhibited in movement of any direction relative to the surface 104. In other examples, the base 400 is inhibited primarily in a vertical direction (e.g., perpendicular to the surface 104) or a nearly vertical direction. As such, a user can vertically pull a wipe from the wipes canister 102 without having to hold the wipes canister 102. This enables one-handed operation for a user.

In some embodiments, the wipes dispensing system 100 will enable some movement side-to-side, that is, along the surface 104 while inhibiting vertical motion of the wipes dispensing system 100 away from the surface 104. As shown in FIG. 40, the vent aperture 2308 is not within the second outside perimeter 702.

Without interruption, the second portion 700 can form the airtight seal with the face (e.g., the downward facing surface 2206) when the actuator 406 is in the first position relative to the sealing device 500. As previously discussed, the actuator 406 is movable between the first position (as shown in FIG. 40) and the second position (shown in FIG. 41) relative to the sealing device 500.

Referring to FIG. 41, a cross-sectional view of parts of the base 400 is illustrated with the actuator 406 in the second position relative to the sealing device 500. When the actuator 406 is in the second position relative to the sealing device 500, the vent aperture 2308 is within the second outside perimeter 702 such that ambient air is in fluid communication with the center of and the underneath of sealing device 500 releasing the suction pressure and allowing the base 400 to be removed from the surface 104.

Figure 42:
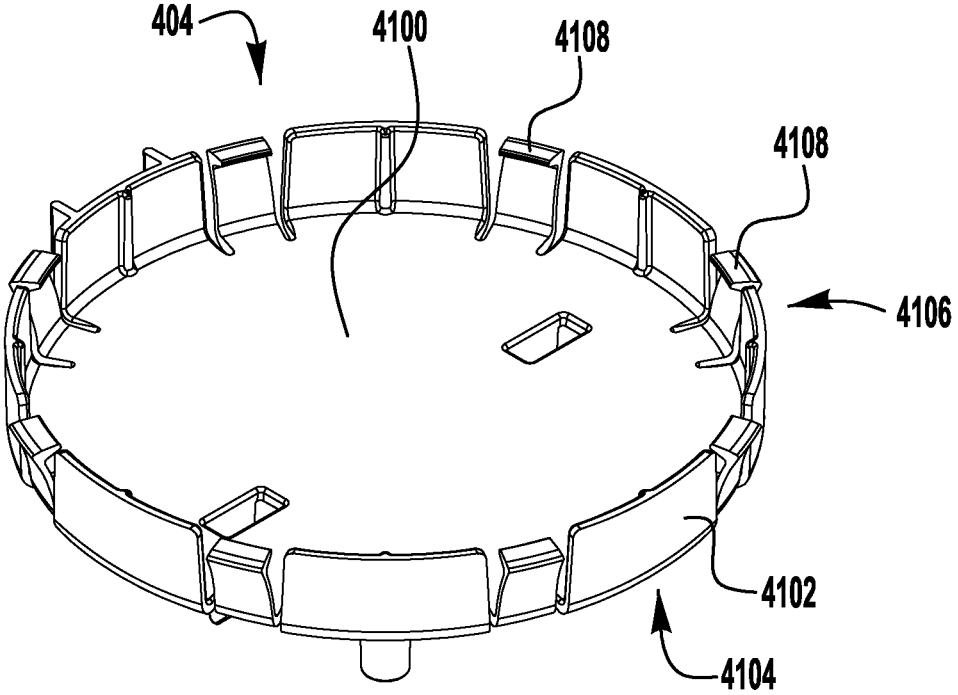
FIG. 42 is a prospective view of a base plate for receiving a wipes dispensing canister.

Referring to FIG. 42, a perspective view of the base plate 404 is illustrated. The base plate 404 includes a base plate floor 4100 and a base plate sidewall 4102 extending between a first end 4104 and a second end 4106. The base plate floor 4100 and the base plate sidewall 4102 can be formed as a continuous piece, such as in a plastic molding operation. The base plate 404 includes an canister retention members 4108.

Figure 43:
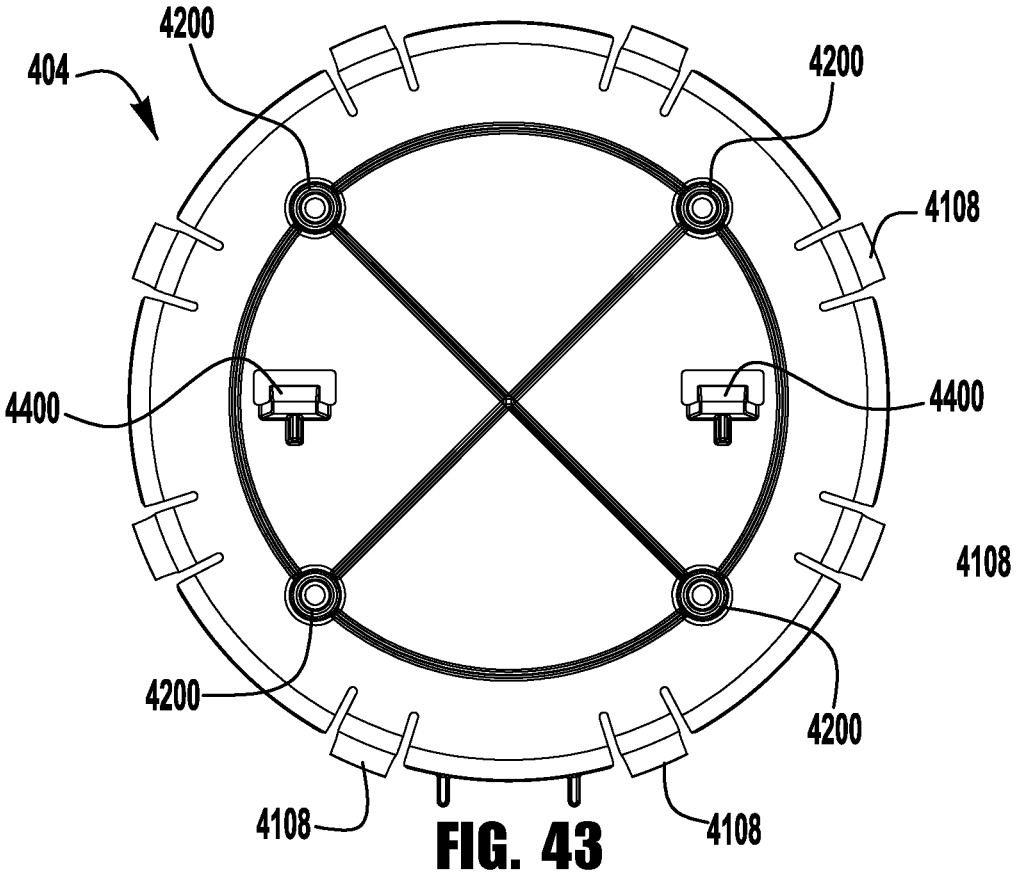
FIG. 43 is a plan view of the base plate of FIG. 42.

Referring to FIG. 43, a bottom view of the base plate 404 is illustrated. The base plate 404 can include boss structures 4200 that are configured to cooperate with the bosses 1800 of the receiver 502 (shown in FIG. 18). As shown, the canister retention members 4008 can be uniformly sized and spaced equally around the perimeter of the base plate 404. However, in some examples the canister retention members 4008 can be sized differently and or have non-uniform spacing between canister retention members 4008 so as to interact with complementary annular features on the wipes canister 102 as will be discussed below.

Figure 44:
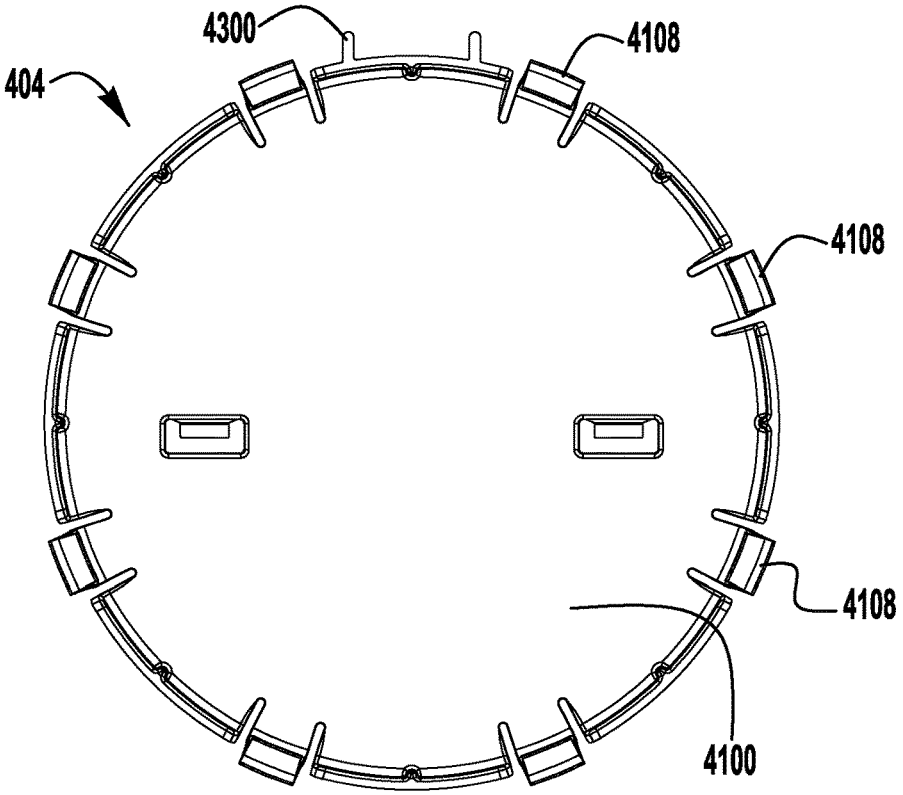
FIG. 44 is a plan view of the base plate of FIG. 42.

Referring to FIG. 44, a top view of the base plate 404 is illustrated. The base plate 404 can include ribs 4300 configured to fit within the opening 1500 in the receiver wall 1402 so as to positively locate the base plate 404 rotationally relative to the receiver 502.

Figure 45:
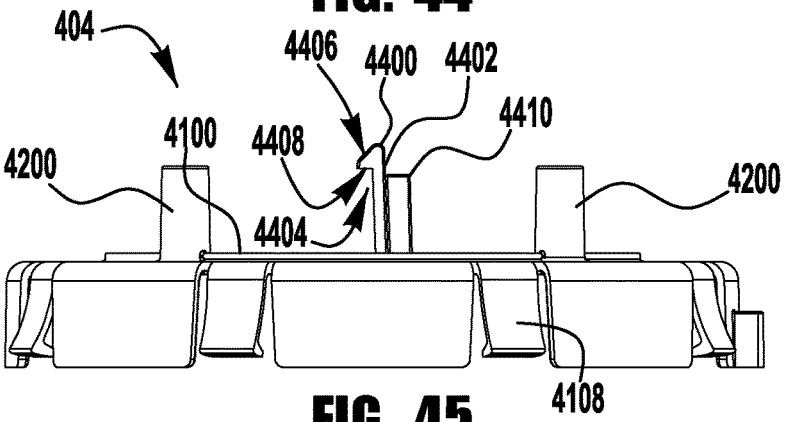
FIGS. 45 and 46 are side views of the base plate of FIG. 42 in an upside-down position.

Referring to FIG. 45, a detailed view of the boss structures 4200 extending in a downward direction (upward in FIG. 45) from the base plate floor 4100 and a second coupling member 4400 is illustrated. As noted previously, the boss structures 4200 are configured to cooperate with the bosses 1800 within the receiver 502. As such, the boss structures 4200 will be arranged in the same pattern as the bosses 1800.

The second coupling member 4400 also extends downward from the base plate floor 4100 and is configured to cooperate with the first coupling member 2208 of the actuator 406. The second coupling member 4400, similar to the first coupling member 2208 can be defined by a block of material 4402 having an undercut area 4404, and the block of material 4402 can include an angled surface 4406 configured to cooperate with the angled surface 2902 of the first coupling member 2208. The second coupling member 4400 can include an upward facing surface 4408 (downward in FIG. 45) configured to cooperate with the downward facing surface 2210 of the first coupling member 2208. A reinforcing rib 4410 can be included to strengthen the second coupling member 4400.

Figure 46:
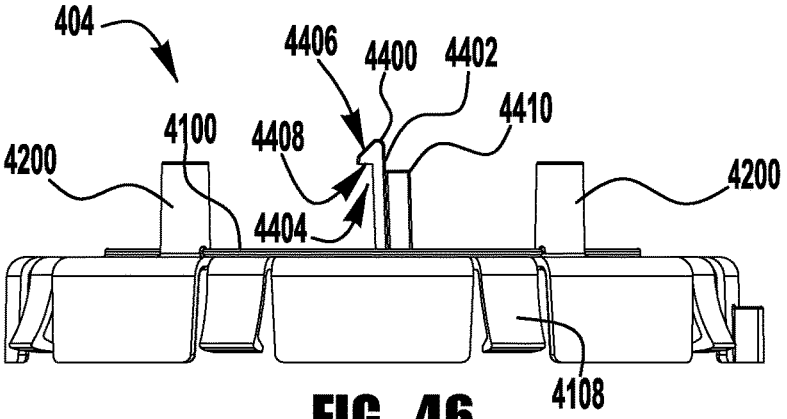

Referring to FIG. 46, a different perspective view of the base plate floor 4100 is illustrated.

Figure 47:
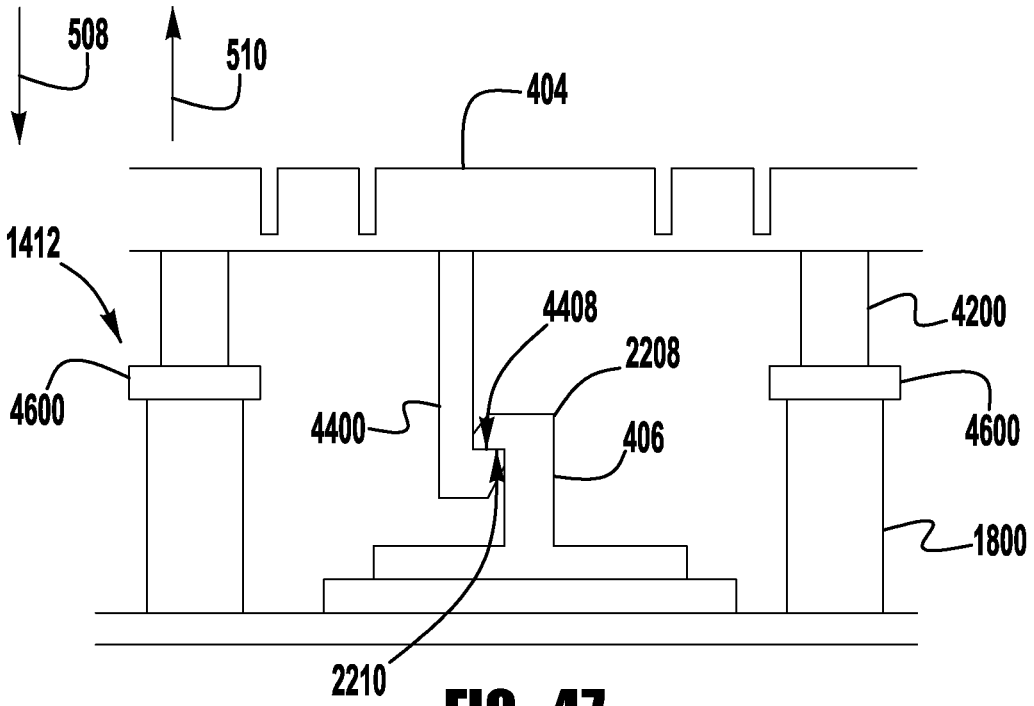
FIG. 47 is a partial view of an exemplary actuator, bae plate an receiver with the actuator in a first functional position.
Figure 48:
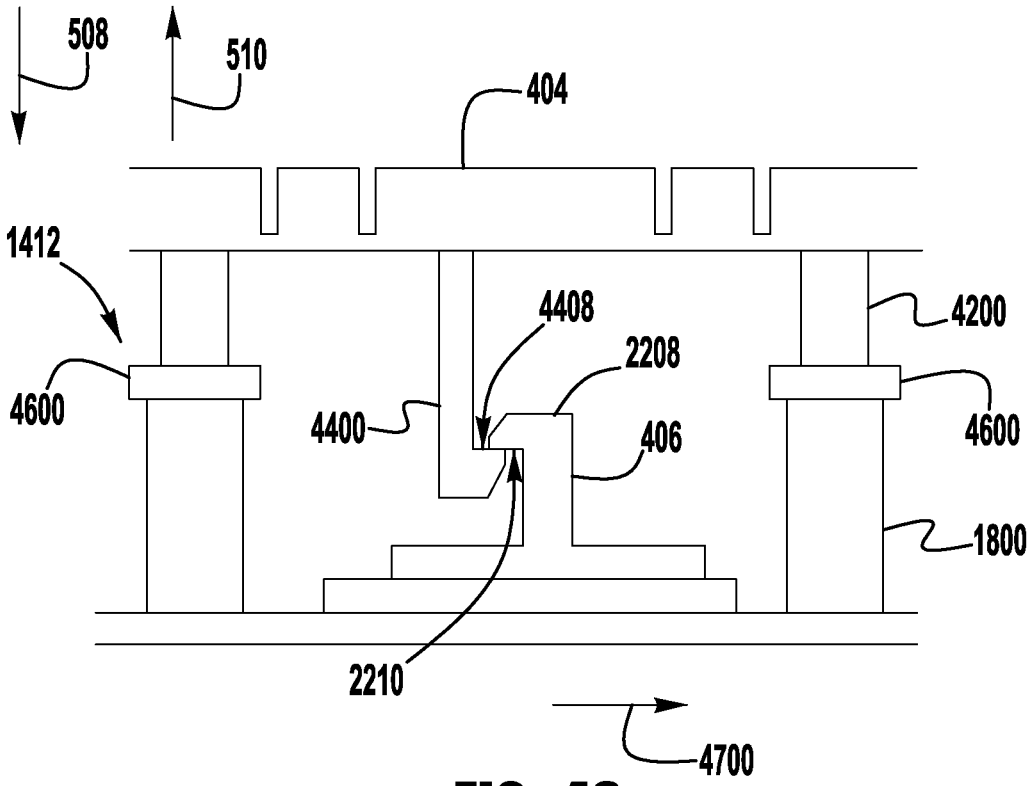
FIG. 48 is a partial view of an exemplary actuator, bae plate an receiver with the actuator in a second functional position.

Referring to FIGS. 47-48, schematic representations of the interaction between the actuator 406 and the base plate 404 are illustrated. The actuator 406 is movable between a first position and a second position relative to the base plate 404 to engage and disengage therebetween. In some embodiments this distance of this relative movement is not the same distance as the relative movement between the vent aperture 2308 of actuator 406 and the sealing device 500 required to release the suction forces and disengage the base 400 from a surface. In some embodiments, the two movements have the same relative movements.

FIG. 47 illustrates the first position of the actuator 406 relative to the base plate 404. The first position has the actuator 406 biased in its outermost position. In this position, the base plate 404 is received within the receptacle 1412 (also represented in FIGS. 54-56). When the actuator 406 is in the first position relative to the base plate 404, a biasing member 4600 biases the base plate 404 in an upward direction (e.g., second direction shown by arrow 510), but the physical interference between the upward facing surface 4408 of the base plate 404 and the downward facing surface 2210 of the actuator 406 maintains the base plate 404 in its downmost position within the receptacle 1412.

Referring to FIG. 48, the actuator 406 has been moved to an intermediate position between the first position relative to the base plate 404 and the second position relative to the base plate 404. The actuator 406 has moved to the right in the figure represented by arrow 4700, and the downward facing surface 2210 has moved relative to the upward facing surface 4408. In some embodiments, at this position, the vent aperture 2308 is in fluid communication with the bottom surface of sealing device 500 allowing the release of any suction force holding the base 400 in place.

Figure 49:
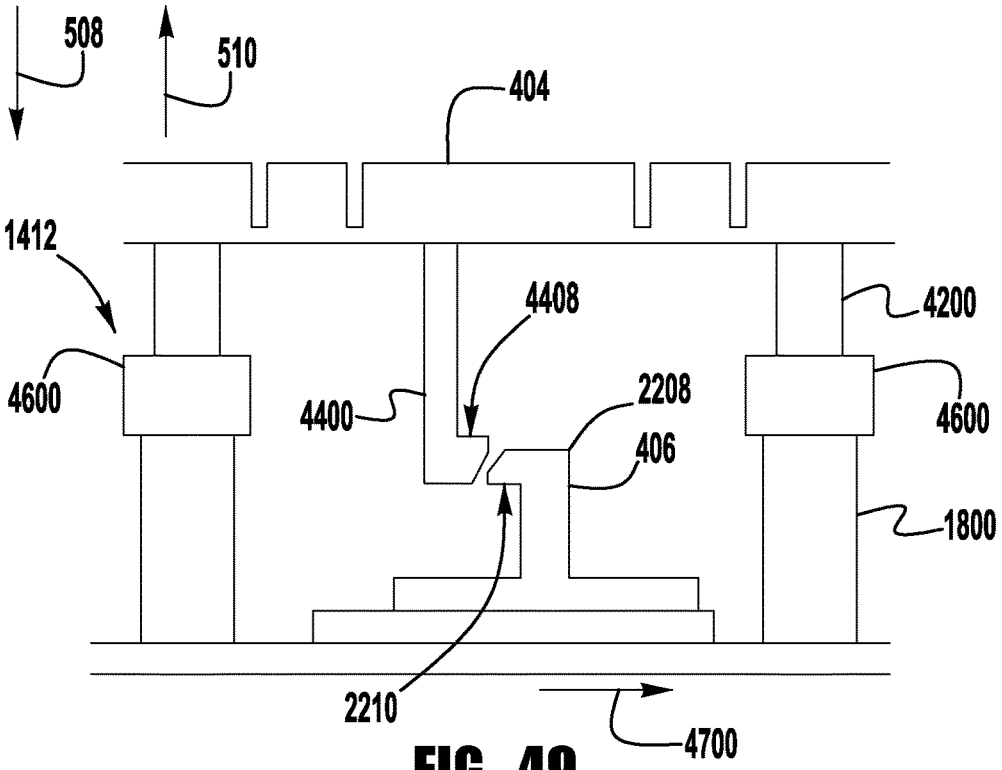
FIG. 49 is a partial view of an exemplary actuator, bae plate an receiver with the actuator in a third functional position.

Referring to FIG. 49, the actuator 406 is in the second position relative to the base plate 404, i.e. the inner most position, and the first coupling member 2208 is not coupled to the second coupling member 4400. The physical interference between the upward facing surface 4408 and the downward facing surface 2210 has been removed, enabling the biasing member 4600 (e.g., a coil spring) to urge the base plate 404 in the second direction shown by arrow 510 (e.g., upward).

Figure 50:
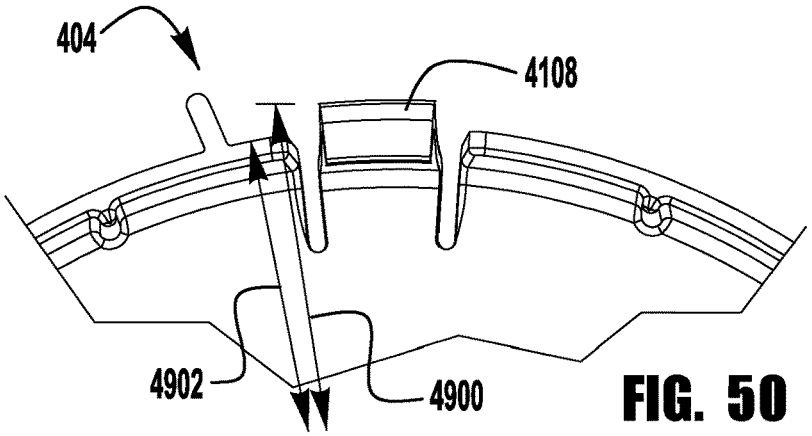
FIGS. 50-52 are partial views of portions of the base plate with canister retention members in an open or released position.

Referring to FIG. 50, a detailed view of an canister retention members 4108 is illustrated. In some embodiments, the canister retention members 4108 can have a dimension 4900 from a center point of the base plate 404 that is longer than a dimension 4902 of the base plate sidewall 4102. This differing dimension can occur in any suitable manner, for example a biasing device can bias the canister retention members 4108 outward. In some embodiments, the canister retention members 4108 has been molded so that the canister retention members 4108 extend outward The canister retention members 4108 may be flexed inward to a biased position as described below by applying an inward force on the canister retention members. When that inward force is removed, canister retention members 4108 move outward to their unbiased position. The canister retention members 4108 may be engineered and manufactured to be biased to the dimension 4900. FIG. 49 illustrates the canister retention members 4108 in the first position relative to the base plate 404.

Figure 51:
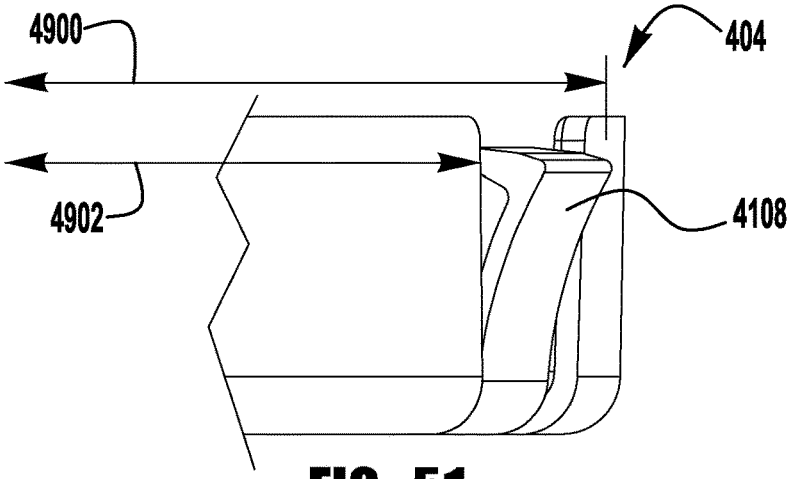

Referring to FIG. 51, an elevation view of the canister retention members 4108 is illustrated. This provides another perspective view of the dimension 4900 that is longer than the dimension 4902 for the base plate sidewall 4102. It is worthy of note that each of the canister retention members 4008 can be elastically deflected from a first position to a second position. FIG. 51 illustrates the canister retention members 4108 in the first position relative to the base plate 404.

Figure 52:
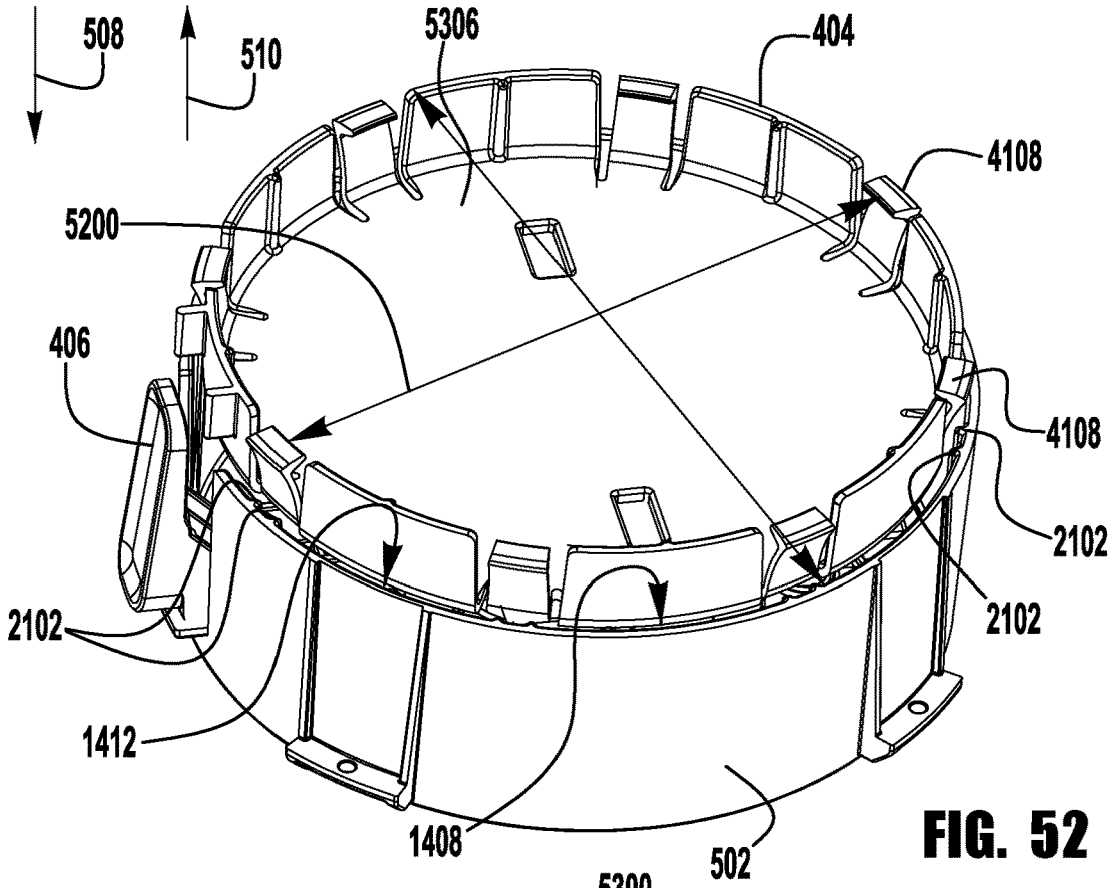

Referring to FIG. 52, a perspective view of the base plate 404 and the receiver 502 is shown (base cover 402 is removed). In FIG. 52, the actuator 406 is in the first position relative to the base plate 404. As such, the biasing member 4600 (not shown) is urging the base plate 404 in a second direction shown by arrow 510 (e.g., upward). As discussed previously, the base plate 404 can be clocked rotationally with respect to the receiver 502. As such, each canister retention member 4108 can be aligned with one or more ribs 2102 located on the interior surface 1408. It is to be understood that the base plate 404 moves in a first direction shown by arrow 508 (e.g., downward) as the base plate 404 is received in the receptacle 1412. The biasing member 4600 can be located between the receiver 502 and the base plate 404. The application of the force on the base plate 404 in the first direction shown by arrow 508 can arise from a user placing a wipes canister 102 on top of the base plate 404 and urging the canister in the first direction (e.g., downward). FIG. 52 illustrates the canister retention members 4108 in the first position relative to the base plate 404. In this first position, a wipes canister (not shown) may be removed from the bae. As can be seen, the tops of the canister retention members 4108 are located above the top of the receiver 502, which allows the canister retention members 4108 in their outward unbiased position.

Figure 53:
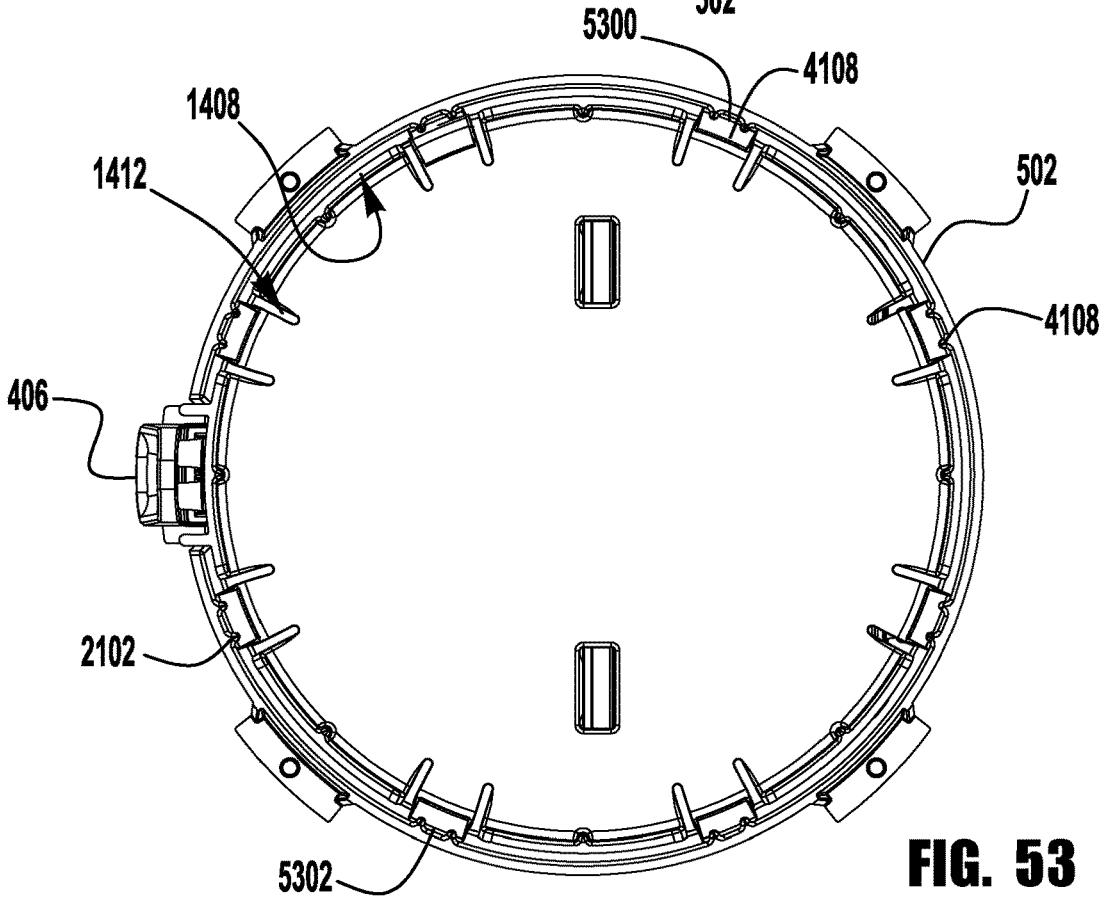
FIG. 53 is a plan view of the base plate in the receiver with canister retention members in an closed or engaged position.

Referring to FIG. 53, a top view of the base plate 404 and the receiver 502 is illustrated. In this view, the actuator 406 is in the second position (i.e. engaged position) relative to the base plate 404 and the base plate 404 is received within the receptacle 1412. For ease of explanation, a first one of the canister retention members 5300 and a second canister retention member 5302 are specifically called out, but are merely certain selected ones of the canister retention members 4108. The first canister retention member 5300 and the second canister retention member 5302 are diametrically opposed such that the canister retention members 5300, 5302 are in place to measure the greatest width across the base plate 404. Of course, if the base plate 404 has a shape that is other than circular, the dimensions may differ, but the principal of the following operation and relationships between structures will remain the same. FIG. 49 illustrates the canister retention members 4108 in the first position relative to the base plate 404. The first position is the released position.

When the actuator 406 is in the second position (the engaged position) relative to the base plate 404, the canister retention members 5300, 5302 are elastically moved inward and maintained in that position due to the force applied by the interior surface 1408 and/or the ribs 2102 having a smaller diametral dimension than the diametral dimension between the canister retention members 5300, 5302 when the actuator is in the second position relative to the base plate 404. As such, the downward (e.g., the first direction)

force on the base plate 404 provided by the wipes canister 102 moves the base plate 404 downward, moves the canister retention members inward and causes the first coupling member 2208 to engage with the second coupling member 4400.

Returning to FIGS. 48 and 52, when the actuator 406 is in the second position (innermost position) relative to the base plate 404, the first coupling member 2208 is not coupled to the second coupling member 4400 and the force exerted by the biasing member 4600 on the base plate 404 moves the base plate 404 in the second direction shown by arrow 510 (e.g., upward) such that the canister retention members 4108 are in their outward most, or unbiased, position.

Figure 54:
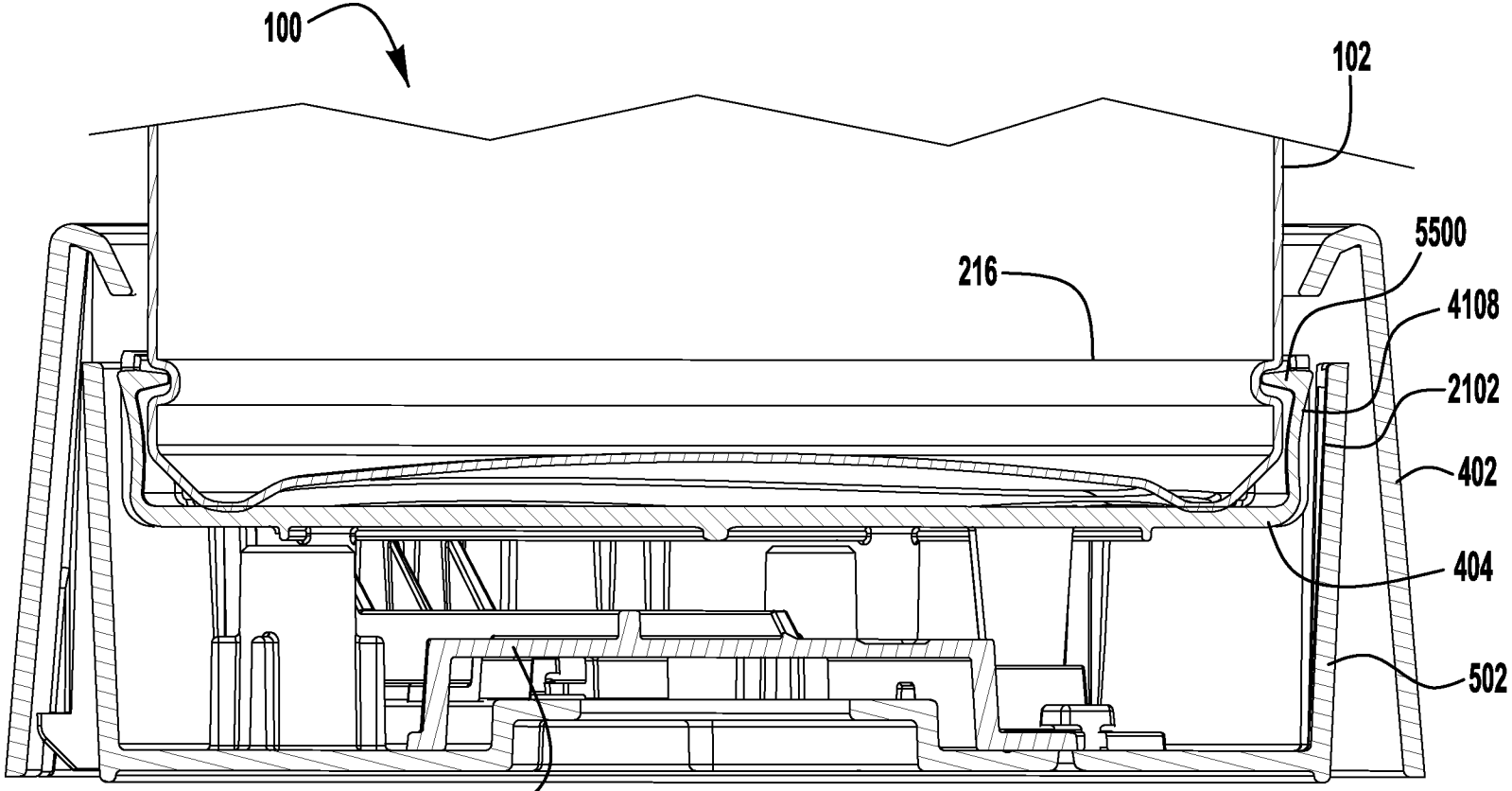
FIG. 54 is a cross-sectional view of a base and a portion of a wipes dispensing canister with the canister retention members in a closed or engaged position.
Figure 55:
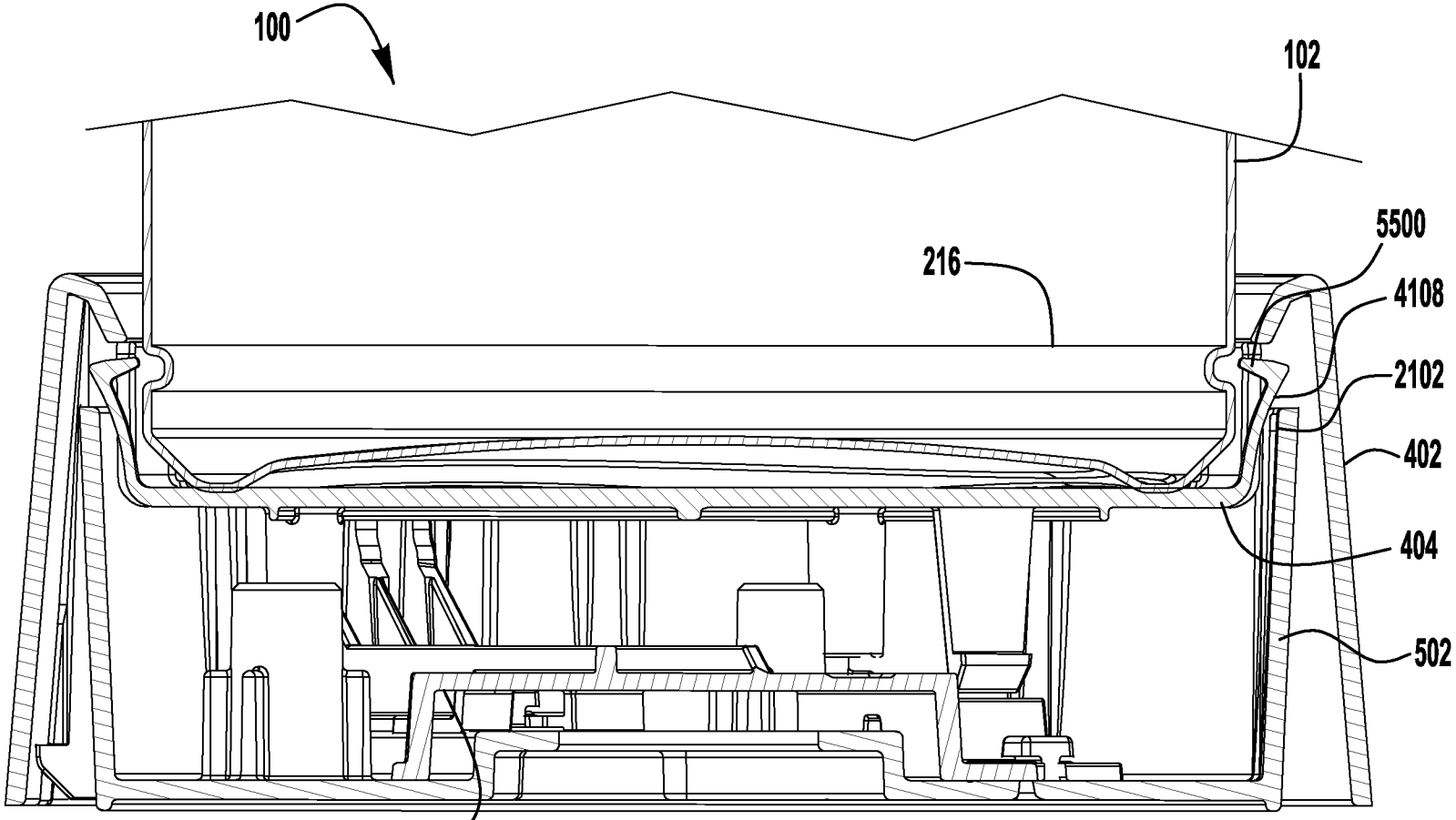
Figure 56:
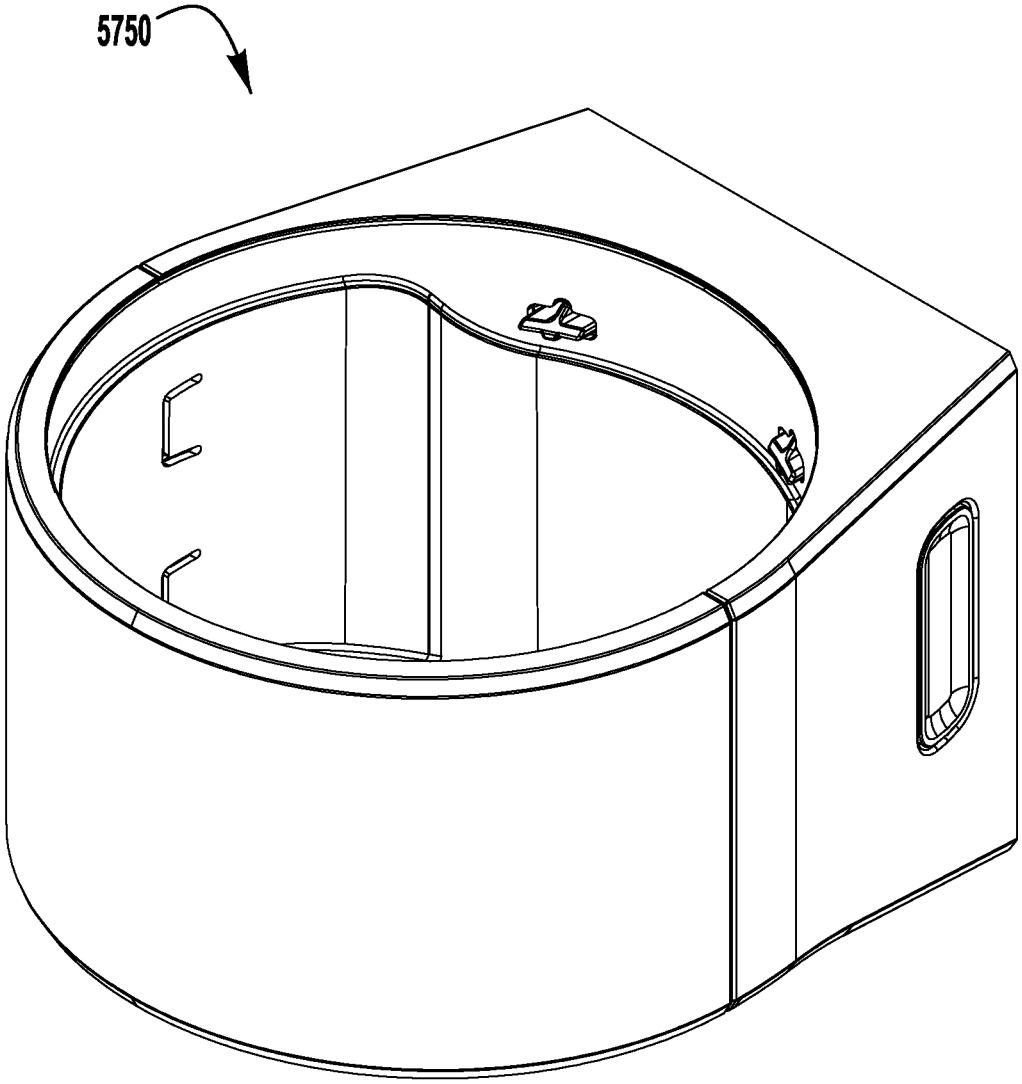
FIG. 56 is a prospective view of a an exemplary embodiment of wall mounting bracket for a wipes dispensing canister.

Referring to FIGS. 54 and 55, cross-section views of the wipes dispensing system 100 are illustrated. The canister retention members 4108 are movable between the first position (released position) and the second position (engaged position) as discussed. In FIG. 55, the canister retention member 4108 is shown in the second position (engaged position), and the canister retention members 4108 engages the annular feature 216 to attach the wipes canister 102 to the base 400 and mount the wipes canister 102 to the surface 104 through the base 400 when the base 400 is mounted to the surface 104. Engagement of the annular feature 216 can be effected by a tab 5500 extending from the canister retention members 4108. Engagement between the canister retention members 4108 with the annular feature 216 attaches the wipes canister 102 to the base 400. FIG. 54 represents the canister retention members 4108 in the second position (engaged position) relative to the base plate 404 while the actuator 406 is in the first position relative to the base plate 404.

Referring to FIG. 55 when the canister retention member 4108 is in the first position relative to the base plate 404, the canister retention member 4108 does not engage the annular feature 216 such that the wipes canister 102 is removable from the base 400. A base cover 402 covers a number of components of the base 400.

Within the present disclosure, the actuator has been described as movable between multiple positions with respect to both the sealing device and the plate. It is contemplated that a first actuator can be movable between a first position with respect to the sealing device and a second position with respect to the sealing device.

Additionally, a second actuator can be movable between a first position with respect to the plate and a second position with respect to the plate. In other words, two separate actuators can be present in the described apparatus; one movable with respect to the sealing device, and the other movable with respect to the plate.

However, a single actuator (as described prominently in the specification) can be movable with respect to both the sealing device and the plate. For example, the surface mounting mechanism can include an actuator movable between a first position, a second position, and a third position.

When the actuator is in the first position, a vent aperture defined in the actuator is not in fluid communication with the mechanism that mounts the mechanism to the surface such that ambient air is not able relive the suction force and prevents removal of the base from the surface. When the actuator is in the first position, the actuator does not decouple a coupling arrangement between a first coupling member and a second coupling member of the mechanism such that an attachment structure of the mechanism attaches the canister to the mechanism such that the canister is mounted to the surface through the mechanism.

When the actuator is in the second position, the actuator decouples the coupling arrangement between the first coupling member and the second coupling member such that the canister retention members do not engage the canister and retain it in the base.

When the actuator is in the second position, the vent aperture is not in fluid commination with the area between the coupling device and the surface and does not relieve the suction force.

When the actuator is in the third position, the vent aperture is in fluid communication with the area between the sealing device and the surfaced and the suction force is relieved enabling the base to be easily removed from the surface.

In some embodiments, the actuator is located in a first actuator position that correlates to the first position relative to the sealing device and the first position relative to the plate.

In some embodiments, the actuator is configured to have three functional positions. A first functional position, is the actuator at rest in its fully unbiased position. The actuator is at rest, the sealing device is sealed to a surface with suction force and a canister is retained in the base. In a second functional position, the vent aperture is in fluid communication with the area between the sealing device and a surface. The suction force is relieved and the base may be removed from the surface. In a third functional position, the canister is removable from the base. In some embodiments, movement of the actuator progresses from the first functional position to the second functional position to the third functional position. In some embodiments, movement of the actuator progresses from the first functional position to the third functional position to the second functional position. Thus, movement of the actuator may release the base from a surface and continued movement of the actuator may release the wipes canister from the base.

Figure 57:
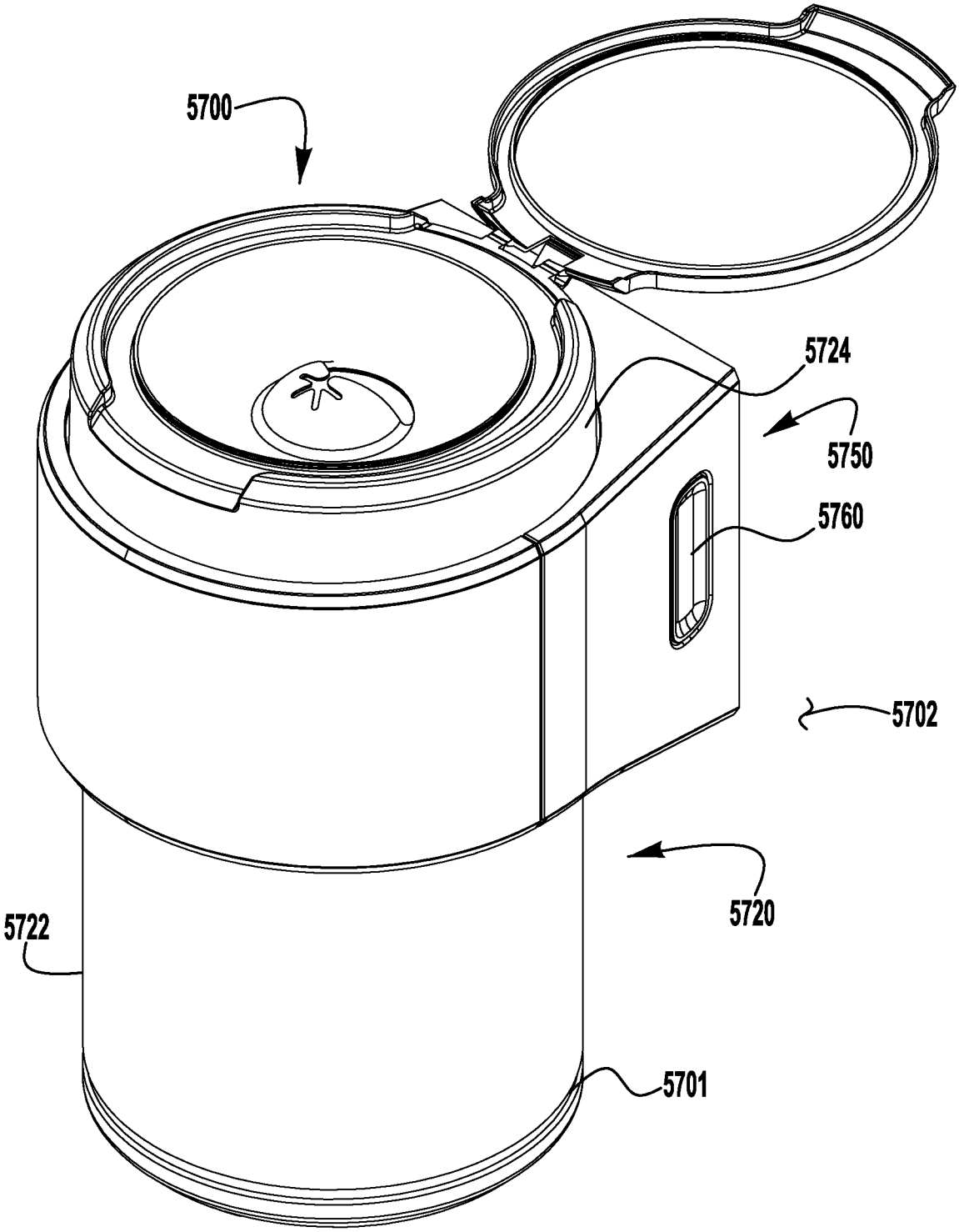
FIG. 57 is a prospective view of an exemplary wipes dispensing canister mounted to a vertical surface using a wall mounting bracket.

FIG. 57 is a prospective view of an exemplary wipes dispensing canister 5720 mounted to a vertical surface 5702 using an exemplary wall mounting bracket 5750. Wall mounting bracket 5750 may be mounted to any vertical surface or substantially vertical surface, such as, for example, a wall, a partition, a stand-alone stand, a moveable stand, a window, or the like. Accordingly, the term "wall" should be construed broadly to be any substantially vertical surface. Wall mounting bracket 5750 may be mounted to the surface by, for example, one or more screws, adhesive, adhesive tape, or the like, and/or combinations thereof.

In this exemplary embodiment, wipes dispensing canister 5720 has a cylindrical body 5722 having a substantially circular cross-section. In some embodiments, wipes dispensing canister 5720 has a different shaped body, such as, for example, an elongated body with an oval shaped cross-section, a square shaped cross-section, a hexagonal shaped cross-section, a square shaped cross-section with chamfered corners, a rectangular shaped cross-section with chamfered corners, or the like. In some embodiments, wipes dispensing canister 5720 includes an annular grooves 5701 for mating with one or more canister retention members in a canister mounting base discussed above.

Figure 59:
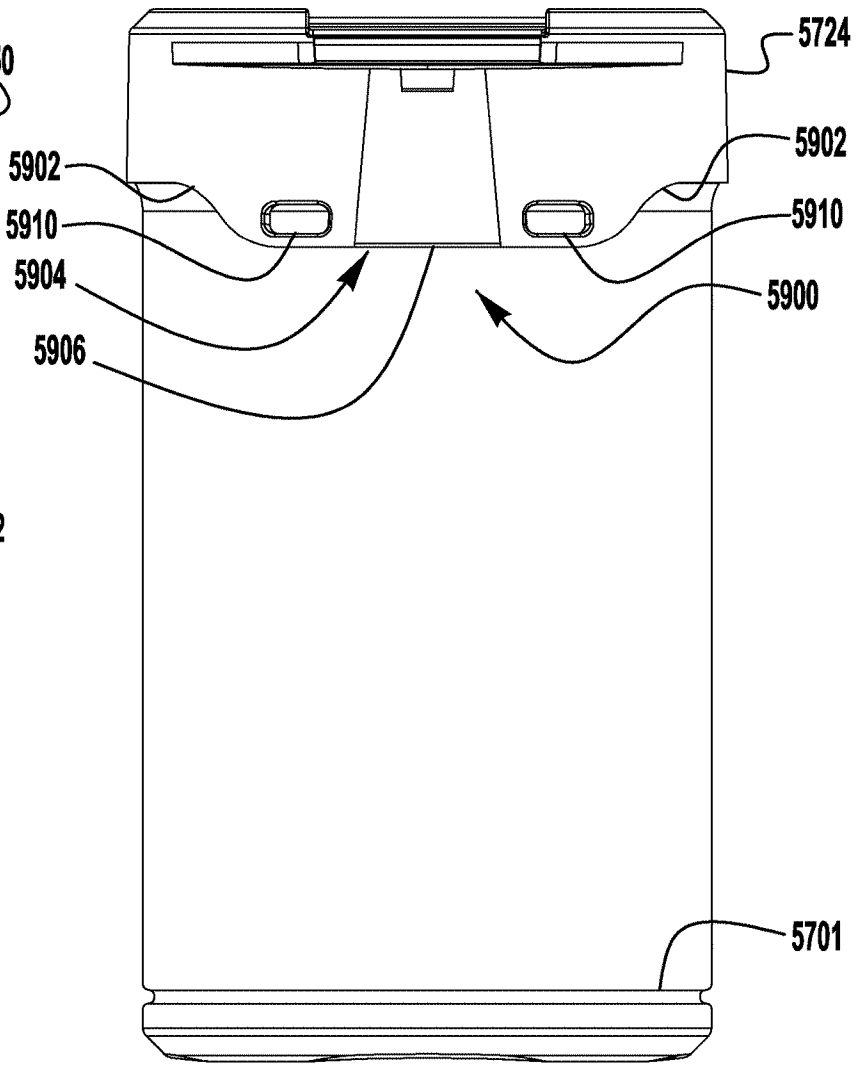
FIG. 59 is a rear view of the exemplary wipes dispensing canister of FIG. 2.
Figure 58:
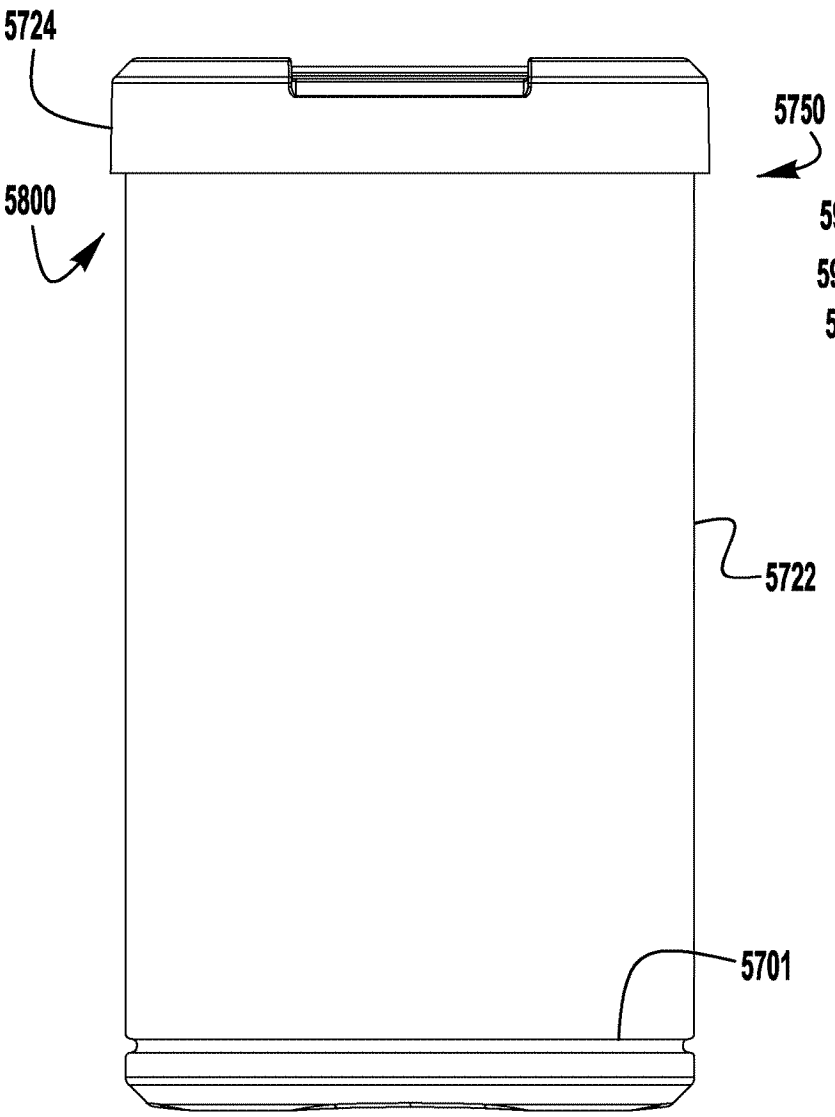
FIG. 58 is front view of an exemplary wipes dispensing canister having a cap or lid.

Wipes dispensing canister 5720 as shown in more detail in FIGS. 58 and 59 includes a cap 5724. Cap 5724 has a front side 5800 (FIG. 58) and a back side 5900 (FIG. 59). In this exemplary embodiment, cap 5724 includes an optional canister orientation member 5904 on the back side 5900. In this exemplary embodiment, canister orientation member 5904 is a downwardly extending tab 5906. Downwardly extending tab 5906 includes optional sloped surfaces 5902.

In this exemplary embodiment, canister orientation member 5904 is configured to mate with alignment member 6120 (FIG. 61) discussed in more detail below. Any mating configuration between canister orientation member 5904 and alignment member 6120 is contemplated such that the wipes dispensing canister 5720 and wall mounting bracket 5550 may be aligned in a selected orientation.

Optional canister orientation member 5904 may be used to ensure that the front of the wipes dispensing canister 5720 is located facing forward when the wipes dispensing canister 5720 is placed in the wall mounting bracket 5550. Many different configurations may be used for the optional canister orientation member 5904. For example, optional canister orientation member 5904 may be one or more protrusions, one or more recesses, combinations thereof, or the like, that are configured to mate with one or more recesses or protrusions (not shown) in an alignment member 6120 in wall mounting bracket 5750.

Figure 61:
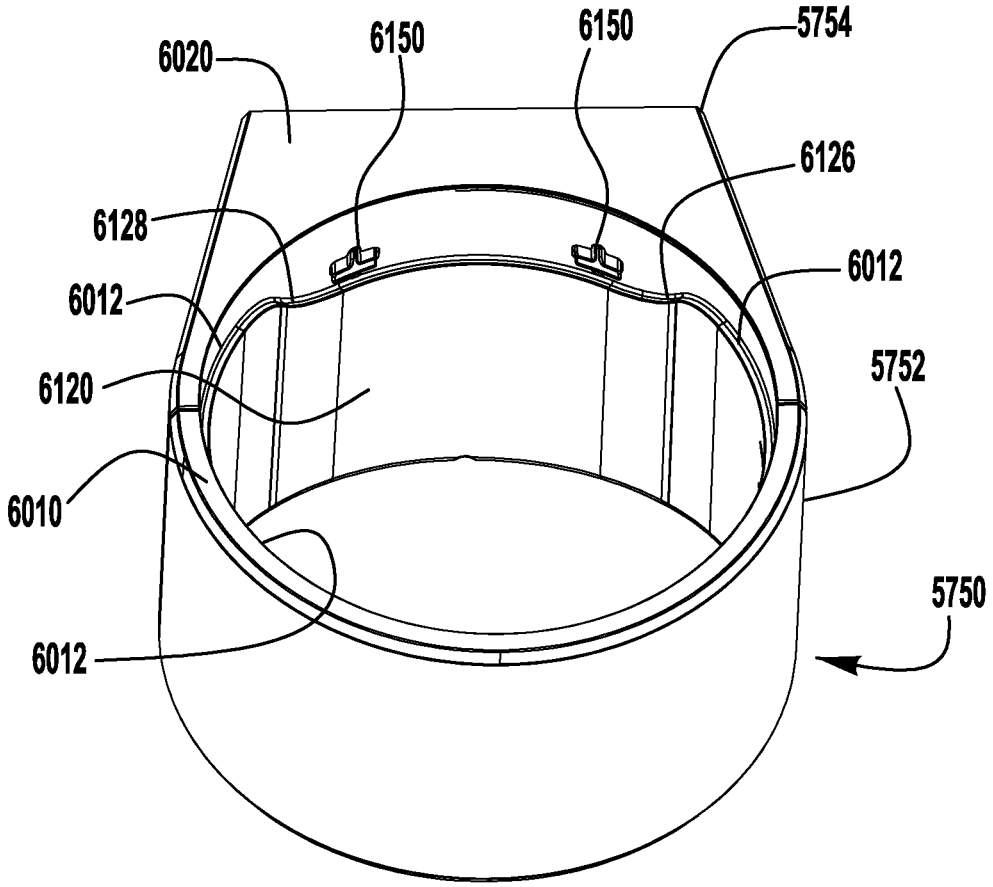
FIG. 61 is an exemplary prospective top prospective view of the exemplary wall mounting bracket of FIG. 4.

In some embodiments, located in cap 5724 are one or more catches 5910, which in this exemplary embodiment, are apertures. The one or more catches 5910 and one or more latches 6150 may be referred to herein as wall bracket locking members. The one or more catches 5910 are engaged by one or more latches 6150 (FIG. 61). When the one or more catches 5910 are engaged by the one or more latches 6150, the wipes dispensing canister 5720 is secured to the wall mounting bracket 5750. In some embodiments, the one or more latches 6150 are spring loaded and have a sloped surface so that when the wipes dispensing canister 5720 is dropped in the wall mounting bracket 5750 and the canister orientation member 5904 aligns with the alignment member 6120, the one or more latches 6150 move inward until they engage with the one or more catches 5910. Once the one or more latches 6150 engage with the one or more catches 5910, the wipes dispensing canister 5720 is secured to wall mounting bracket 5750. In this exemplary embodiment, to release the wipes dispensing canister 5720 from the wall mounting bracket 5750, one or more release members 5760 are depressed which causes the one or more latches 6150 to disengage from the one or more catches 5910.

In this exemplary embodiment, the one or more latches and one or more catches may be replaced with a different type of wall bracket locking members, such as, for example, a locking ring or partial locking ring, that may be rotated in a first direction to release the wipes canister 120 from the wall mounting bracket 150 and may be rotated in a second direction to secure the wipes canister 120 to the wall mounting bracket 150. In some embodiments, the locking ring is spring loaded so as to bias the locking ring in a locked position. In some embodiments, the locking members are one or more beads or projections that engage one or more grooves or recesses and the wipes canister 120 is secured to wall mounting bracket 5950 with a friction fit type locking mechanism. As with the canister orientation member 5904, wipes dispensing canister 5720 may have a base orientation member (not shown) that is configured to orientate the front of the wipes dispensing canister 5720.

Figure 60:
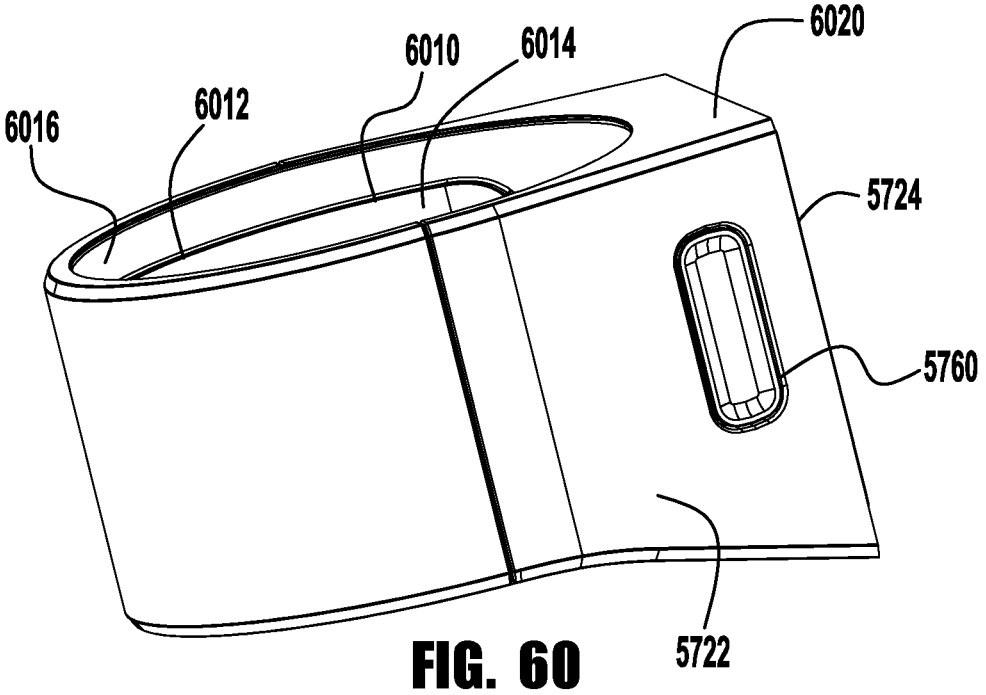
FIG. 60 is a perspective side view of an exemplary wall mounting bracket for the wipes dispensing canister of FIG. 2.

FIG. 60 is a side prospective view of exemplary wall mounting bracket 5750 for wipes dispensing canister 5720. Wall mounting bracket 5750 includes an opening 6010 that has a shape that corresponds to and/or matches the outside diameter and/or configuration of wipes dispensing canister 5720. In this exemplary embodiment, opening 6010 has a circular cross-section. Opening 6010 may be configured to correspond to any shape of wipes dispensing canister 5720 used. In this exemplary embodiment, opening 6010 is sized to fit around at least a portion of cap 5724. In some exemplary embodiments, opening 6010 is sized to fit around the wipes dispensing canister 5720, but is smaller than the cap 5724 such that the cap 5724 sits on top of the opening 6010. In this exemplary embodiment, wall mounting bracket includes a cap ridge 6012. Cap ridge has the same cross-sectional shape as the shape of the wipes dispensing canister 5720, and in this instance has a circular cross-section. Opening 6010 has a first wall 6014 that is slightly larger than the body 6022 of the wipes dispensing canister 5720. Opening 6010 has a second wall 6016 that is sized to be slightly larger than the cap 6024. Accordingly, when wipes dispensing canister 5720 is placed in wall mounting bracket 5750, the lower portion of cap 5724 is below the top surface 6020 of wall mounting bracket 5750. In some embodiments, cap 5724 includes one or more projections (not shown) that is (are) larger than at least a portion of opening 6010 and the one or more projections are configured to engage with a surface of wall mounting bracket 5750 to hold the wipes dispensing canister 5720 in the desired position.

FIG. 61 is a top prospective view of the exemplary wall mounting bracket 5750. In this exemplary embodiment, wall mounting bracket 5750 has an optional alignment member 6120 located in the rear of the wall mounting bracket 5750. The alignment member 6120 may be located in other places in the wall mounting bracket 5750 as described above and may take one of many different shapes to provide for the alignment features disclosed herein. Wall mounting bracket 5750 includes a top surface 6020, an opening 6010, a cap ridge 6012, one or more latches 6150, sloped surfaces 6128 in cap ridge 6012, which may be used for the alignment features disclosed herein. In some embodiments, there is a lock member (not shown) that locks the release member 5760 and prevents release member 5760 from operating. In some embodiments, lock member (not shown) is hidden so that casual users are unaware of its location and cannot remove the wipes dispensing canister from the wall mounting bracket 5750.

By securing the wipes dispensing canister 5720 to wall mounting bracket 5750 a user is able to open the wipes dispensing canister 5720 and remove one or more wipes without the need to hold onto the wipes dispensing canister 5720.

Figure 62:
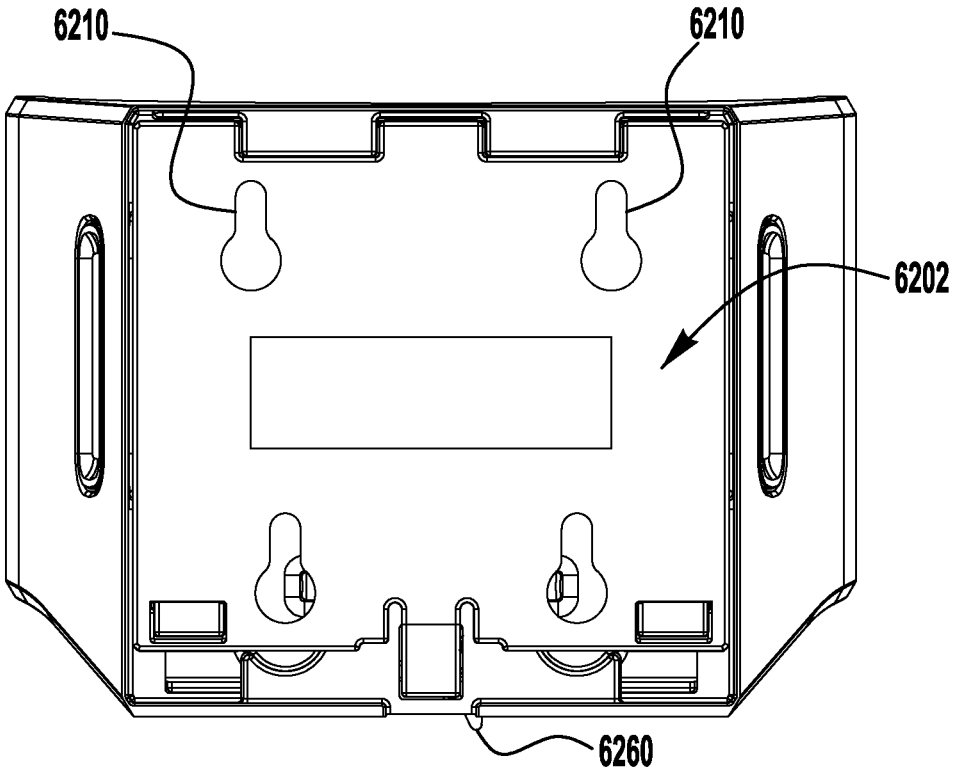

FIG. 62 is a rear view of the exemplary wall mounting bracket 5750 and base plate 6202. In this exemplary embodiment, base plate 6202 is configured with mounting holes 6210. The larger portion of mounting holes 6210 are configured to fit over the top of a screw head (not shown) and lowered down so that the shank of the screw is located in the top of the slot and the screw head prevents the base plate from pulling off the screw shank. In some embodiments, base plate 6202 is anchored to the wall using an adhesive. In some embodiments, base plate 6202 is anchored to the wall using two sided tape.

Wall mounting bracket 5750 is releasably secured to base plate 6202. In some embodiments, a plurality of tabs (not shown) engage a plurality of recesses to secure wall mounting bracket 5750 to base plate 6202.

Figure 63:
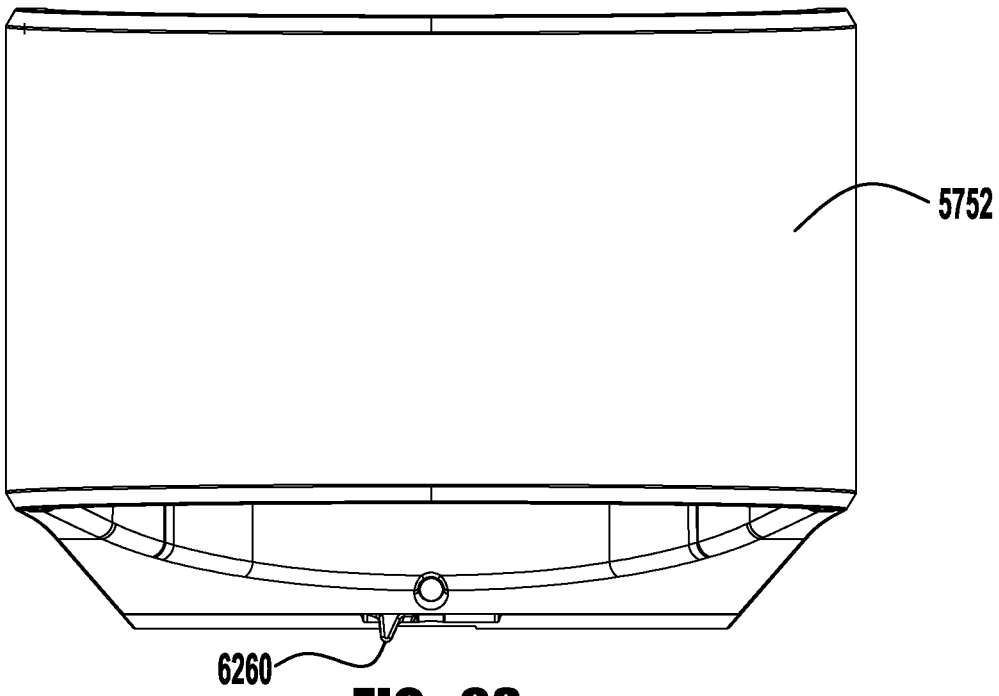
FIG. 63 is a rear view of the exemplary wall mounting bracket.

In this exemplary embodiment, an optional release member 6250 is used to lock or further secure wall mounting bracket 5750 to base plate 6202. In some embodiments, release member 6260 is a lever. In some embodiments, the lever is biased to a locked position and may be moved to an unlocked position to remove wall mounting bracket 5750 from base plate 6202. In some embodiments, release member 6260 is a button. In some embodiments, the button is biased to a locked position and may be moved to an unlocked position to remove wall mounting bracket 5750 from base plate 6202. FIG. 63 is a front view of the exemplary wall mounting bracket 5750 showing optional release member 6260.

In some embodiments the wall mounting bracket 5750 (and/or the base 400) includes a "lock-or-not" member or a lock member (not shown). The lock-or-not member prevents, or does not prevent, the release members from releasing the wipes dispenser canister from the wall mounting bracket 5750 and or the base 400. In some embodiments, the lock-or-not member may operate to allow the one or more release members to move without releasing the canister from the wall mounting bracket 5750 and/or the base 400 and/or from removing or not removing the base 400 from a surface. In some embodiments release member 6250 is the lock-or-not member. In this embodiment, the lock-or not member is located such that it will be between the wipes canister and the wall so it is hidden from the view of the casual observer. In some embodiments, the lock-or-not member is located below the eye level of a casual observer.

In some embodiments, the base, which may be similar to the base described above, does not have a sealing device as described above. In some embodiments, the base comprises the remaining elements or functionally similar elements. In some embodiments, located on the bottom of mounting base is a contact surface (not shown). Contact surface (not shown) is configured to contact the surface that mounting base (not shown) is mounted on. In some embodiments, contact surface (not shown) has an adhesive located thereon and a protective cover that may be removed so that the mounting base (not shown) may be secured to a surface. In some embodiments, the adhesive is a releasable or reusable adhesive. In some embodiments, the releasable adhesive may be released, wetted and re-adhered to a surface. In some embodiment, contact surface (not shown) is a protective surface, such as, for example, felt, which contacts the surface and prevents damage to the surface. In some embodiments, such as, for example, those using felt to protect surfaces, mounting base (not shown) includes one or more weighted elements to add weight to the mounting base (not shown) to help keep base mounting bracket from moving when a wipe is pulled out of the wipes dispensing canister.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention, in its broader aspects, is not limited to the specific details, the representative apparatus and illustrative examples shown and described. Accordingly, departures may be made from such details without departing from the spirit or scope of the applicant's general inventive concept.

We claim:

1. A wipes dispensing system comprising:
a wipes dispensing canister;
the wipes dispensing canister having a cylindrical body;
one of a catch and a latch; and
a cap;
a wall mounting bracket;
the wall mounting bracket having
an opening therethrough for receiving the wipes dispensing canister;
wherein the cylindrical body of the dispensing canister is lowered through the opening;
a cap ridge for engaging a portion of the cap to support the wipes dispensing canister in the wall mounting bracket;
the other one of the catch and the latch;
wherein when the wipes dispensing canister is located within the wall mounting bracket, a bottom edge of the cap is located proximate the cap ridge; and
wherein a bottom of the wipes dispensing canister is located below a bottom of the wall mounting bracket.

2. The wipes dispensing system of claim 1 wherein the wall mounting bracket completely encircles the wipes dispensing canister.

3. The wipes dispensing system of claim 1 wherein the wipes dispensing canister further comprises a base mounting catch for securing the wipes canister in a base mounting bracket.

4. The wipes dispensing system of claim 1 further comprising an orientation member configured to orientate a front of the wipes dispensing canister to face a front of the wall mounting bracket.

5. The wipes dispensing system of claim 4 wherein the orientation member is located on the cap.

6. The wipes dispensing system of claim 4 wherein the orientation member comprises a protrusion that engages an alignment member.

7. The wipes dispensing system of claim 5 wherein the alignment member is located on the wall mounting bracket.

8. The wipes dispensing system of claim 1 further comprising a release member for disengaging on of the latch and the catch.

9. The wipes dispensing system of claim 8 further comprising a second release member for disengaging the latch from the catch, wherein the first release member is on a first side of the wall mounting bracket and the second release member is on a second side of the bracket.

10. The wipes dispensing system of claim 8 further comprising a lock-or-not member for locking the release member.

11. A base for a wipes dispensing system;
the base having
a receiver;
a sealing device;
a base plate;
one or more canister retention members; and
an actuator;
wherein the actuator has a plurality of functional positions;
wherein in a first functional position, the base is sealed to a surface with a suction force and a wipes dispensing canister is engaged by the one or more wipes canister retention members thereby retaining the wipes dispensing canister in the base;
wherein in a second functional position, at least one of the suction force is released allowing the base to be freely removable from the surface and the canister retention members are disengaged from the wipes dispensing canister allowing the wipes dispensing canister to be removed from the base.

12. The base for a wipes dispensing system of claim 11 wherein the actuator is biased toward the first functional position.

13. The base for a wipes dispensing system of claim 11 wherein the actuator comprises an aperture therethrough and wherein when the aperture is placed in fluid communication with area between the sealing device and the surface, the suction force is released.

14. The base for a wipes dispensing system of claim 11 further comprising a third functional position, wherein in the third functional position the suction force is released allowing the base to be freely removable from the surface and the canister retention members are disengaged from the wipes dispensing canister allowing the wipes dispensing canister to be removed from the base.

15. The base for a wipes dispensing system of claim 11 wherein the base plate is moveable between a first position and a second position and wherein in the first position, the wipes canister engagement members are in an engaged position and wherein when the base plate is in the second position the wipes canister engagement members are in a disengaged position.

16. The base for a wipes dispensing system of claim 15 wherein the first position is lower than the second position.

17. A wipes dispensing canister comprising:

an elongated body;

a base located proximate a first end of the elongated body;

wherein the base comprises a closed end;

an opening located proximate a second end of the elongated body;

a cap located over the opening;

an annular groove located at least partially around the elongated body;

wherein the annular groove is located proximate the closed end of the base;

wherein the annular groove is configured to mate with a wipes canister retention member located in a base mounting bracket for a wipes dispensing canister.

18. The wipes dispensing canister of claim 17 wherein the annular groove is continuous around the elongated body.

19. The wipes dispensing canister of claim 17 wherein the cap has one of a latch and a catch; and wherein the one of the latch and a catch is configured to mate with the other of a latch and a catch in a wall mounting bracket for a wipes dispensing canister.

20. The wipes dispensing canister of claim 19 wherein the cap comprises a lid.

* * * * *